US009057258B2

(12) United States Patent
Benson

(10) Patent No.: US 9,057,258 B2
(45) Date of Patent: Jun. 16, 2015

(54) SYSTEM AND METHOD FOR USING CONTROLLED VIBRATIONS FOR BOREHOLE COMMUNICATIONS

(71) Applicant: HUNT ADVANCED DRILLING TECHNOLOGIES, L.L.C., Dallas, TX (US)

(72) Inventor: Todd W. Benson, Dallas, TX (US)

(73) Assignee: Hunt Advanced Drilling Technologies, LLC, Dallas, TX (US)

( * ) Notice: Subject to any disclaimer, the term of this patent is extended or adjusted under 35 U.S.C. 154(b) by 0 days.

(21) Appl. No.: 14/508,849

(22) Filed: Oct. 7, 2014

(65) Prior Publication Data

US 2015/0023137 A1 Jan. 22, 2015

Related U.S. Application Data

(63) Continuation-in-part of application No. 14/467,727, filed on Aug. 25, 2014, which is a continuation of application No. 14/145,044, filed on Dec. 31, 2013, now Pat. No. 8,783,342, which is a continuation of (Continued)

(51) Int. Cl.
*E21B 47/16* (2006.01)
*E21B 28/00* (2006.01)

(52) U.S. Cl.
CPC ..... *E21B 47/16* (2013.01); *E21B 28/00* (2013.01)

(58) Field of Classification Search
CPC ..... E21B 34/00; E21B 44/00; E21B 7/24; E21B 28/00; E21B 1/00; E21B 7/04; E21B 7/068; E21B 4/10; E21B 47/12; E21B 47/16
USPC ..... 175/57, 40, 56, 106, 24, 415, 45, 55; 166/177.1, 177.2; 173/2, 91, 128, 207
See application file for complete search history.

(56) References Cited

U.S. PATENT DOCUMENTS 2,742,265 A * 4/1956 Snyder ..... 175/56
3,768,576 A 10/1973 Martini
4,794,534 A 12/1988 Millheim (Continued)

FOREIGN PATENT DOCUMENTS

GB 2236782 A 4/1991
WO 2005071441 A1 8/2005
WO 2009039448 A2 3/2009

OTHER PUBLICATIONS

Saputelli, L. et al., "Real-Time Decision-Making for Value Creation While Drilling," SPE/IADC 85314; Middle East Drilling Technology Conference & Exhibition Held in Abu Dhabi, UAE, Oct. 20-22, 2003; 19 pages.

(Continued)

*Primary Examiner* — Daniel P Stephenson
(74) *Attorney, Agent, or Firm* — Howison & Arnott, LLP

(57) ABSTRACT

A system for producing controlled vibrations within a borehole comprises a vibration mechanism an impact to produce a plurality of vibration beats. The vibration mechanism is located substantially near a bottom hole assembly within the borehole. A damping mechanism selectively damps the vibration beats to encode information therein. The damping mechanism is located remotely from the vibration mechanism along a drill string of the bottom hole assembly.

28 Claims, 37 Drawing Sheets

Related U.S. Application Data application No. 14/010,259, filed on Aug. 26, 2013, now Pat. No. 8,678,107, which is a continuation of application No. 13/752,112, filed on Jan. 28, 2013, now Pat. No. 8,517,093.

(60) Provisional application No. 61/693,848, filed on Aug. 28, 2012, provisional application No. 61/644,701, filed on May 9, 2012.

(56) References Cited

U.S. PATENT DOCUMENTS

| | | | |
|---|---|---|---|
| 5,193,628 | A | 3/1993 | Foster |
| 5,220,963 | A | 6/1993 | Patton |
| 5,812,068 | A | 9/1998 | Beimgraben et al. |
| 6,088,294 | A | 7/2000 | Balogh et al. |
| 6,233,524 | B1 | 5/2001 | Harrell et al. |
| 6,272,434 | B1 | 8/2001 | Wisler et al. |
| 6,279,702 | B1 | 8/2001 | Koh |
| 6,408,953 | B1 | 6/2002 | Goldman et al. |
| 6,424,919 | B1 | 7/2002 | Moran et al. |
| 6,523,623 | B1 | 2/2003 | Schuh |
| 6,577,954 | B2 | 6/2003 | Alft et al. |
| 6,612,382 | B2 | 9/2003 | King |
| 6,732,052 | B2 | 5/2004 | MacDonald et al. |
| 7,000,710 | B1 | 2/2006 | Umbach et al. |
| 7,003,439 | B2 | 2/2006 | Aldred et al. |
| 7,011,156 | B2 | 3/2006 | von Gynz-Rekowski |
| 7,032,689 | B2 | 4/2006 | Goldman et al. |
| 7,054,750 | B2 | 5/2006 | Rodney et al. |
| 7,085,696 | B2 | 8/2006 | King |
| 7,136,795 | B2 | 11/2006 | Downton |
| 7,142,986 | B2 | 11/2006 | Moran |
| 7,342,504 | B2 | 3/2008 | Crane |
| 7,460,957 | B2 | 12/2008 | Prange et al. |
| 7,606,666 | B2 | 10/2009 | Repin et al. |
| 7,653,563 | B2 | 1/2010 | Veeningen et al. |
| 7,684,929 | B2 | 3/2010 | Prange et al. |
| 7,823,655 | B2 | 11/2010 | Boone et al. |
| 7,860,593 | B2 | 12/2010 | Boone et al. |
| 7,938,197 | B2 | 5/2011 | Boone et al. |
| 7,945,488 | B2 | 5/2011 | Karr et al. |
| 8,010,290 | B2 | 8/2011 | Illfelder |
| 8,217,093 | B2 | 7/2012 | Reinheimer |
| 8,256,534 | B2 * | 9/2012 | Byreddy et al. ..... 175/57 |
| 8,622,153 | B2 | 1/2014 | McLoughlin et al. |
| 8,678,107 | B2 | 3/2014 | Benson |
| 8,783,342 | B2 | 7/2014 | Benson |
| 2001/0042642 | A1 | 11/2001 | King |
| 2001/0054514 | A1 | 12/2001 | Sullivan et al. |
| 2002/0103630 | A1 | 8/2002 | Aldred et al. |
| 2002/0139581 | A1 | 10/2002 | DeJesus et al. |
| 2003/0024738 | A1 | 2/2003 | Schuh |
| 2004/0168811 | A1 | 9/2004 | Shaw et al. |
| 2005/0194130 | A1 | 9/2005 | Best et al. |
| 2005/0194185 | A1 | 9/2005 | Gleitman |
| 2006/0151214 | A1 | 7/2006 | Prange et al. |
| 2006/0203614 | A1 | 9/2006 | Harmon |
| 2008/0172272 | A1 | 7/2008 | Back et al. |
| 2009/0076873 | A1 | 3/2009 | Johnson et al. |
| 2009/0090555 | A1 | 4/2009 | Boone et al. |
| 2009/0120690 | A1 | 5/2009 | Phillips |
| 2010/0139977 | A1 | 6/2010 | Watkins et al. |
| 2010/0191516 | A1 | 7/2010 | Benish et al. |
| 2010/0259415 | A1 | 10/2010 | Strachan et al. |
| 2011/0067928 | A1 | 3/2011 | Hulden et al. |
| 2011/0153300 | A1 | 6/2011 | Holl et al. |
| 2012/0048621 | A1 | 3/2012 | Stewart et al. |
| 2012/0126992 | A1 | 5/2012 | Rodley et al. |
| 2012/0285701 | A1 | 11/2012 | Cheng et al. |
| 2013/0032402 | A1 | 2/2013 | Byreddy et al. |
| 2013/0092441 | A1 | 4/2013 | Hummes et al. |
| 2013/0140037 | A1 | 6/2013 | Sequeira et al. |
| 2013/0262048 | A1 | 10/2013 | Tang et al. |
| 2013/0340999 | A1 | 12/2013 | Benson |
| 2014/0110106 | A1 | 4/2014 | Fripp et al. |
| 2014/0144705 | A1 | 5/2014 | Baudoin |
| 2014/0174726 | A1 | 6/2014 | Harrigan et al. |

OTHER PUBLICATIONS

Patent Cooperation Treaty: International Search Report and Written Opinion of related application PCT/US2013/040411; Adri Schouten; Sep. 17, 2014; 14 pages.

* cited by examiner 900
902
904
906
908
910
912
914

SYSTEM AND METHOD FOR USING CONTROLLED VIBRATIONS FOR BOREHOLE COMMUNICATIONS

CROSS-REFERENCE TO RELATED APPLICATIONS

This application is a continuation-in-part of U.S. patent application Ser. No. 14/467,727, filed Aug. 25, 2014, entitled SYSTEM AND METHOD FOR STEERING IN A DOWNHOLE ENVIRONMENT USING VIBRATION MODULATION, which is a continuation of U.S. patent application Ser. No. 14/145,044, filed Dec. 31, 2013, now U.S. Pat. No. 8,783,342, issued Jul. 22, 2014, entitled SYSTEM AND METHOD FOR USING CONTROLLED VIBRATIONS FOR BOREHOLE COMMUNICATIONS, which is a continuation of U.S. patent application Ser. No. 14/010,259, filed Aug. 26, 2013, now U.S. Pat. No. 8,678,107, issued on Mar. 25, 2014, entitled SYSTEM AND METHOD FOR DRILLING HAMMER COMMUNICATION, FORMATION EVALUATION AND DRILLING OPTIMIZATION, which is a continuation of U.S. patent application Ser. No. 13/752,112, filed Jan. 28, 2013, now U.S. Pat. No. 8,517,093, issued on Aug. 27, 2013, entitled SYSTEM AND METHOD FOR DRILLING HAMMER COMMUNICATION, FORMATION EVALUATION AND DRILLING OPTIMIZATION, which claims benefit from U.S. Provisional Application No. 61/693,848, filed Aug. 28, 2012, and entitled SYSTEM AND METHOD FOR DRILLING HAMMER COMMUNICATION AND FORMATION EVALUATION USING MAGNETORHEOLOGICAL FLUID VALVE ASSEMBLY. U.S. patent application Ser. No. 13/752,112 also claims benefit from U.S. Provisional Application No. 61/644,701, filed May 9, 2012, and entitled SYSTEM AND METHOD FOR DRILLING HAMMER COMMUNICATION AND FORMATION EVALUATION.

TECHNICAL FIELD

The following disclosure relates to directional and conventional drilling.

BACKGROUND

Drilling a borehole for the extraction of minerals has become an increasingly complicated operation due to the increased depth and complexity of many boreholes, including the complexity added by directional drilling. Drilling is an expensive operation and errors in drilling add to the cost and, in some cases, drilling errors may permanently lower the output of a well for years into the future. Current technologies and methods do not adequately address the complicated nature of drilling. Accordingly, what is needed are a system and method to improve drilling operations.

SUMMARY

The present invention, as disclosed and described herein, comprises a system for producing controlled vibrations within a borehole comprises a vibration mechanism an impact to produce a plurality of vibration beats. The vibration mechanism is located substantially near a bottom hole assembly within the borehole. A damping mechanism selectively damps the vibration beats to encode information therein. The damping mechanism is located remotely from the vibration mechanism along a drill string of the bottom hole assembly.

BRIEF DESCRIPTION OF THE DRAWINGS

For a more complete understanding, reference is now made to the following description taken in conjunction with the accompanying Drawings in which.

DETAILED DESCRIPTION

Figure 1A:
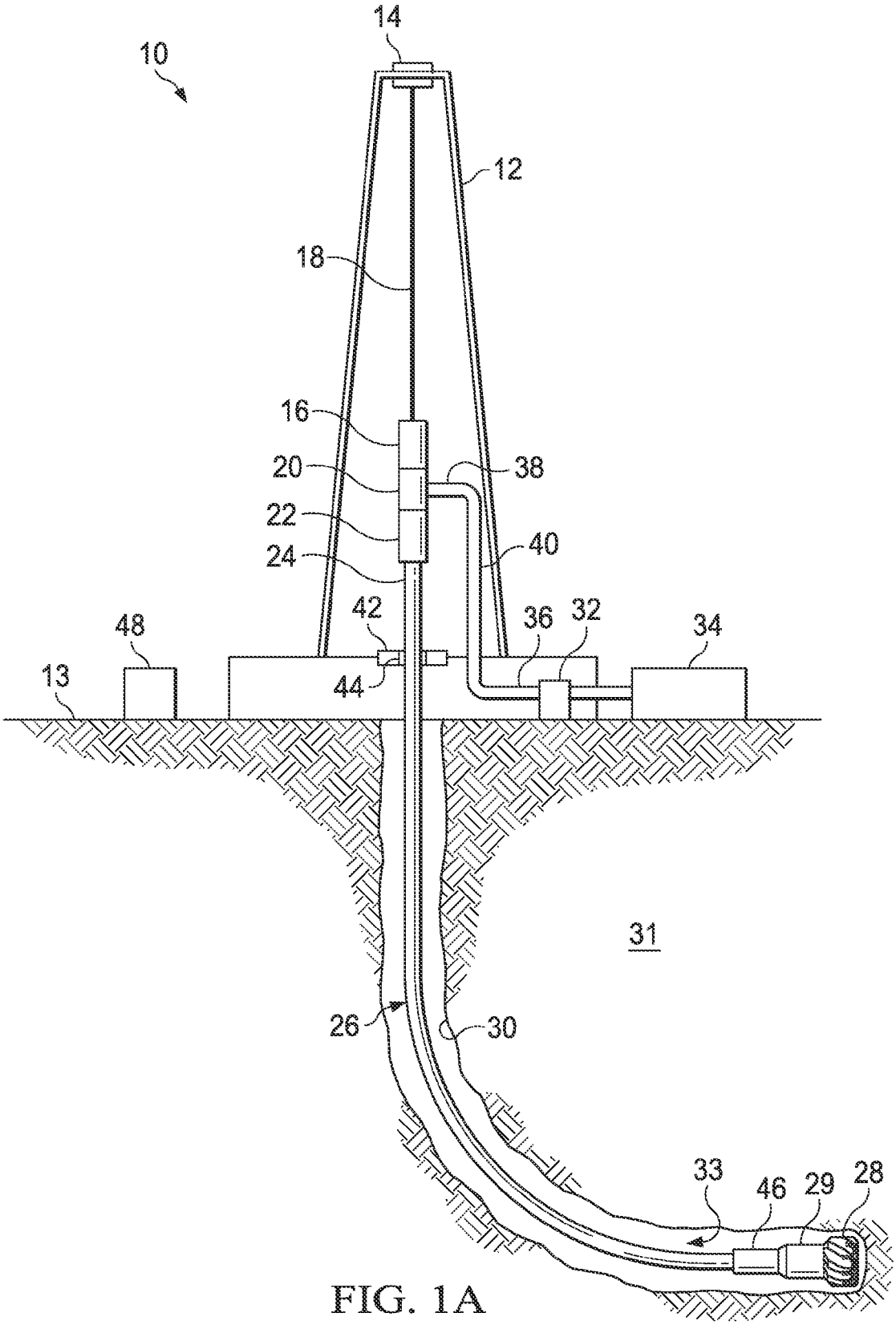
FIG. 1A illustrates an environment within which various aspects of the present disclosure may be implemented.

Referring now to the drawings, wherein like reference numbers are used herein to designate like elements throughout, the various views and embodiments of a system and method for creating and detecting vibrations during hammer drilling are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

During the drilling of a borehole, it is generally desirable to receive data relating to the performance of the bit and other downhole components, as well as other measurements such as the orientation of the toolface. While such data may be obtained via downhole sensors, the data should be communicated to the surface at some point. However, data communication from downhole sensors to the surface tends to be excessively slow using current mud pulse and electromagnetic (EM) methods. For example, data rates may be in the single digit baud rates, which may mean that updates occur at a minimum interval (e.g., ten seconds). It is understood that various factors may affect the actual baud rate, such depth, flow rate, fluid density, and fluid type.

The relatively slow communication rate presents a challenge as advances in drilling technology increase the rate of penetration (ROP) that is possible. As drilling speed increases, more downhole sensor information is needed and needed more quickly in order to geosteer horizontal wells at higher speeds. For example, geologists may desire a minimum of one gamma reading per foot in complicated wells. If the drilling speed relative to the communication rate is such that there is only one reading every three to five feet, which may be fine for simple wells, the bit may have to be backed up and part of the borehole re-logged more slowly to get the desired one reading per foot. Accordingly, the drilling industry is facing the possibility of having to slow down drilling speeds in order to gain enough logging information to be able to make steering decisions.

This problem is further exacerbated by the desire for even more sensor information from downhole. As mud pulse and EM telemetry are serial channels, adding additional sensor information makes the communication problem worse. For example, if the current data rate enables a gamma reading to be sent to the surface every ten seconds via mud pulse, adding additional sensor information that must be sent along the same channel means that the ten second interval between gamma readings will increase unless the gamma reading data is prioritized. If the gamma reading data is prioritized, then other information will be further delayed. Another method for increased throughput is to use lower resolution data that, although the throughput is increased, provides less detailed data.

One possible approach uses wired pipe (e.g., pipe having conductive wiring and interconnects on either end), which may be problematic because each piece of the drill string has to be wired and has to function properly. For example, for a twenty thousand foot horizontal well, this means approximately six hundred connections have to be made and all have to function properly for downhole to surface communication to occur. While this approach provides a fast data transfer rate, it may be unreliable because of the requirement that each component work and a single break in the chain may render it useless. Furthermore, it may not be industry compatible with other downhole tools that may be available such as drilling jars, stabilizers, and other tools that may be connected in the drill string.

Another possible approach is to put more electronics (e.g., computers) downhole so that more decisions are made downhole. This minimizes the amount of data that needs to be transferred to the surface, and so addresses the problem from a data aspect rather than the actual transfer speed. However, this approach generally has to deal with high heat and vibration issues downhole that can destroy electronics and also puts more high cost electronics at risk, which increases cost if they are lost or damaged. Furthermore, if something goes wrong downhole, it can be difficult to determine what decisions were made, whether a particular decision was made correctly or incorrectly, and how to fix an incorrect decision.

Vibration based communications within a borehole typically rely on an oscillator that is configured to produce the vibrations and a transducer that is configured to detect the vibrations produced by the oscillator. However, the downhole power source for the oscillator is often limited and does not supply much power. Accordingly, the vibrations produced by the oscillator are fairly weak and lack the energy needed to travel very far up the drill string. Furthermore, drill strings typically have dampening built in at certain points inherently (e.g., the large amount of rubber contained in the power section stator) and the threaded connections may provide additional dampening, all of which further limit the distance the vibrations can travel.

Referring to FIG. 1A, one embodiment of an environment 10 is illustrated in which various configurations of vibration creation and/or control functionality may be used to provide frequency tuning, formation evaluation, improvements in rate of penetration (ROP), high speed data communication, friction reduction, and/or other benefits. Although the environment 10 is a drilling environment that is described with a top drive drilling system, it is understood that other embodiments may include other drilling systems, such as rotary table systems.

In the present example, the environment 10 includes a derrick 12 on a surface 13. The derrick 12 includes a crown block 14. A traveling block 16 is coupled to the crown block 14 via a drilling line 18. In a top drive system (as illustrated), a top drive 20 is coupled to the traveling block 16 and provides the rotational force needed for drilling. A saver sub 22 may sit between the top drive 20 and a drill pipe 24 that is part of a drill string 26. The top drive 20 rotates the drill string 26 via the saver sub 22, which in turn rotates a drill bit 28 of a bottom hole assembly (BHA) 29 in a borehole 30 in formation 31. A mud pump 32 may direct a fluid mixture (e.g., mud) 33 from a mud pit or other container 34 into the borehole 30. The mud 33 may flow from the mud pump 32 into a discharge line 36 that is coupled to a rotary hose 38 by a standpipe 40. The rotary hose 38 is coupled to the top drive 20, which includes a passage for the mud 33 to flow into the drill string 26 and the borehole 30. A rotary table 42 may be fitted with a master bushing 44 to hold the drill string 26 when the drill string is not rotating.

As will be described in detail in the following disclosure, one or more downhole tools 46 may be provided in the borehole 30 to create controllable vibrations. Although shown as positioned behind the BHA 29, the downhole tool 46 may be part of the BHA 29, positioned elsewhere along the drill string 26, or distributed along the drill string 26 (including within the BHA 29 in some embodiments). Using the downhole tool 46, tunable frequency functionality may be provided that can used for communications as well as to detect various parameters such as rotations per minute (RPM), weight on bit (WOB), and formation characteristics of a formation in front of and/or surrounding the drill bit 28. By tuning the frequency, an ideal drilling frequency may be provided for faster drilling. The ideal frequency may be determined based on formation and drill bit combinations and the communication carrier frequency may be oscillated around the ideal frequency, and so may change as the ideal frequency changes based on the formation. Frequency tuning may occur in various ways, including physically configuring an impact mechanism to vary an impact pattern and/or by skipping impacts through dampening or other suppression mechanisms.

In some embodiments, the presence of a high amplitude vibration device within the drill string 26 may improve drilling performance and control by reducing the static friction of the drill string 26 as it contacts the sides of the borehole 30. This may be particularly beneficial in long lateral wells and may provide such improvements as the ability to control WOB and toolface orientation.

Although the following embodiments may describe the downhole tool 46 as being incorporated into a mud motor type assembly, the vibration generation and control functionality provided by the downhole tool 46 may be incorporated into a variety of standalone device configurations placed anywhere in the drill string 26. These devices may come in the form of agitator variations, drilling sensor subs, dedicated signal repeaters, and/or other vibration devices. In some embodiments, it may be desirable to have separation between the downhole tool 46 and the bottom hole assembly (BHA) for implementation reasons. In some embodiments, distributing the locations of such mechanisms along the drill string 26 may be used to relay data to the surface if transmission distance limits are reached due to increases in drill string length and hole depth. Accordingly, the location of the vibration creation device or devices does not have a required position within the drill string 26 and both single unit and multi-unit implementations may distribute placement of the vibration generating/encoding device throughout the drill string 26 based on the specific drilling operation being performed.

Vibration control and/or sensing functionality may be downhole and/or on the surface 13. For example, sensing functionality may be incorporated into the saver sub 22 and/or other components of the environment 10. In some embodiments, sensing and/or control functionality may be provided via a control system 48 on the surface 13. The control system 48 may be located at the derrick 12 or may be remote from the actual drilling location. For example, the control system 48 may be a system such as is disclosed in U.S. Pat. No. 8,210,283 entitled SYSTEM AND METHOD FOR SURFACE STEERABLE DRILLING, filed on Dec. 22, 2011, and issued on Jul. 3, 2012, which is hereby incorporated by reference in its entirety. Alternatively, the control system 48 may be a stand alone system or may be incorporated into other systems at the derrick 12. For example, the control system 48 may receive vibration information from the saver sub 22 via a wired and/or wireless connection (not shown). Some or all of the control system 48 may be positioned in the downhole tool 46, or may communicate with a separate controller in the downhole tool 46. The environment 10 may include sensors positioned on and/or around the derrick 12 for purposes such as detecting environmental noise that can then be canceled so that the environmental noise does not negatively affect the detection and decoding of downhole vibrations.

The following disclosure often refers using the WOB force as the source of impact force, it is understood that there are other mechanisms that may be used to store the impact energy potential, including but not limited to springs of many forms, sliding masses, and pressurized fluid/gas chambers. For example, a predictable spring load device could be used without dependency on WOB. This alternative might be preferred in some embodiments as it might allow greater control and predictability of the forces involved, as well as provide impact force when WOB does not exist or is minimal. As an additional or alternate possibility, a spring like preload may be used in conjunction with WOB forces to allow for vibration generation when the bit 28 is not in contact with the drilling surface.

Figure 1D:
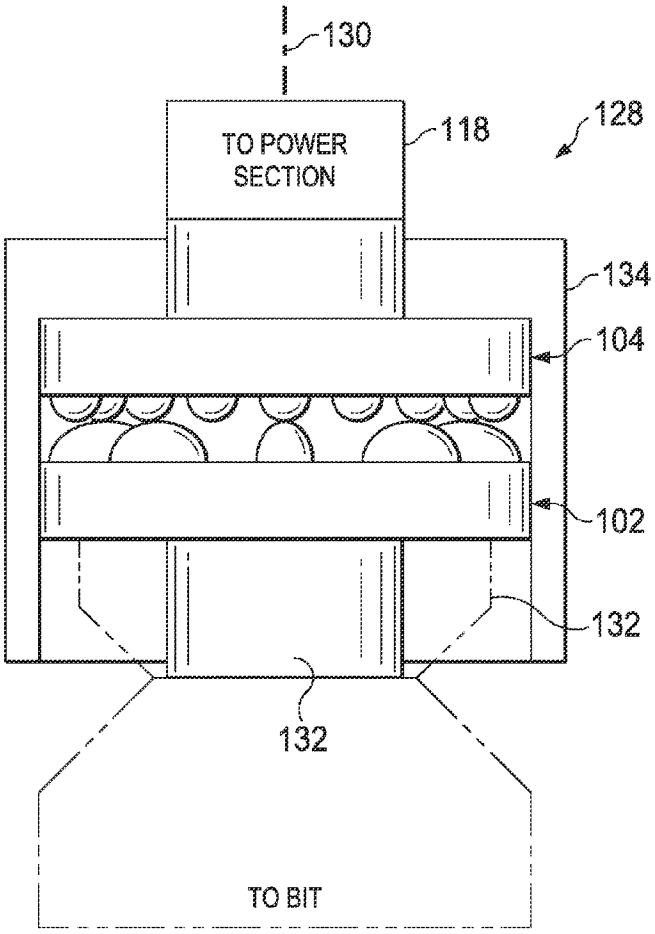
FIG. 1D illustrates one embodiment of a portion of a hammer drill drill string with which the anvil plate of FIG. 1B and the encoder plate of FIG. 1C may be used.
Figure 1B:
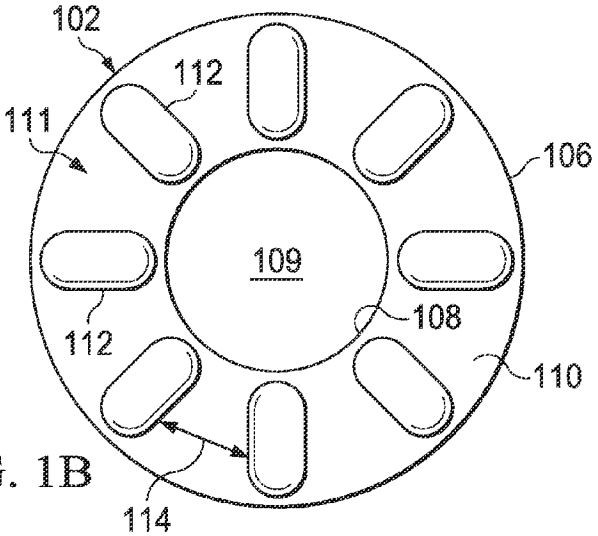
FIG. 1B illustrates one embodiment of an anvil plate that may be used in the creation of vibrations.
Figure 1C:
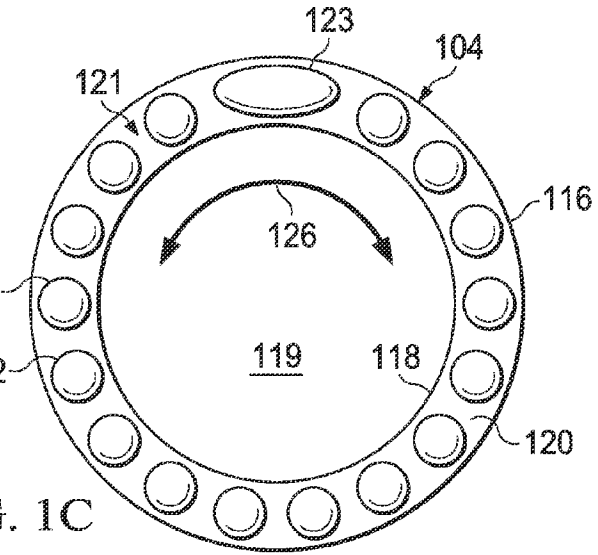
FIG. 1C illustrates one embodiment of an encoder plate that may be used with the anvil plate of FIG. 1B in the creation of vibrations.

Referring to FIGS. 1B-1D, embodiments of vibration causing components are illustrated that may be used to create downhole vibrations within an environment such as the environment 10 of FIG. 1A. More specifically, FIG. 1B illustrates an anvil plate 102, FIG. 1C illustrates an encoder plate 104, and FIG. 1D illustrates the anvil plate 102 and encoder plate 104 in one possible opposing configuration as part of a drill string, such as the drill string 26. In the present example, the anvil plate 102 and encoder plate 104 may be configured to provide a tunable frequency that can used for communications as well as to detect various parameters such as rotations per minute (RPM), weight on bit (WOB), and formation characteristics of the formation 31 in front of and/or surrounding bit 28 of the drill string 26. The anvil plate 102 and encoder plate 104 may also be tuned to provide an ideal drilling frequency to provide for faster drilling. The ideal frequency may be determined based on formation and drill bit combinations and the communication carrier frequency may be oscillated around the ideal frequency, and so may change as the ideal frequency changes based on the formation. Accordingly, while much of the drilling industry is focused on minimizing vibrations, the current embodiment actually creates vibrations using a mechanical vibration mechanism that is tunable.

In the current example, the anvil plate 102 and encoder plate 104 are used with hammer drilling. As is known, hammer drilling uses a percussive impact in addition to rotation of the drill bit in order to increase drilling speed by breaking up the material in front of the drill bit. The current embodiment may use the thrust load of the hammer drilling with the anvil plate 102 and encoder plate 104 to create the vibrations, while in other embodiments the anvil plate 102 and encoder plate 104 may not be part of the thrust load and may use another power source (e.g., a hydraulic source, a pneumatic source, a spring load, or a source that leverages potential energy) to power the vibrations. While hammer drilling traditionally uses an air medium, the current example may use other fluids (e.g., drilling muds) with the hammer drill as liquids are generally needed to control the well. A mechanical vibration mechanism as provided in the form of the anvil plate 102 and encoder plate 104 works well in such a liquid environment as the liquid may serve as a lubricant for the mechanism.

Referring specifically to FIG. 1B, the anvil plate 102 may be configured with an outer perimeter 106 and an inner perimeter 108 that defines an interior opening 109. Spaces 110 may be defined between bumps 112 and may represent an upper surface 111 of a substrate material (e.g., steel) forming the anvil plate 102. In the present example, the spaces 110 are substantially flat, but it is understood that the spaces 110 may be curved, grooved, slanted inwards and/or outwards, have angles of varying slope, and/or have a variety of other shapes. In some embodiments, the area and/or shape of a space 110 may vary from the area/shape of another space 110.

It is understood that the term "bump" in the present embodiment refers to any projection from the surface 111 of the substrate forming the anvil plate 102. Accordingly, a configuration of the anvil plate 102 that is grooved may provide bumps 112 as the lands between the grooves. A bump 112 may be formed of the substrate material itself or may be formed from another material or combination of materials. For example, a bump 112 may be formed from a material such as polydiamond crystal (PDC), stellite (as produced by the Deloro Stellite Company), and/or another material or material combination that is resistant to wear. A bump 112 may be formed as part of the surface 111, may be fastened to the surface 111 of the substrate, may be placed at least partially in a hole provided in the surface 111, or may be otherwise embedded in the surface 111.

The bumps 112 may be of many shapes and/or sizes, and may curved, grooved, slanted inwards and/or outwards, have varying slope angles, and/or may have a variety of other shapes. In some embodiments, the area and/or shape of a bump 112 may vary from the area/shape of another bump 112. Furthermore, the distance between two particular points of two bumps 112 (as represented by arrow 114) may vary between one or more pairs of bumps. The bumps 112 may have space between the bumps themselves and between each bump and one or both of the inner and outer perimeters 106 and 108, or may extend from approximately the outer perimeter 106 to the inner perimeter 108. The height of each bump 112 may be substantially similar (e.g., less than an inch above the surface 111) in the present example, but it is understood that one or more of the bumps may vary in height.

Referring specifically to FIG. 1C, the encoder plate 104 may be configured with an outer perimeter 116 and an inner perimeter 118 that defines an interior opening 119. Spaces 120 may be defined between bumps 122 and may represent an upper surface 121 of a substrate material (e.g., steel) forming the encoder plate 104. In the present example, the spaces 120 are substantially flat, but it is understood that the spaces 120 may be curved, grooved, slanted inwards and/or outwards, have angles of varying slopes, and/or have a variety of other shapes. In some embodiments, the area and/or shape of a space 120 may vary from the area/shape of another space 120.

It is understood that the term "bump" in the present embodiment refers to any projection from the surface 121 of the substrate forming the encoder plate 104. Accordingly, a configuration of the encoder plate 104 that is grooved may provide bumps 122 as the lands between the grooves. A bump 122 may be formed of the substrate material itself or may be formed from another material or combination of materials. For example, a bump 122 may be formed from a material such as PDC, stellite, and/or another material or material combination that is resistant to wear. A bump 122 may be formed as part of the surface 121, may be fastened to the surface 121 of the substrate, may be placed at least partially in a hole provided in the surface 121, or may be otherwise embedded in the surface 121.

The bumps 122 may be of many shapes and/or sizes, and may curved, grooved, slanted inwards and/or outwards, have varying slope angles, and/or may have a variety of other shapes. In some embodiments, the area and/or shape of a bump 122 may vary from the area/shape of another bump 122. For example, bump 123 is illustrated as having a different shape than bumps 122. The differently shaped bump 123 may be used as a marker, as will be described later. Furthermore, the distance between two particular points of two bumps 122 and/or bumps 122 and 123 may vary between one or more pairs of bumps. The bumps 122 and 123 may have space between the bumps themselves and between each bump and one or both of the inner and outer perimeters 116 and 118, or may extend from approximately the outer perimeter 116 to the inner perimeter 118. The height of each bump 122 and 123 is substantially similar (e.g., less than an inch above the surface 121) in the present example, but it is understood that one or more of the bumps may vary in height.

Generally, the bumps 122 and 123 may be the same height to distribute the load over all the bumps 122 and 123. For example, if the force supplying the power to create the vibrations (whether hammer drill thrust load or another force) was applied to a single bump, that bump may wear down relatively quickly. Furthermore, due to the shape of the encoder plate 104, applying the force to a single bump may force the plate off axis and create problems that may extend beyond the encoder plate 104 to the drill string. Accordingly, the encoder plate 104 may be configured with a minimum of two bumps to more evenly distribute the load in some embodiments, while other embodiments may use configurations of three or more bumps for additional wear resistance and stability.

Although not shown in the current embodiment, some or all of the bumps 122 and 123 may be retractable. For example, rather than providing all bumps 122 and 123 as fixed on or within the surface 121, one or more of the bumps may be spring loaded or controlled via a hydraulic actuator. It is noted that when retractable bumps are present, the load distribution may be maintained so that a single bump is not taking the entire load.

With additional reference to FIG. 1D, a portion 128 of a drill string is illustrated. In the present embodiment, the drill string is associated with a drill bit (not shown). For example, a rotary hammer mechanism built into a mud motor or other downhole tool may be used to achieve a higher ROP. The addition of this mechanical feature to a bottom hole assembly (BHA) provides a high amplitude vibration source that is many times more powerful than most oscillator power sources.

The encoder plate 104 is centered relative to a longitudinal axis 130 of the drill string with the axis 130 substantially perpendicular to the surface 121 of the encoder plate 104. Similarly, the anvil plate 102 is centered relative to the longitudinal axis 130 with the axis 130 substantially perpendicular to the surface 111 of the anvil plate 104. The bumps 112 of the anvil plate 102 face the bumps 122, 123 of the encoder plate 104. The travel distance between the bumps 112 and bumps 122, 123 may be less than one inch (e.g., less than one eighth of an inch). For example, in this configuration, the anvil plate 102 may be fastened to a rotating mandrel shaft 132 and the encoder plate 104 may be fastened to a mud motor housing 134. However, it is understood that the travel distance may vary depending on the configuration.

It is understood that the anvil plate 102 and encoder plate 104 may be switched in some embodiments. Such a reversal may be desirable in some embodiments, such as when the vibration mechanism is higher up the drill string. However, when the vibration mechanism is part of the mud motor housing or near another rotating member, such a reversal may increase the complexity of the vibration mechanism. For example, some or all of the bumps 122 and 123 may be retractable as described above, and such retractable bumps may be coupled to a control mechanism. Furthermore, as will be described in later embodiments, the encoder plate 104 may have multiple encoder rings that can be rotated relative to one another. These rings may be coupled to wires and/or one or more drive motors to control the relative rotation of the rings. If the positions of the anvil plate 102 and encoder plate 104 are reversed from that illustrated in FIG. 1D when the vibration mechanism is near a rotating member such as a mud motor housing, the encoder plate 104 and its associated wires and motor connections would rotate relative to the housing, which would increase the complexity. Accordingly, the relative position of the anvil plate 102 and encoder plate 104 may depend on the location of the vibration mechanism.

In operation, when one or more of the bumps 122/123 on the encoder plate 104 strikes one or more of the bumps 112 on the anvil plate 102 with sufficient force, vibrations are created. These vibrations may be used to pass information along the drill string and/or to the surface, as well as to detect various parameters such as RPM, WOB, and formation characteristics. Different arrangements of bumps 112 and/or 122/123 may create different patterns of oscillation. Accordingly, the layout of the bumps 112 and/or 122/123 may be designed to achieve a particular oscillation pattern. As will be described in later embodiments, the encoder plate 104 may have multiple encoder rings that can be rotated relative to one another to vary the oscillation pattern.

Although not shown, there may be a spring or other preload mechanism to keep some vibration occurring when off bottom. More specifically, there is a thrust load and a tensile load on the vibration mechanism that is formed by the anvil plate 102 and encoder plate 104. The thrust load may be supported by a traditional bearing, but there may be a spring or other preload so that it will vibrate going both directions. In some embodiments, it may be desirable to have the vibration mechanism produce no vibration when it is off bottom (e.g., there is no WOB) or it may be desirable to have it vibrate less when it is off bottom. For example, maintaining some level of vibration enables communications to occur when the bit is pulled off bottom for a survey, but higher intensity vibrations are not needed because formation sensing (which may need stronger vibrations) is not occurring.

In some embodiments, there may be a mechanism (e.g., a spring mechanism) (not shown) for distributing the thrust load between the vibration mechanism and a thrust bearing assembly. When the thrust load reaches a particular upper limit, any load that goes over that limit may be directed entirely to the thrust bearing assembly. This prevents the vibration mechanism from receiving more load than it can safely handle, since increased loading may make it difficult to rotate the anvil/encoder plates and may increase wear. It is understood that in some embodiments, the spring mechanism may be used as the potential energy source for the impact.

It is understood that vibrations may be produced in many different ways other than the use of an anvil plate and an encoder plate, such as by using pistons and/or other mechanical actuators. Accordingly, the functionality provided by the vibration mechanism (e.g., communication and formation sensing) may be provided in ways other than the anvil/encoder plates combination used in many of the present examples.

Figure 2A:
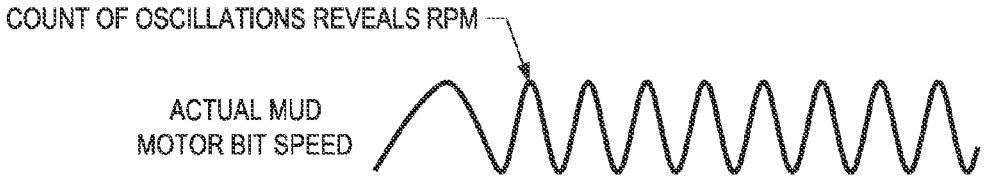
FIGS. 2A-2C illustrate embodiments of waveforms that may be caused by the vibrations produced by an anvil plate and an encoder plate.
Figure 2B:
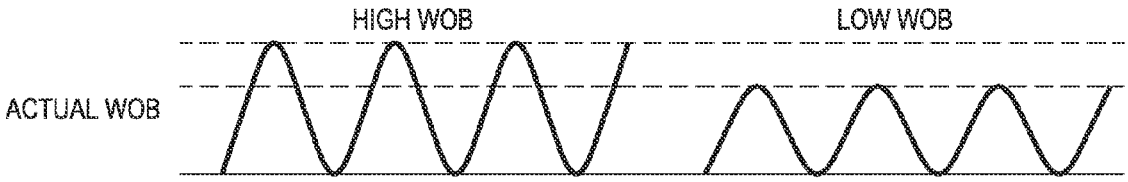
Figure 2C:
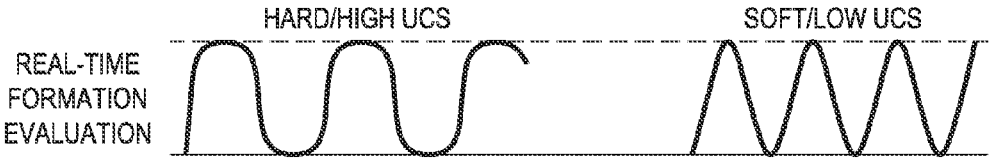

Referring to FIGS. 2A-2C, embodiments of different vibration waveforms are illustrated. FIG. 2A shows a series of oscillations that can be used to find the RPM of the bit. It is understood that the correlation of the oscillations to RPM may not be one to one, but may be calculated based on the particular configuration of the anvil plate 102 and/or encoder plate 104. For example, using the encoder plate 104 of FIG. 1C, the longer peak of the wavelength that may be caused by the bump 123 compared to the length of the peaks caused by the bumps 122 may indicate that one complete rotation has occurred. Alternatively or additionally, the number of oscillations may be counted to identify a complete rotation as the number of bumps representing a single rotation is known, although the number may vary based on frequency modulation and the particular configuration of the plates.

FIG. 2B shows two waveforms of different amplitudes that illustrate varying WOB measurements. For example, a high WOB may cause waves having a relatively large amplitude due to the greater force caused by the higher WOB, while a low WOB may cause waves having a smaller amplitude due to the lesser force. It is understood that the correlation of the amplitudes to WOB may not be linear, but may be calculated based on the particular configuration of the anvil plate 102 and/or encoder plate 104.

FIG. 2C shows two waveforms that may be used for formation detection. The formation detection may be real time or near real time. For example, a formation that is hard and/or has a high unconfined compressive strength (UCS) may result in a waveform having peaks and troughs that are relatively long and curved but with relatively vertical slope transitions between waves. In contrast, a formation that is soft and/or has a low UCS may result in a waveform having peaks and troughs that are relatively short but with more gradual slope transitions between waves. Accordingly, the shape of the waveform may be used to identify the hardness or softness of a particular formation. It is understood that the correlation of a particular waveform to a formation characteristic (e.g., hardness) may not be linear, but may be calculated based on the particular configuration of the anvil plate 102 and/or encoder plate 104. As real time UCS data while drilling is not generally currently available, drilling efficiency may be improved using the vibration mechanism to provide UCS data as described. In some embodiments, the UCS data may be used to optimize drilling calculations such as mechanical specific energy (MSE) calculations to optimize drilling performance.

In addition, the UCS for a particular formation is not consistent. In other words, there is typically a non-uniform UCS profile for a particular formation. By obtaining real time or near real time UCS data while drilling, the location of the bit in the formation can be identified. This may greatly optimize drilling by providing otherwise unavailable real time or near real time UCS data. Furthermore, within a given formation, there may be target zones that have higher long term production value than other zones, and the UCS data may be used to identify whether the drilling is tracking within those target zones.

Figure 3A:
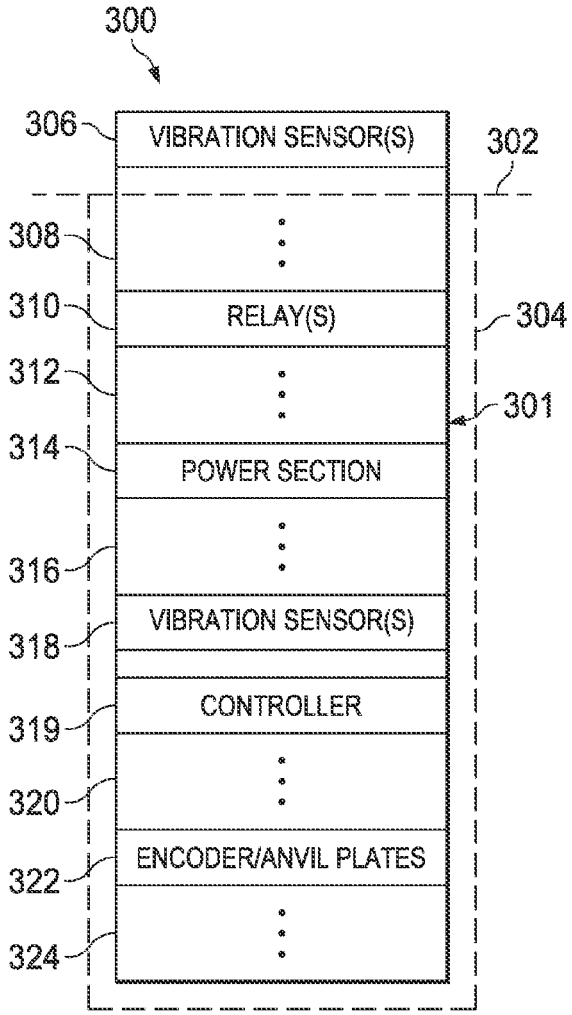
FIG. 3A illustrates a system that may be used to create and detect vibrations.

Referring to FIG. 3A, one embodiment of a system 300 is illustrated that may use the anvil plate 102 of FIG. 1B and the encoder plate 104 of FIG. 1C to create vibrations. The system 300 is illustrated relative to a surface 302 and a borehole 304. The system 300 includes encoder/anvil plate section 322, a controller 319, one or more vibration sensors 318 (e.g., high sensitivity axial accelerometers) for decoding vibrations downhole, and a power section 314, all of which may be positioned within a drill string 301 that is within the borehole 304.

It is noted that, as the control of the hammer frequency is closed loop, active dampening of electronic components typically damaged by unpredictable vibrations may be accomplished. This closed loop enables pre-dampening actions to occur because the amplitude and frequency of the vibrations are known to at least some extent. This allows the closed loop system to be more efficient than rectional active dampening systems that react after measuring incoming vibrations, which results in a delay before dampening occurs. Accordingly, some vibration may be relatively undampened due to the delay. The closed loop may also be more efficient than passive dampening systems that rely on the use of dampening materials.

The controller 319, which may also handle information encoding, may be part of a control system (e.g., the control system 48 of FIG. 1A) or may communicate with such a control system. The controller 319 may synchronize dampening timing with impact timing. More specifically, because vibration measurements are being made locally, the controller 319 may rapidly adapt dampening to match changes in vibration frequency and/or amplitude using one or more of the dampening mechanisms described herein. For example, the controller 319 may synchronize the dampening with the occurrence of impacts so that, if the timing of the impacts changes due to changes in formation hardness or other factors, the timing of the dampening may change to track the impacts. This real time or near real time synchronization may ensure that dampening occurs at the peak amplitude of a given impact and not between impacts as might happen in an unsynchronized system. Similarly, if impact amplitude increases or decreases, the controller 319 may adjust the dampening to account for such amplitude changes.

The vibration sensors 318 may be placed within fifty feet or less (e.g., within five feet) of the vibration source provided by the encoder/anvil plate section 322. In the present embodiment, the vibration sensors 318 may be positioned between the power section 314 and the vibration source due to the dampening effect of the rubber that is commonly present in the power section stator. The positioning of the vibration sensors 318 relative to the vibration source may not be as important for communications as for formation sensing, because the vibration sensors 318 may need to be able to sense relatively slight variations in formation characteristics and being closer to the vibration source may increase the efficiency of such sensing. The more distance there is between the vibration source and the vibration sensors 318, the more likely it is that slight changes in the formation will not be detected. The vibration sensors 318 may include one sensor for measuring axial vibrations for WOB and another sensor for formation evaluation.

The system 300 may also include one or more vibration sensors 306 (e.g., high sensitivity axial accelerometers) positioned above the surface 302 for decoding transmissions and one or more relays 310 positioned in the borehole 304. The vibration sensors 306 may be provided in a variety of ways, such as being part of an intelligent saver sub that is attached to a top drive on the drill rig (not shown). The relays 310 may not be needed if the vibrations produced by the encoder/anvil plate section 322 are strong enough to be detected on the surface by the vibration sensors 306. The relays 310 may be provided in different ways and may be vibration devices or may use a mud pulse or EM tool. For example, agitators may be used in drill strings to avoid friction problems by using fluid flow to cause vibrations in order to avoid friction in the lateral portion of a drill string. The mechanical vibration mechanism provided by the encoder/anvil plate section 322 may provide such vibrations at the bit and/or throughout the drill string. This may provide a number of benefits, such as helping to hold the toolface more stably and maintain consistent WOB.

In some embodiments, a similar or identical mechanism may be applied to an agitator to provide relay functionality to the agitator. For example, the relay may receive a vibration having a particular frequency f, use the mechanical mechanism to generate an alternative frequency signal, and may transmit the original and alternative frequency signals up the drill string. By generating the additional frequency signal, the effect of a malfunctioning relay in the chain may be minimized or eliminated as the additional frequency signal may be strong enough to reach the next working relay.

It is understood that the sections forming the system 300 may be positioned differently. For example, the power section 314 may be positioned closer to the encoder/anvil plate section 322 than the vibration sensors 318, and/or one or more of the vibration sensors 318 may be placed ahead of the encoder/anvil plate section 322. In still other embodiments, some sections may be combined or further separated. For example, the vibration sensors 318 may be included in a mud motor assembly, or the vibration sensors 318 may be separated and distributed in different parts of the drill string 301. In still other embodiments, the controller 319 may be combined with the vibration sensors 318 or another section, may be behind one or more of the vibration sensors 318 (e.g., between the power section 314 and the vibration sensors 318), and/or may be distributed.

The remainder of the drill string 301 includes a forward section 324 that may contain the drill bit and additional sections 320, 316, 312, and 308. The additional sections 320, 316, 312, and 308 represent any sections that may be used with the system 300, and each additional section 320, 316, 312, and 308 may be removed entirely in some embodiments or may represent multiple sections. For example, one or both of the sections 308 and 312 may represent multiple sections and one or more relays 310 may be positioned between or within such sections.

In operation, the anvil plate 102 and encoder plate 104 create vibrations. In later embodiments where the encoder plate 104 includes multiple rings that can be moved relative to one another, the power section 314 may provide power for the movement of the rings so that the phase and frequency of the vibrations can be tuned. The vibration sensors 318, which may be powered by the power section 314, detect the vibrations for formation sensing purposes and send the information up the drill string using the vibrations created by the anvil plate 102 and encoder plate 104. The vibrations sent up the drill string are detected by the vibration sensors 306.

Figure 3B:
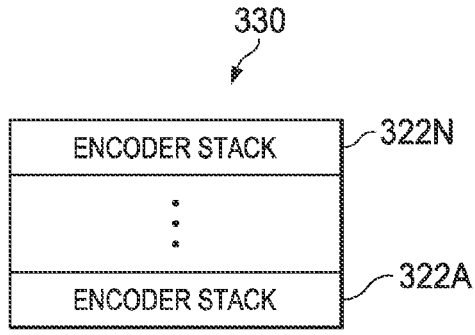
FIG. 3B illustrates another embodiment of a vibration mechanism.

Referring to FIG. 3B, another embodiment of a vibration mechanism 330 is provided. Although the vibration mechanisms described in the present disclosure are generally illustrated with a single anvil plate and a single set of encoder plates (e.g., an encoder stack), the vibration mechanism 330 includes multiple encoder stacks 332*a* through 332N, where "a" represents the first encoder stack and "N" represents a total number of encoder stacks present in the vibration mechanism 330. Such encoder stacks may be positioned adjacent to one another or may be distributed with other drilling components positioned between two encoder stacks. It is understood that the use of multiple encoder stacks extends to embodiments of vibration mechanisms that rely on structures other than an anvil plate/encoder plate combination for the creation of the vibration. For example, if an encoder stack is configured to use pistons to create vibration, multiple piston-based encoder stacks may be used. In still other embodiments, different types of encoder stacks may be used in a single drill string.

Figure 3C:
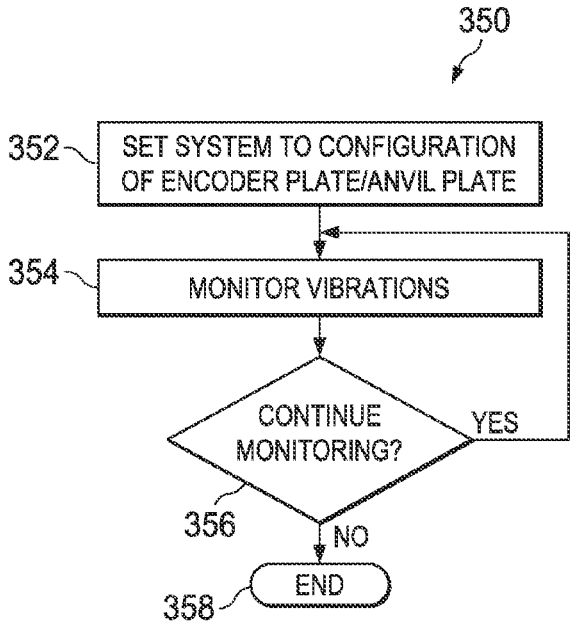
FIG. 3C illustrates a flow chart of one embodiment of a method that may be used with the vibration components of FIGS. 1B-1D, 3A, and/or 3B.

Referring to FIG. 3C, a method 350 illustrates one embodiment of a process that may occur using the vibration causing components illustrated in FIGS. 1A-1C, 3A, and/or 3B to obtain waveform information (e.g., oscillations per unit time, frequency and/or amplitude) from waveforms such as those illustrated in FIGS. 2A-2C. In step 352, a system may be set to use a particular configuration of an encoder plate/anvil plate pair. For example, the system may be a system such as is disclosed in previously incorporated U.S. Pat. No. 8,210,283. It is understood that many different systems may be used to execute the method 350. In some embodiments, the system may not need to be set to a particular configuration of an encoder plate/anvil plate pair, in which case step 352 may be omitted. In such embodiments, for example, the system may establish a current frequency/amplitude baseline using detected waveform information and then look for variations from the baseline.

In step 354, vibrations from the encoder plate/anvil plate are monitored. For example, the monitoring may be used to count oscillations as illustrated in FIG. 2A. When counting oscillations, the configuration of the encoder plate/anvil plate would need to be known in order to calculate that a single revolution has occurred. The monitoring may also be used to detect frequency and/or amplitude variations as illustrated in FIGS. 2B and 2C. The waveform information may be used to adjust drilling parameters, determine formation characteristics, and/or for other purposes.

In step 356, a determination may be made as to whether monitoring is to be continued. If monitoring is to be continued, the method 350 returns to step 354. If monitoring is to stop, the method 350 moves to step 358 and ends. It is understood that step 352 may be repeated in cases where a new encoder plate and/or anvil plate are used, although step 352 may not need to be repeated in cases where a plate is replaced with another plate having the same configuration.

Figure 4:
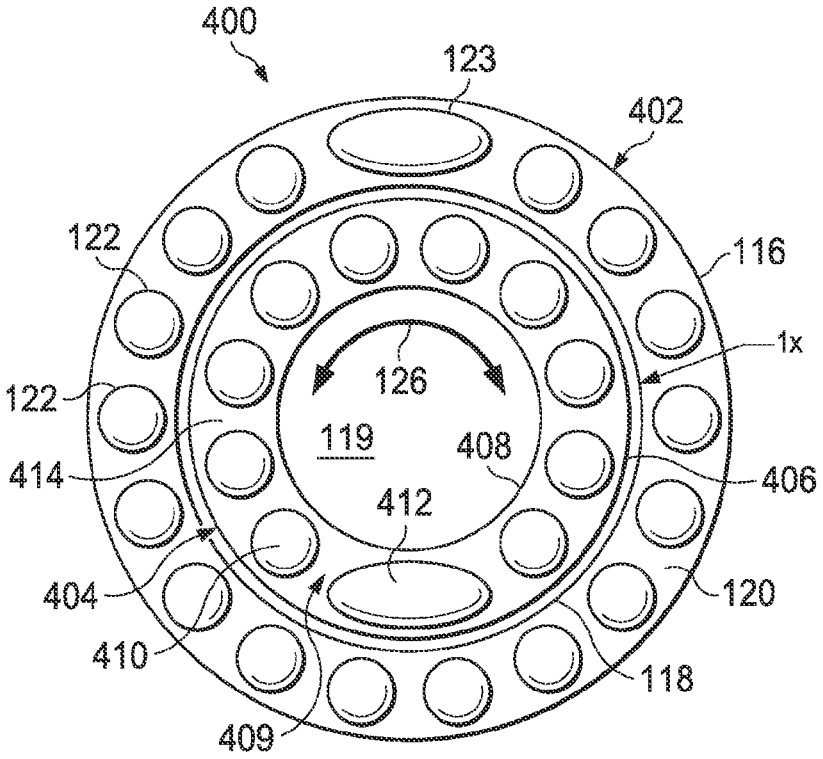
FIG. 4 illustrates another embodiment of an encoder plate with inner and outer encoder rings.

Referring to FIG. 4, another embodiment of an encoder plate 400 is illustrated with an outer encoder ring 402 and an inner encoder ring 404. Via the outer and inner encoder rings 402 and 404, the encoder plate 400 may provide a phase adjusting series of rings and bumps that can be used to cause frequency modulation for communication and localized sensing purposes. For purposes of the present example, the configuration of the outer encoder ring 402 is identical to the encoder plate 104 of FIG. 1C, although it is understood that the outer encoder ring 402 may have many different configurations. The inner encoder ring 404 is positioned within the aperture 119 so that the inner and outer encoder rings 402 and 404 form concentric circles.

The inner encoder ring 404 may be configured with an outer perimeter 406 and an inner perimeter 408 that defines the interior opening 119. Spaces 414 may be defined between bumps 410 and 412 and may represent an upper surface 409 of a substrate material (e.g., steel) forming the encoder plate 400. In the present example, the spaces 414 are substantially flat, but it is understood that the spaces 414 may be curved, grooved, slanted inwards and/or outwards, have varying slope angles, and/or have a variety of other shapes. In some embodiments, the area and/or shape of a space 414 may vary from the area/shape of another space 414.

It is understood that the term "bump" in the present embodiment refers to any projection from the surface 409 of the substrate forming the encoder plate 400. Accordingly, a configuration of the encoder plate 400 that is grooved may provide bumps 410 as the lands between the grooves. A bump 410 may be formed of the substrate material itself or may be formed from another material or combination of materials. For example, a bump 410 may be formed from a material such as PDC, stellite, and/or another material or material combination that is resistant to wear. A bump 410 may be formed as part of the surface 409, may be fastened to the surface 409 of the substrate, may be placed at least partially in a hole provided in the surface 409, or may be otherwise embedded in the surface 409.

The bumps 410/412 may be of many shapes and/or sizes, and may curved, grooved, slanted inwards and/or outwards, having varying slope angles, and/or may have a variety of other shapes. In some embodiments, the area and/or shape of a bump 410/412 may vary from the area/shape of another bump 410/412. For example, bump 412 is illustrated as having a different shape than bumps 410. The differently shaped bump 412 may be used as a marker. Furthermore, the distance between two particular points of two bumps may vary between one or more pairs of bumps. The bumps 410 may have space between the bumps themselves and between each bump and one or both of the inner and outer perimeters 406 and 408, or may extend from approximately the outer perimeter 406 to the inner perimeter 408. The height of each bump 410/412 is substantially similar in the present example, but it is understood that one or more of the bumps may vary in height.

The configuration of the encoder plate 400 with the inner encoder ring 404 and the outer encoder ring 402 enables the phase of the vibrations to be adjusted. More specifically, the inner and outer encoder rings 404 and 402 may be moved relative to one another. For example, both the inner and outer encoder rings 404 and 402 may be movable, or one of the inner and outer encoder rings 404 and 402 may be movable while the other is locked in place. Rotation may be accomplished by many different mechanisms, including gears and cams. By rotating the inner encoder ring 404 relative to the outer encoder ring 402, the phase of the vibrations may be changed, providing the ability to tune the oscillations within a particular range while the anvil plate 102 and the encoder plate 404 are downhole.

The ability to adjust the frequency and phase of the vibrations by moving the inner encoder ring 404 relative to the outer encoder ring 402 may enable faster drilling. More specifically, there is often a particular vibration frequency or a relatively narrow band of vibration frequencies within which drilling occurs faster for a particular formation than occurs at other frequencies. By tuning the vibration mechanism provided by the anvil 102 and encoding plate 104 to create that particular frequency or a frequency that is close to that frequency, the ROP may be increased.

In another embodiment, the ability to tune a characteristic of the vibration mechanism (e.g., frequency, amplitude, or beat skipping) may be used to steer or otherwise affect the drilling direction of a bent sub mud motor while rotating. Generally, a well bore will drift towards the direction in which faster drilling occurs. This may be thought of as the drill bit drifting towards the path of least resistance. One method for controlling this is to provide a system that uses fluid flow to try to control the efficiency of drilling based on the rotary position of the bend in the mud motor. For example, the fluid flow may be at its maximum when the drilling is occurring in the correct direction. When the mud motor bend rotates away from the target trajectory, the fluid flow is shut off, which slows the drilling speed by making drilling less efficient and biases the bit back into the desired direction. However, repeatedly turning the fluid flow on and off may be hard on the mechanical system of the BHA and may also result in inconsistent bit cutter and borehole cleaning, neither of which are beneficial to efficient drilling and lead to a loss in peak ROP for a given BHA.

As described above, there is often a particular optimal frequency or amplitude that maximizes drilling speed for a given formation. Accordingly, when the bend is oriented so that drilling is occurring in the correct direction, the vibration mechanism may be used to generate that particular optimal frequency. If the borehole begins to drift off the well plan, the vibration mechanism may be used to modify the vibrations by, for example, altering the vibrations to a less than optimal frequency or decreasing the amplitude of the vibrations when the bend in the mud motor is rotated away from the target well plan. This may serve to arrest well plan deviation and bias the bit towards the correct direction. When using vibration tuning to influence steering, fluid flow may continue normally, thereby avoiding problems that may be caused by repeatedly turning the fluid flow on and off. Controlling vibration to bias the steering may be performed without stopping rotational drilling, which provides advantages in ROP optimization and/or friction reduction.

Figure 5A:
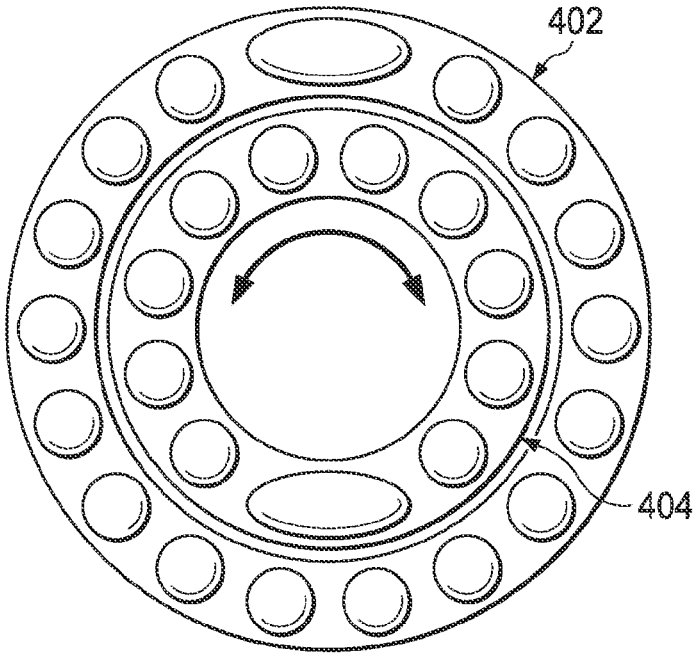
FIGS. 5A and 5B illustrate top views of two different configurations of bumps that may be created when the inner and outer encoder rings of the encoder plate of FIG. 4 are moved relative to one another.
Figure 5C:
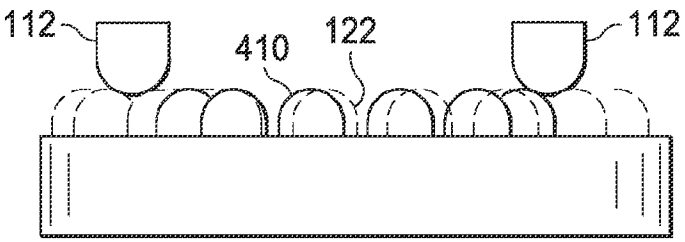
FIGS. 5C and 5D illustrate side views of two different configurations of bumps that may be created when the inner and outer encoder rings of the encoder plate of FIG. 4 are moved relative to one another.
Figure 5D:
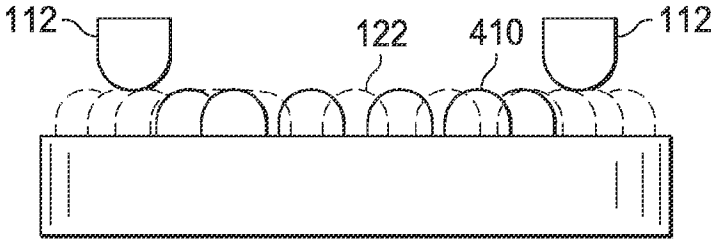
Figure 5F:
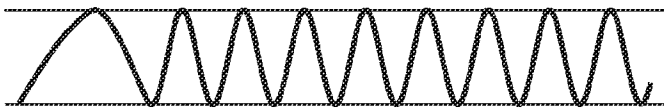
FIGS. 5E and 5F illustrate embodiments of different waveforms that may be created when the inner and outer encoder rings of the encoder plate of FIG. 4 are struck by the bumps of an anvil plate as shown in FIGS. 5C and 5D.
Figure 5B:
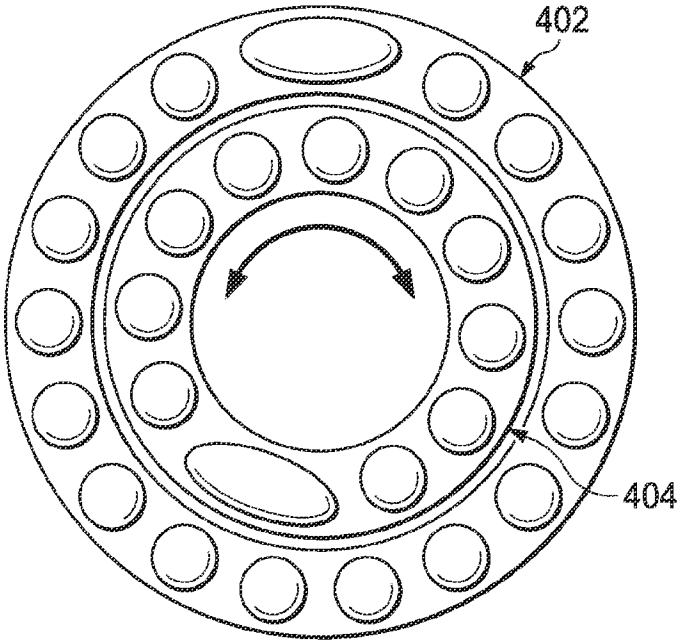
Figure 5E:
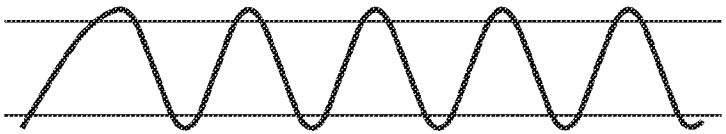

With additional reference to FIGS. 5A-5F, embodiments of the inner and outer encoder rings 404 and 402 of the encoder plate 400 of FIG. 4 are illustrated. FIGS. 5A and 5C illustrate a top view and a side view, respectively, of the inner and outer encoder rings 404 and 402. The inner and outer encoder rings 404 and 402 are positioned relative to one another so that the bumps of each ring are offset just enough to create a "larger" bump when viewed from the side and struck by the bumps 112 of the anvil plate 102. More specifically, the bumps 410 (represented by solid lines) and bumps 122 (represented by dashed lines) are aligned so that the bumps 112 of the anvil plate 102 strike the peaks of a bump 410/bump 122 pair in rapid succession. FIG. 5E illustrates a waveform that may be created by this positioning the inner and outer encoder rings 404 and 402. The waveform that has a relatively low frequency due to the "larger" bumps created by the combination of bumps 410 and 122.

FIGS. 5B and 5D illustrate a top view and a side view, respectively, of the inner and outer encoder rings 404 and 402. The inner and outer encoder rings 404 and 402 are positioned relative to one another so that the bumps of each ring are substantially equidistant. In other words, the peak of each of the bumps 122 is positioned substantially where the trough occurs for the bumps 410 and vice versa. FIG. 5F illustrates a waveform that may be created by this positioning the inner and outer encoder rings 404 and 402. The waveform has a higher frequency than the waveform of FIG. 5E due to the bumps 112 of the anvil plate 102 transitioning more rapidly from one bump 122 to the next bump 410 and from one bump 410 to the next bump 122. It is understood that this may also vary the amplitude of the waveform relative to the waveform of FIG. 5E for a given amount of force, as the bumps 112 of the anvil plate 102 are not traveling as far into the troughs in FIG. 5D as they are in FIG. 5C.

It is understood that varying the bump layout of one or more of the inner encoder ring 404, outer encoder ring 402, and anvil plate 102 may result in different frequencies and different phase shifts. Furthermore, the frequency and phase may be modulated when the inner and outer encoder rings 404 and 402 are moved relative to one another. Accordingly, a desired frequency or range of frequencies and a desired phase or range of phases may be obtained based on the particular configuration of the inner encoder ring 404, outer encoder ring 402, and anvil plate 102.

It is further understood that additional encoder rings may be added to the encoder plate 400 in some embodiments. Additionally or alternatively, the anvil plate 102 may be provided with two or more anvil rings.

Figure 6A:
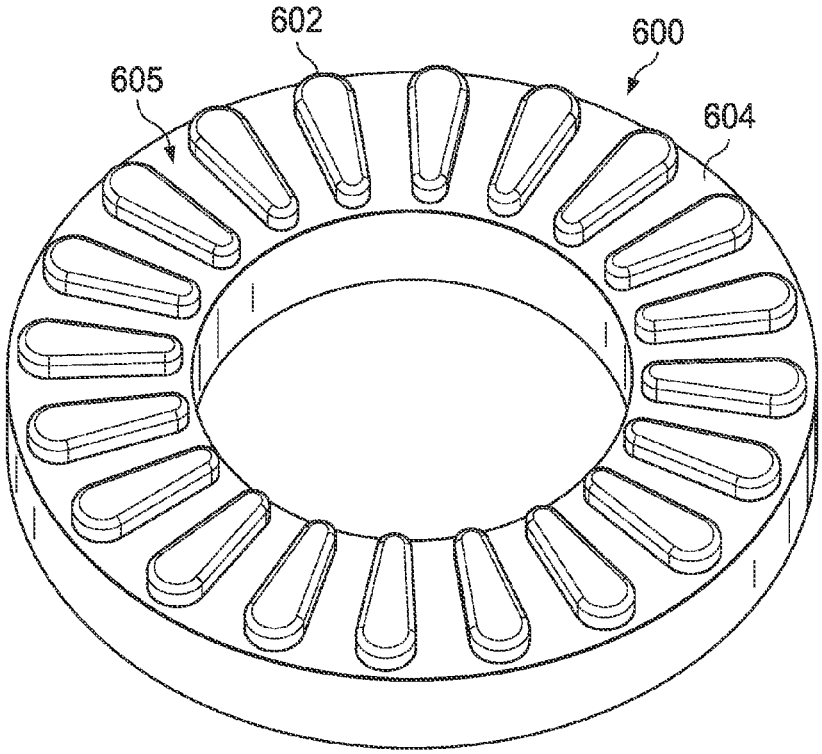
FIG. 6A illustrates another embodiment of an anvil plate.

Referring to FIG. 6A, another embodiment of an anvil plate 600 is illustrated. The anvil plate 600 includes a plurality of bumps 602 separated by a relatively flat space 604. The relatively flat space may be an upper surface 605 of the anvil plate 600.

Figure 6B:
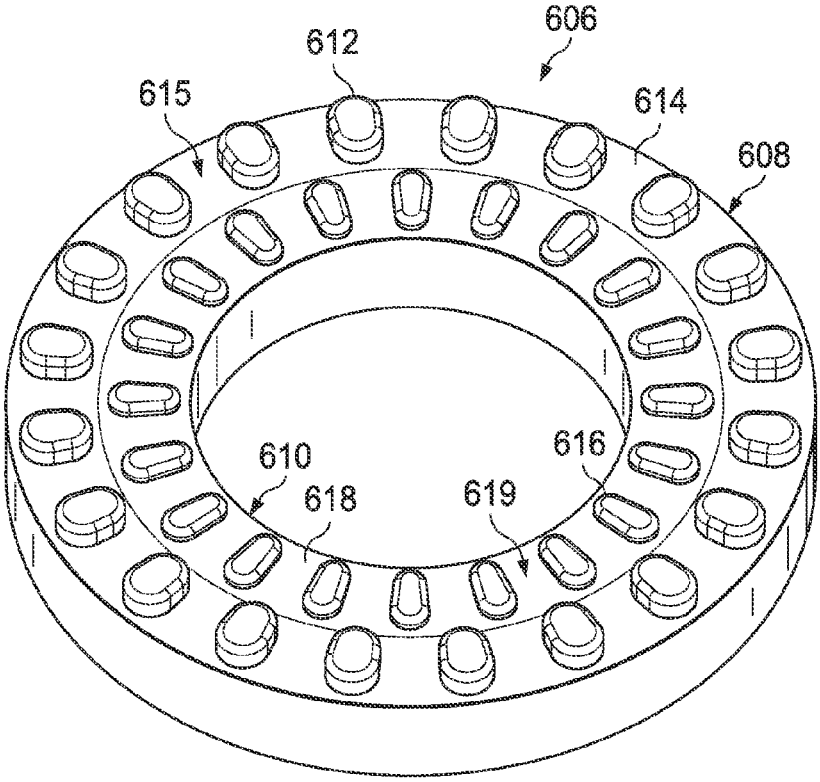
FIG. 6B illustrates another embodiment of an encoder plate with inner and outer encoder rings.

Referring to FIG. 6B, another embodiment of an encoder plate 606 is illustrated with an outer encoder ring 608 and an inner encoder ring 610. The outer encoder ring 608 includes a plurality of bumps 612 separated by a relatively flat space 614, which may be part of an upper surface 615 of the outer encoder ring 608. The inner encoder ring 610 includes a plurality of bumps 616 separated by a relatively flat space 618, which may be part of an upper surface 619 of the inner encoder ring 610.

Figure 6C:
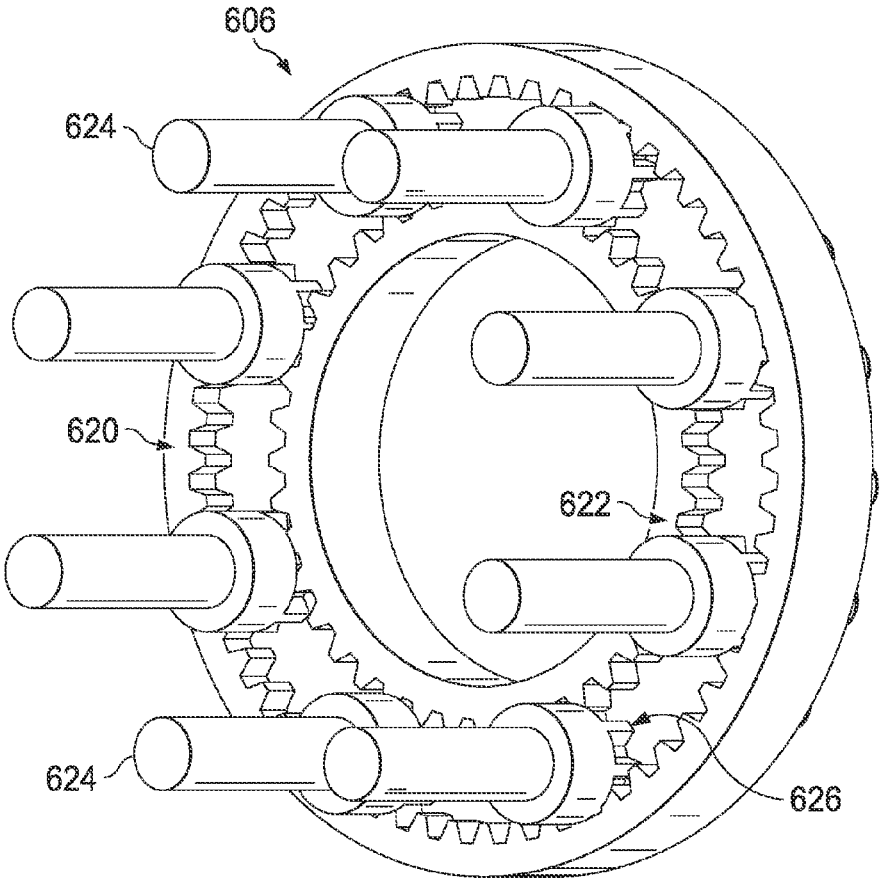
FIG. 6C illustrates one embodiment of the backside of the encoder plate of FIG. 6B.

Referring to FIG. 6C, one embodiment of the backside of the encoder plate 606 is illustrated. In the present example, both the inner and outer encoder rings 608 and 610 may move. The outer encoder ring 608 has a surface 620 having teeth formed thereon and the inner encoder ring 610 has a surface 622 having teeth formed thereon. The surface 622 faces the surface 620 so that the respective teeth are opposing. The teeth of the surfaces 620 and 622 provide a gear mechanism for the outer and inner encoder rings 608 and 610, respectively. One or more shafts 624 have teeth at the proximal end 626 (e.g., the end nearest the toothed surfaces 620/622) that engage the teeth of the surfaces 620/622. At least one of the shafts 624 may be a driver that is configured to rotate via a rotation mechanism such as a gearhead motor. During rotation, the driver shaft 624 rotates the outer encoder ring 608 relative to the inner encoder ring 610 via the gear mechanism.

It is understood that the gear mechanism illustrated in FIG. 6C is only one embodiment of a mechanism that may be used to rotate the outer encoder ring 608 relative to the inner encoder ring 610. Cams and/or other mechanisms may also be used. Such mechanisms may be configured to provide a desired movement pattern. For example, cams may be shaped to provide a predefined movement pattern. In some embodiments, only one of the encoder rings 608/610 may be geared, while the other of the encoder rings may be locked in place. Locking an encoder ring 608/610 in place may be accomplished via pins, bolts, or any other fastening mechanism capable of preventing movement of the encoder ring being locked in place while allowing movement of the other encoder ring. It is noted that having both encoder rings 608/610 geared or otherwise movable may increase the speed of relative movement, but may also require more torque. Accordingly, balances between relative movement speed and torque may be made to satisfy particular design parameters.

Figure 7A:
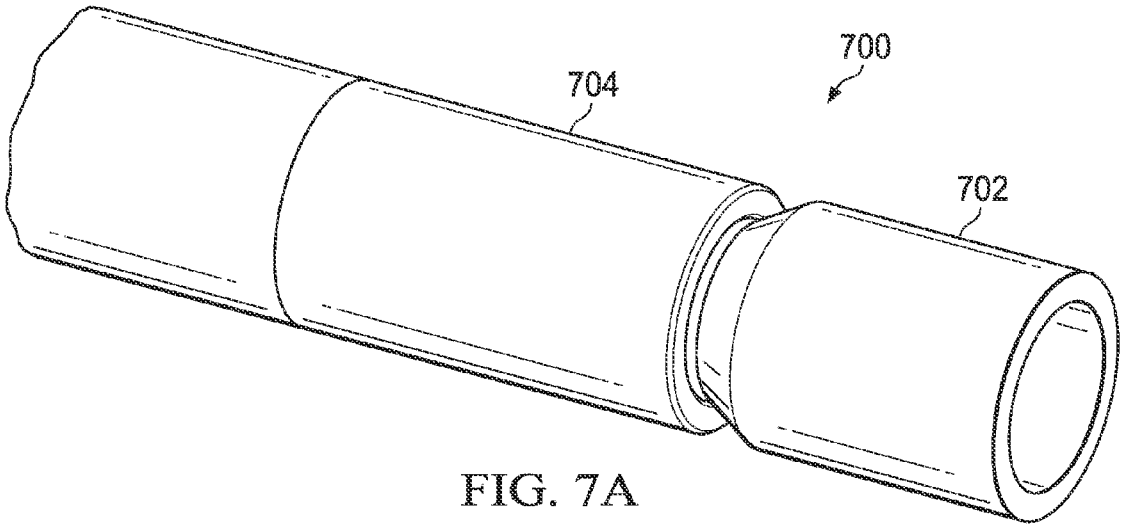
FIGS. 7A-7C illustrate embodiments of a housing within which the anvil plate of FIG. 6A and the encoder plate of FIGS. 6B and 6C may be used.
Figure 7B:
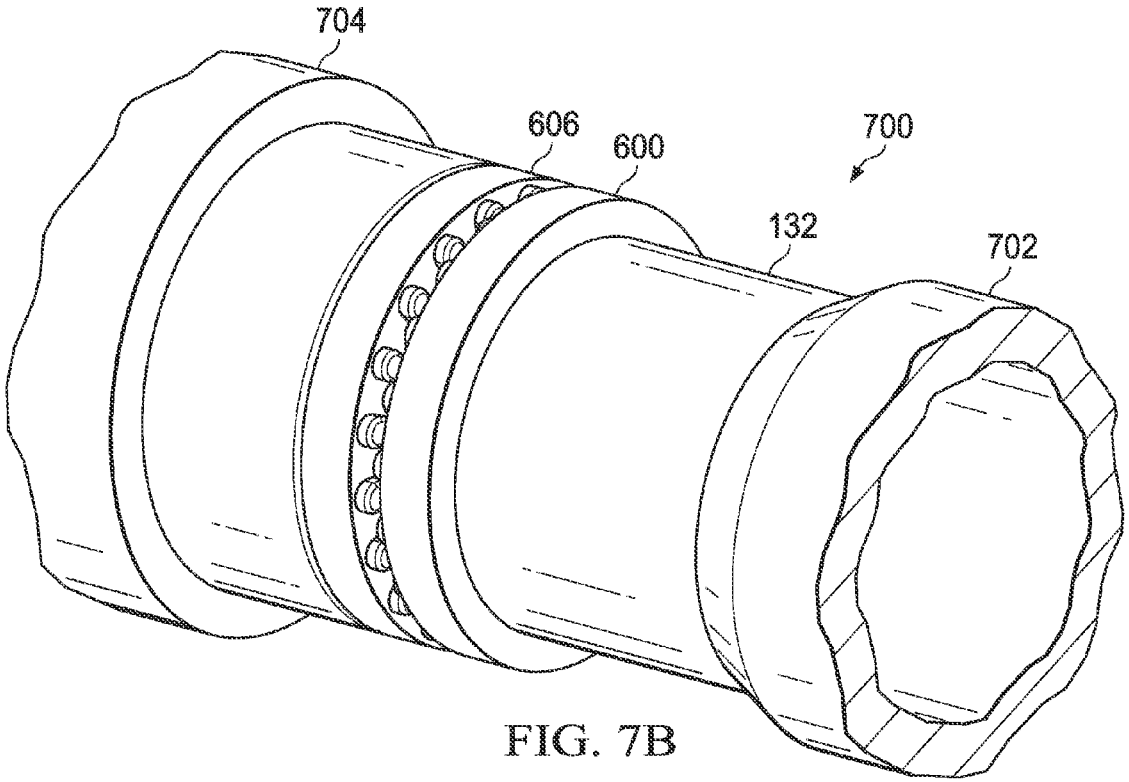
Figure 7C:
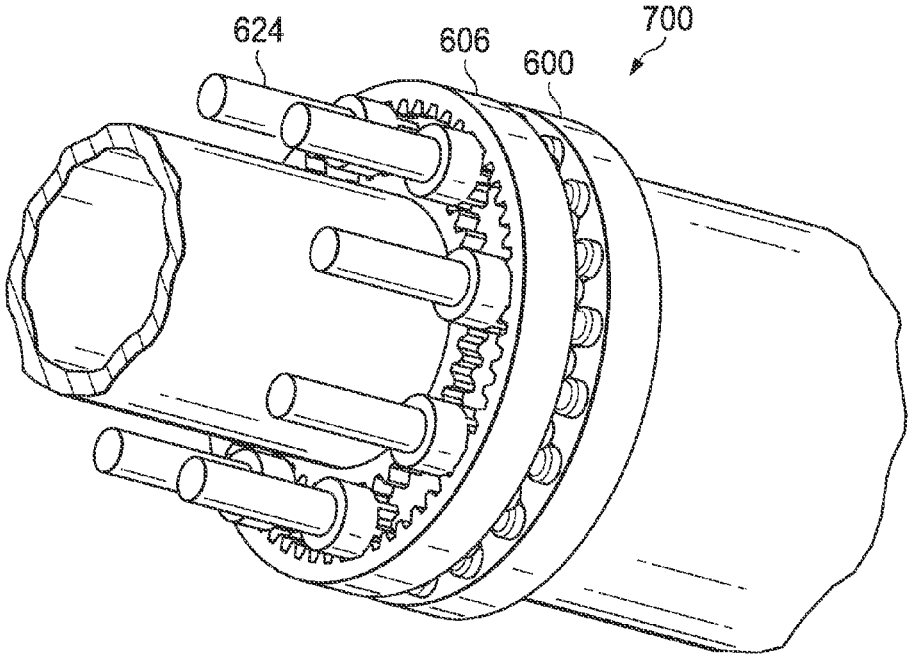

Referring to FIGS. 7A-7C, embodiments of a housing 700 is illustrated. The housing 700 may be a portion of a drill string. In the present example, the anvil plate 600 (FIG. 6A) and encoder plate 606 (FIG. 6B) are positioned in section 704. However, in other embodiments, the anvil plate 600 and encoder plate 606 may be positioned in section 702 or may be separated, such as positioning the anvil plate 600 in section 702 and the encoder plate 606 and other components of the system 300 (FIG. 3) the section 704 or vice versa.

Figure 8A:
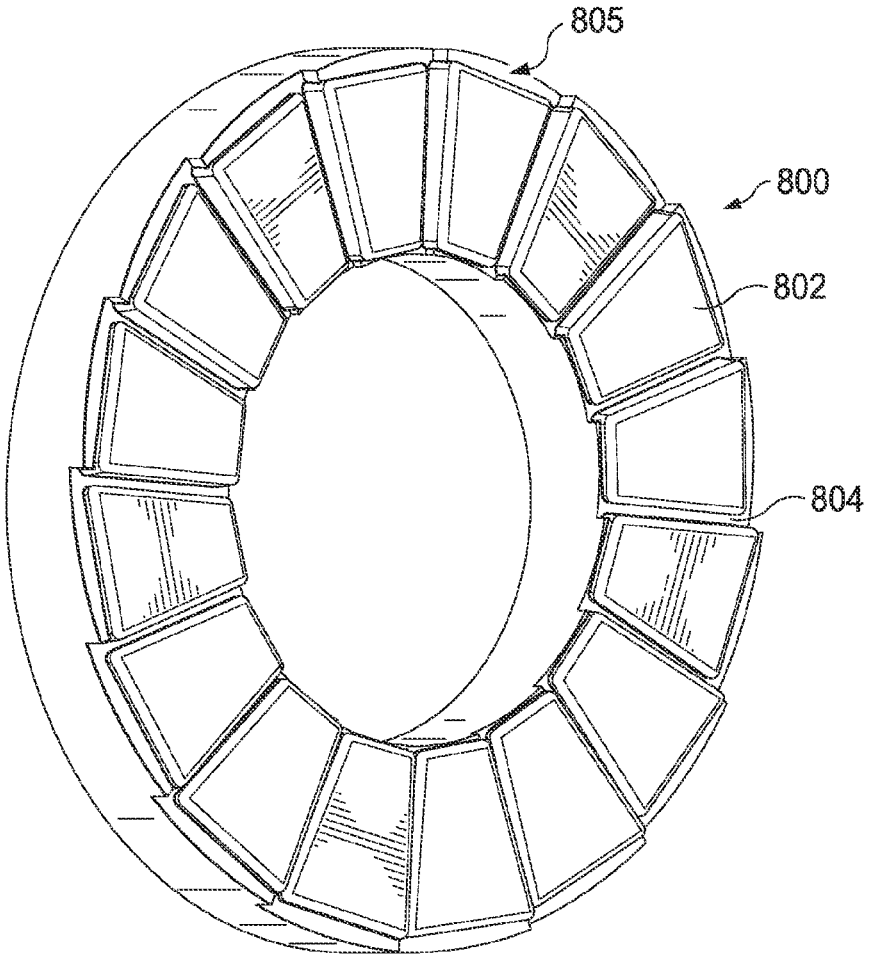
FIGS. 8A and 8B illustrate another embodiment of an anvil plate.
Figure 8B:
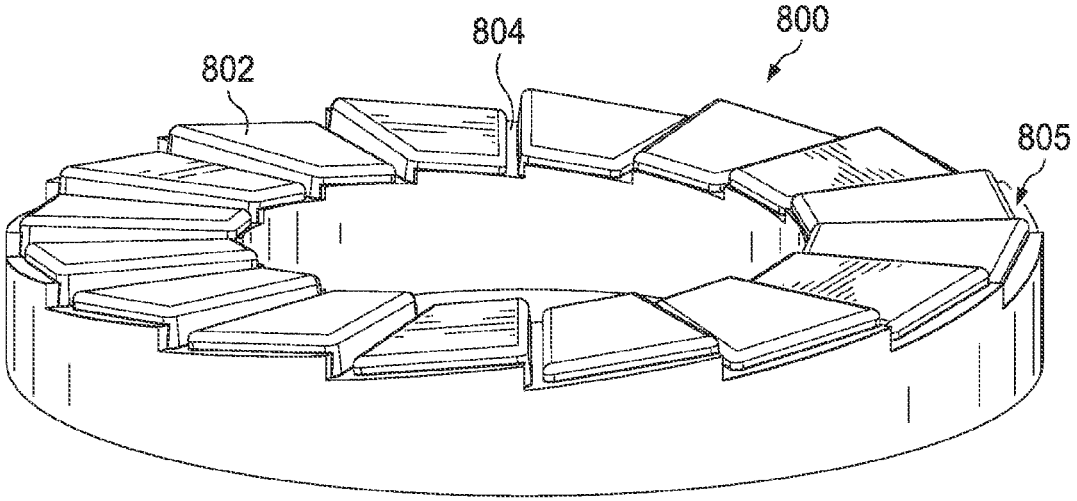

Referring to FIGS. 8A and 8B, another embodiment of an anvil plate 800 is illustrated. In the present example, the bumps are represented as ramps. The anvil plate 800 includes a plurality of ramps 802 separated by spaces 804, which may be part of an upper surface 805 of the anvil plate 800.

Figure 8C:
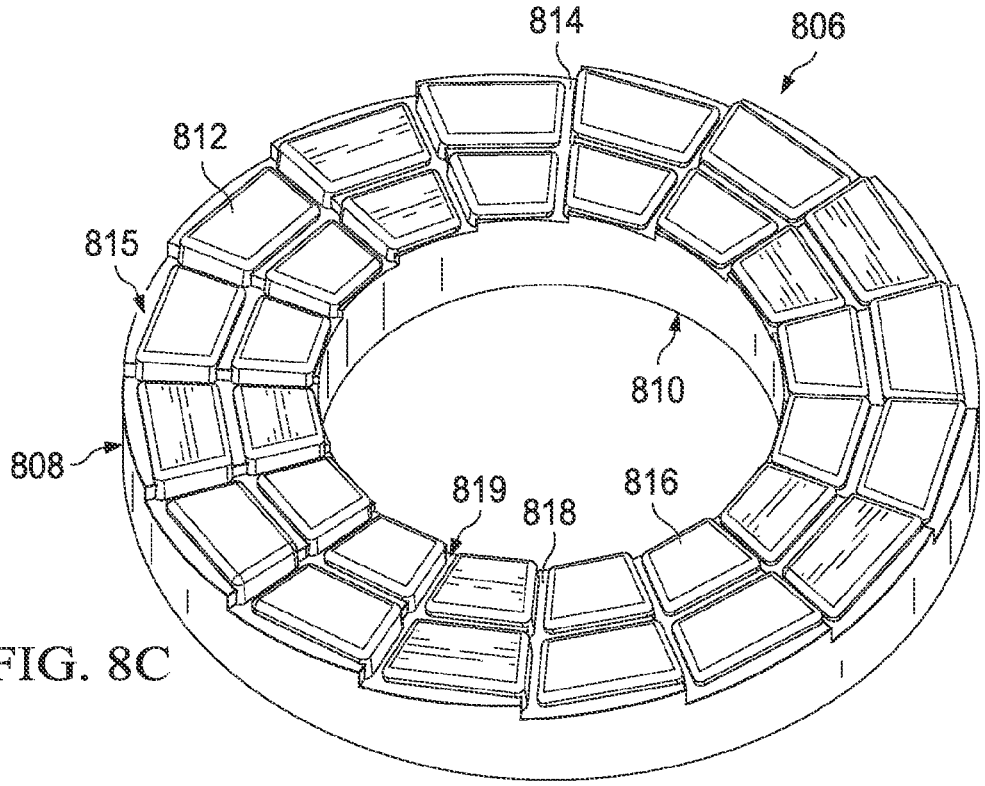
FIG. 8C illustrates another embodiment of an encoder plate with inner and outer encoder rings.

Referring to FIG. 8C, another embodiment of an encoder plate 806 is illustrated with an outer encoder ring 808 and an inner encoder ring 810. The outer encoder ring 808 includes a plurality of ramps 812 separated by spaces 814, which may be part of an upper surface 815 of the outer encoder ring 808. The inner encoder ring 810 includes a plurality of ramps 816 separated by spaces 818, which may be part of an upper surface 819 of the inner encoder ring 810.

Figure 8D:
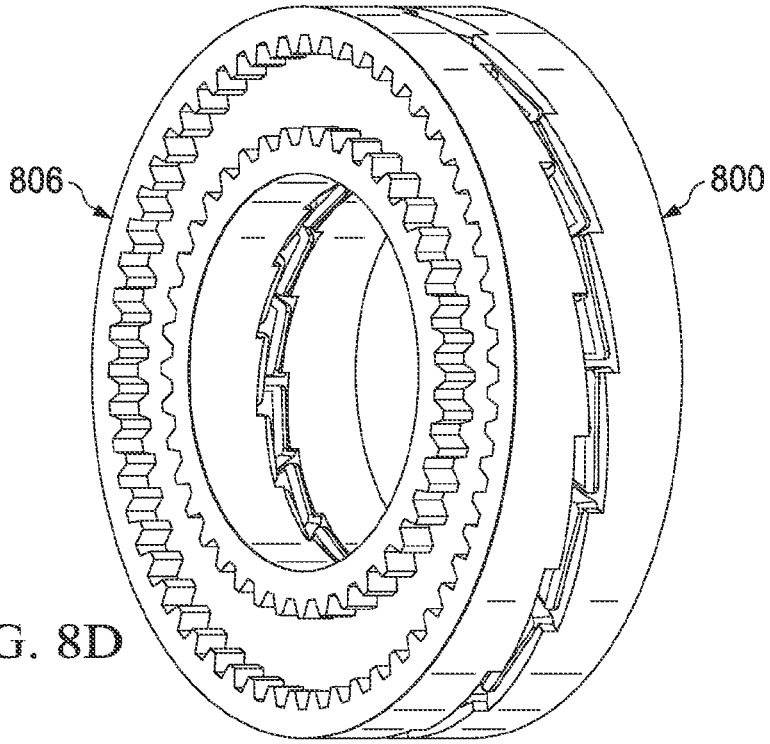
FIG. 8D illustrates the anvil plate of FIGS. 8A and 8B with the encoder plate of FIG. 8C.

Referring to FIG. 8D, the anvil plate 800 of FIGS. 8A and 8B is illustrated with the encoder plate 806 of FIG. 8C. It is noted that sloped bumps, such as the ramps 802 and 812, may act as a ratchet that prevents backwards movement in some embodiments. This may be an advantage or a disadvantage depending on the desired performance of the vibration mechanism provided by the anvil plate 800 and encoder plate 806.

In another embodiment, rather than the use of the anvil/encoder plates described above, other mechanical configurations may be used. For example, in one embodiment, cylindrical rollers may be used with non-flat races. The rollers moving along the non-flat races may create vibrations based on the shape of the races (e.g., sinusoidal). In another embodiment, non-cylindrical rollers may be used with flat races (e.g., like a cam shaft). The non-flat rollers moving along the races may create vibrations based on the shape of the rollers. In yet another embodiment, a conical roller bearing assembly may be provided. As a conical roller is pushed between two tapered races, separation between the two races is created that causes axial motion.

Accordingly, as described herein, some embodiments may enable modulating a vibration pattern through mechanical adjustment of concentric disks or other mechanisms, which enables data to be transferred up-hole by way of one of many modulation schemes at rates higher than may be provided by current mud pulse and EM methods. Varying the patterns of the anvil plate and/or encoder plate may allow for a multitude of communication schemes. In some embodiments, the frequency of the vibration may be adjustable such that an ideal impact frequency can be achieved for a given formation. Additionally, in some embodiments, using a vibration sensor such as a near hammer accelerometer or pressure transducer, the impact characteristics of the hammer shock may provide insight into the WOB, the UCS or formation hardness, and/or formation porosity on a real time or near real time basis, which may enable for real time or near real time adjustment and optimization of drilling practices.

Some embodiments may provide increased measuring while drilling/logging while drilling (MWD/LWD) data transfer rates. Some embodiments may provide increased ROP through a frequency modulated hammer drill. Some embodiments may provide the ability to evaluate and track actual mud motor RPM. Some embodiments may provide the ability to evaluate porosity through mechanical sonic tool implementation. Some embodiments may reduce static friction in lateral sections of a well. Some embodiments may minimize or eliminate MWD pressure drop and potential blockage. Some embodiments may allow compatibility with all forms of drilling fluid. Some embodiments may actively dampen MWD components using closed loop vibration control and active dampening. Some embodiments may be used in directional and conventional drilling. Some embodiments may be used in drilling with casing, in vibrating casing into the hole, and/or with coiled tubing. Some embodiments may be used for mining (e.g., for drilling air shafts), to find coal beds, and to perform other functions not directed to oil well drilling.

Figures 9A, 10, 18:
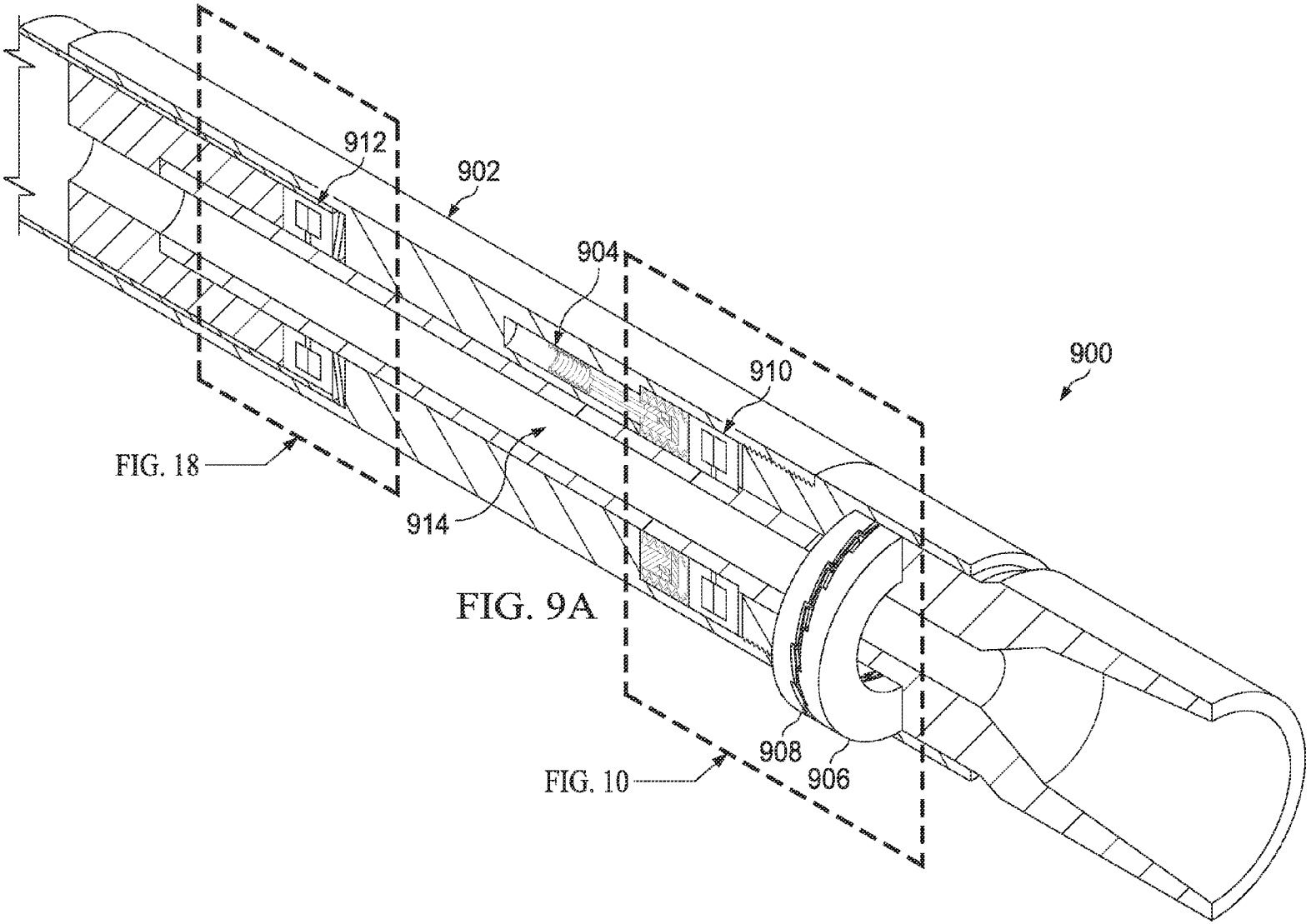
FIG. 9A illustrates one embodiment of a portion of a system that may be used to control vibrations using a magnetorheological fluid valve assembly.
FIGS. 10-18 illustrate various embodiments of portions of the system of FIG. 9A.

Referring to FIG. 9A, an embodiment of a portion of a system 900 is illustrated with a housing 902. The system 900 may similar to the system 300 of FIG. 3 in that the system 900 provides control over vibration-based communications. In the present embodiment, a magnetorheological (MR) fluid valve assembly 904 is used to control the vibrations produced by a vibration mechanism. For example, the system 900 may use a vibration mechanism such as an anvil plate 906 and encoder plate 908, which may be similar or identical to the anvil plate 102 of FIG. 1A or the anvil plate 800 of FIGS. 8A, 8B, and 8D, and the encoder plate 104 of FIG. 1B or the encoder plate 806 of FIGS. 8C and 8D. It is understood, however, that many different combinations of plates and/or other vibration mechanisms may be used as described in previous embodiments.

As will be described in greater detail below, the valve assembly 904 may provide a mechanism that may be controlled to slow and/or stop the movement of one or more thrust bearings of a thrust bearing assembly 910 that is coupled to one or both of the anvil plate 906 and encoder plate 908, as well as provide a spring mechanism used to reset the system. An off-bottom bearing assembly 912 may also be provided. The valve assembly 904, the anvil plate 906 and encoder plate 908, the thrust bearing assembly 910, and the off-bottom bearing assembly 912 are positioned around a cavity 914 containing a mandrel (not shown) that rotates around and/or moves along a longitudinal axis of the housing 902.

Figure 9B:
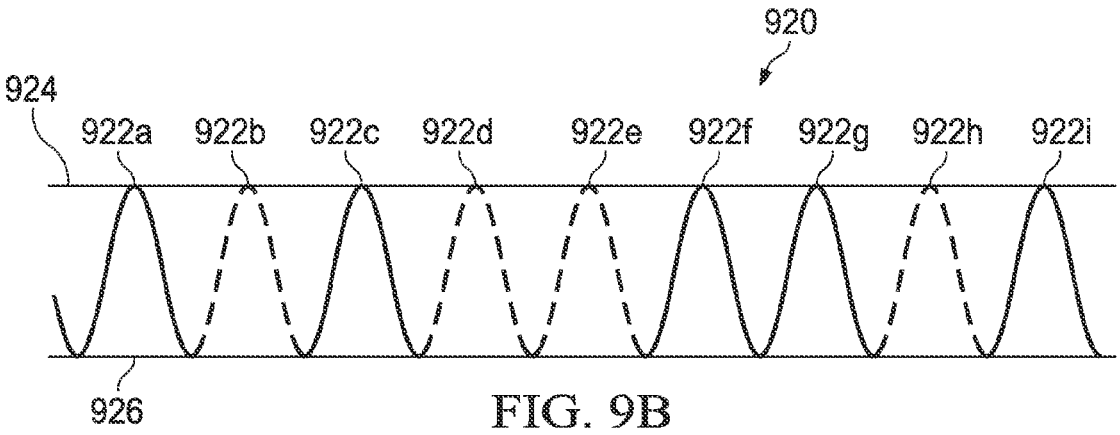
FIGS. 9B-9D illustrate embodiments of different waveforms that may be created using the fluid valve assembly of FIG. 9A.
Figure 9C:
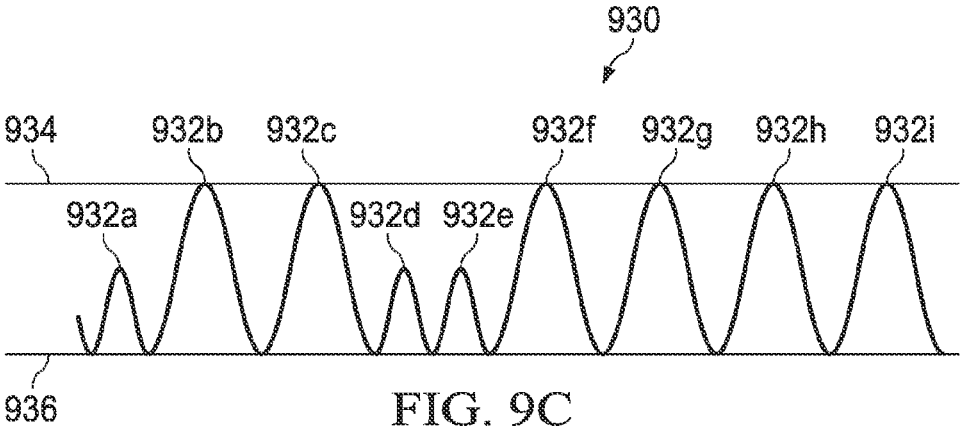
Figure 9D:
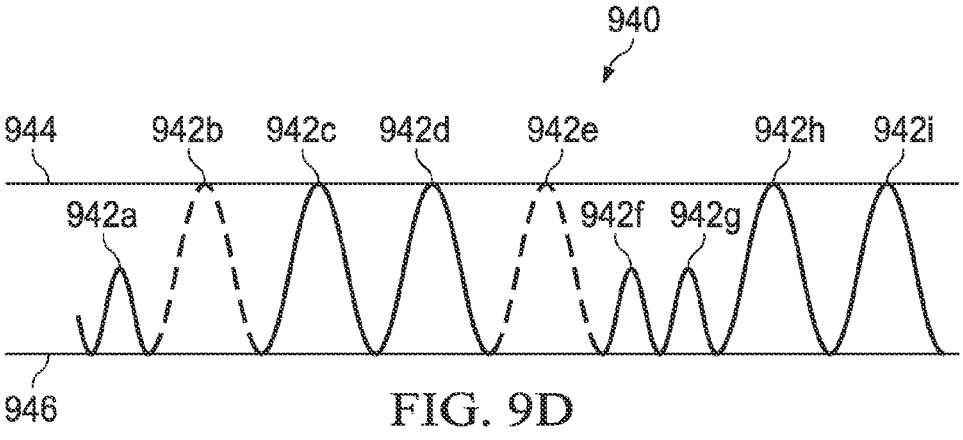
Figure 10:
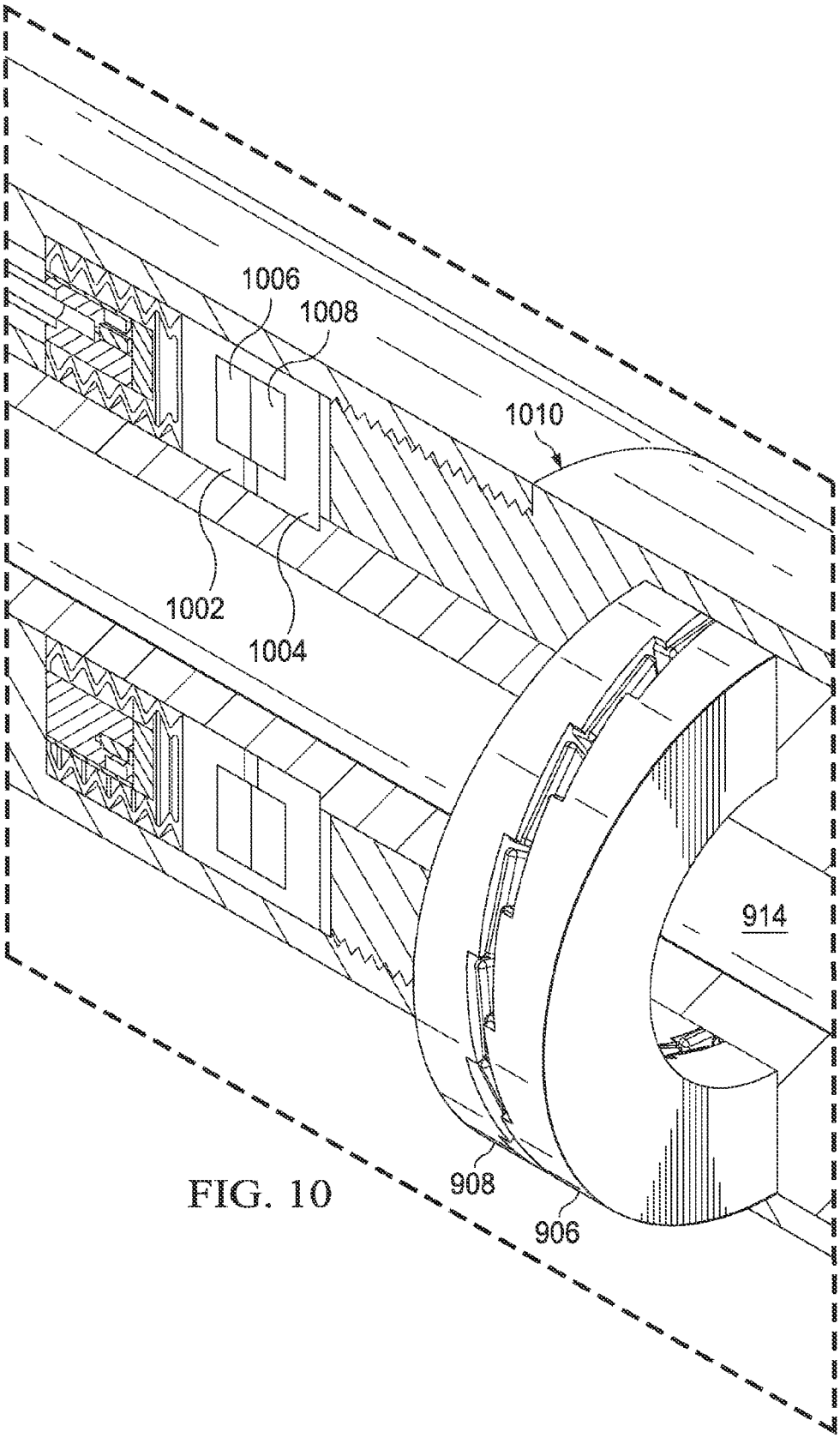

With additional reference to FIGS. 9B-9D, embodiments of waveforms illustrate possible operations of the valve assembly 904. More specifically, the anvil plate 906 and encoder plate 908 may produce a maximum frequency at a maximum amplitude if no constraints are in place. For example, a maximum number of impacts may be achieved for a given set of parameters (e.g., rotational speed, surface configuration of the surfaces of the anvil plate 906 and encoder plate 908, and formation hardness). This provides a maximum number of impacts (e.g., beats) per unit time and each of those impacts will be at a maximum amplitude. It is understood that the maximum frequency and/or amplitude may vary somewhat from beat to beat and may not be constant due to variations caused by formation characteristics and/or other drilling parameters. While a beat is illustrated for purposes of example as a single impact from trough to trough, it is understood that a beat may be defined in other ways, such as using a particular part of a cycle (e.g., rising edge, falling edge, peak, trough, and/or other characteristics of a waveform).

The valve assembly 904 may be used to modify the beats per unit time by varying the amplitude on a beat by beat basis, assuming the valve assembly is configured to handle the frequency of a particular pattern of beats. In other words, the valve assembly 904 may not only affect the amplitude of a given impact, but it may alter the beats per unit time by dampening or otherwise preventing a beat from occurring. In embodiments where suppression is not available at a per beat resolution, a minimum number of beats may be suppressed according to the available resolution.

Referring specifically to FIG. 9B, a waveform 920 is illustrated with possible beats 922*a*-922*i*. In this example, the valve assembly 904 is used to skip (e.g., suppress) beats 922*b*, 922*d*, 922*e*, and 922*h*, while beats 922*a*, 922*c*, 922*f*, 922*g*, and 922*i* occur normally. This alters the waveform 920 from a normal nine beats per unit time to five beats in the same amount of time. Moreover, it is understood than any beat or beats may be skipped, enabling the valve assembly 904 to control the vibration pattern as desired. Each beat is either at a maximum amplitude 924 or suppressed to a minimum amplitude 926.

Referring specifically to FIG. 9C, a waveform 930 is illustrated with possible beats 932*a*-932*i*. In this example, the valve assembly 904 is used to control to amplitude of beats 932*a*, 932*d*, and 932*e*, while beats 932*b*, 932*c*, and 932*f*-922*i* occur normally. This alters the amplitude of various beats of the waveform 930 while allowing all beats to exist. It is understood than any beat or beats may be amplitude controlled, enabling the valve assembly 904 to control the force of the vibrations as desired. Each beat is either at a maximum amplitude 934 or suppressed to some amplitude between the maximum amplitude 934 and a minimum amplitude 936.

Referring specifically to FIG. 9D, a waveform 940 is illustrated with possible beats 942*a*-942*i*. In this example, the valve assembly 904 is used to skip (e.g., suppress) beats 942*b* and 942*e*, lower the amplitude of beats 942*a*, 942*f*, and 942*g*, and allow beats 942*c*, 942*d*, 942*h*, and 942*i* to occur normally. This alters the waveform 940 from a normal nine full amplitude beats per unit time to seven beats in the same amount of time with three of those beats having a reduced amplitude. Each beat is either at a maximum amplitude 944, suppressed to a minimum amplitude 946, or suppressed to some amplitude between the maximum amplitude 944 and the minimum amplitude 946.

Accordingly, the valve assembly 904 may be used to control the beat pattern and amplitude, even when the encoder plate itself is not tunable (e.g., when it only has a single ring). The valve assembly 904 may be used to create frequency reduction in a scaled manner (e.g., suppressing every other beat would halve the frequency of the vibrations) or may be used to skip whatever beats are desired, as well as reduce the amplitude of beats without full suppression.

It is understood that the valve assembly 904 may be used to create a binary system of on or off, or may be used to create a multi level system depending on the resolution provided by the vibrations, the valve assembly 904, and any sensing mechanism used to detect the vibrations. For example, if the impacts are large enough and/or the sensing mechanism is sensitive enough, the valve assembly 904 may provide "on" (e.g., full impact), "off" (e.g., no impact), or "in between" (e.g., approximately fifty percent) (as illustrated in FIG. 9C). If more resolution is available, additional information may be encoded. For example, amplitude may be controlled to "on", "off", and two additional levels of thirty-three percent and sixty-six percent. In another example, amplitude may be controlled to "on", "off", and three additional levels of twenty-five percent, fifty percent, and seventy-five percent. The level of resolution may affect how quickly information can be transmitted to the surface as more information can be encoded per unit time for higher levels of resolution than for lower levels of resolution.

It is understood that the exact force percentage may not be relevant, but may be divided into ranges based on the ability of the system to create and detect vibrations. Accordingly, no impact may actually mean that impact is reduced to less than five percent (or whatever percentage is no longer detectable and provides a detection threshold), while a range of ninety percent to one hundred percent may qualify as "full impact." Accordingly, the actual implementation of encoding using beat skipping and amplitude reduction may depend on many factors and may change based on formation changes and other factors.

Referring to FIG. 10, one embodiment of the anvil plate 906 and encoder plate 908 of FIG. 9A is illustrated in greater detail. Thrust bearings 1002 and 1004 of thrust bearing assembly 910 are also illustrated. In the present example, thrust bearing 1004 is coupled to anvil plate 906 such that the thrust bearing 1004 and anvil plate 906 move together. As illustrated, the thrust bearings 1002 and 1004 may include inserts 1006 and 1008, respectively. The inserts 1006 and 1008, which may be formed of a material such as PDC, are durable, exhibit low friction, and enable the thrust bearings 1002 and 1004 to bear high load levels. The thrust bearings 1002 and 1004 move together, with little or no slack between them.

The thrust bearings 1002 and 1004 may protect the vibration mechanism provided by the anvil plate 906 and encoder plate 908. For example, as the vibration mechanism goes up the ramp of the encoder plate 908, the housing 902 is pushed to the left (e.g., up when vertically oriented) relative to the bit (not shown) and mandrel (not shown but in cavity 914) as the bit engages the formation. When the vibration mechanism goes off the ramp, it drops and the force of the drillstring (not shown) will push the housing 902 to the right (e.g., down when vertically oriented) relative to the mandrel as the weight of the drillstring is no longer supported by the ramp. If the motion limiting mechanism provided by the valve assembly 904 (as described below in greater detail) is weak when the drop occurs, the thrust bearings 1002/1004 move back quickly and hit the bellows assembly 1302 with substantial force because there is not much force opposing the bit force. If the motion limiting mechanism is strong, the thrust bearings 1002/1004 may not drop or may be cushioned. Accordingly, the thrust bearing assembly 910 aids in stopping and/or slowing the drop off of the ramp in the vibration mechanism. Furthermore, the substantial impact that occurs when the thrust bearing 1004 drops back quickly may damage one of the ramps of the vibration mechanism due to the impact being concentrated on one of the relatively sharp corners of the ramp, but can be safely handled by the broader surfaces of the thrust bearing assembly 910.

Figure 11:
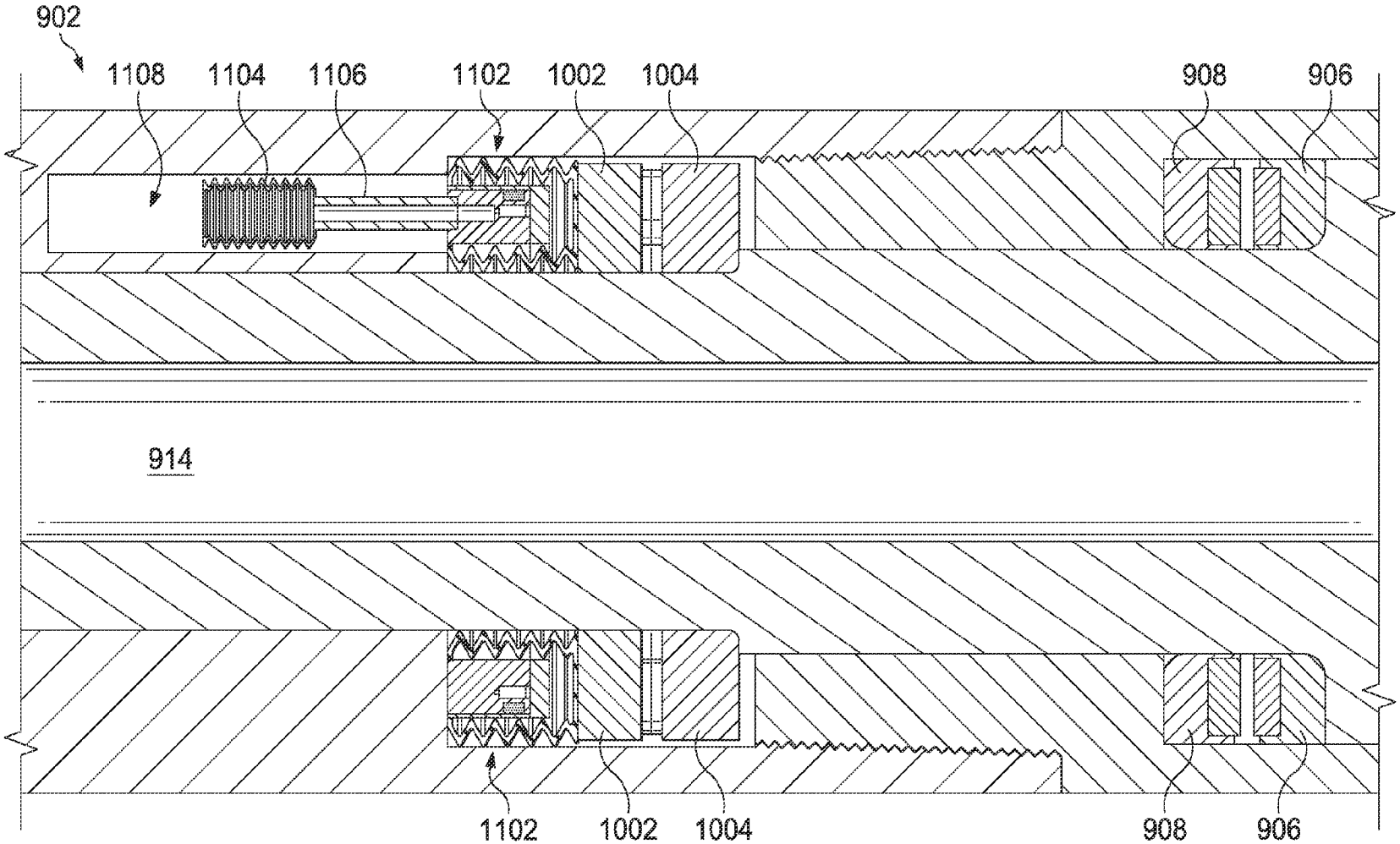
Figure 12:
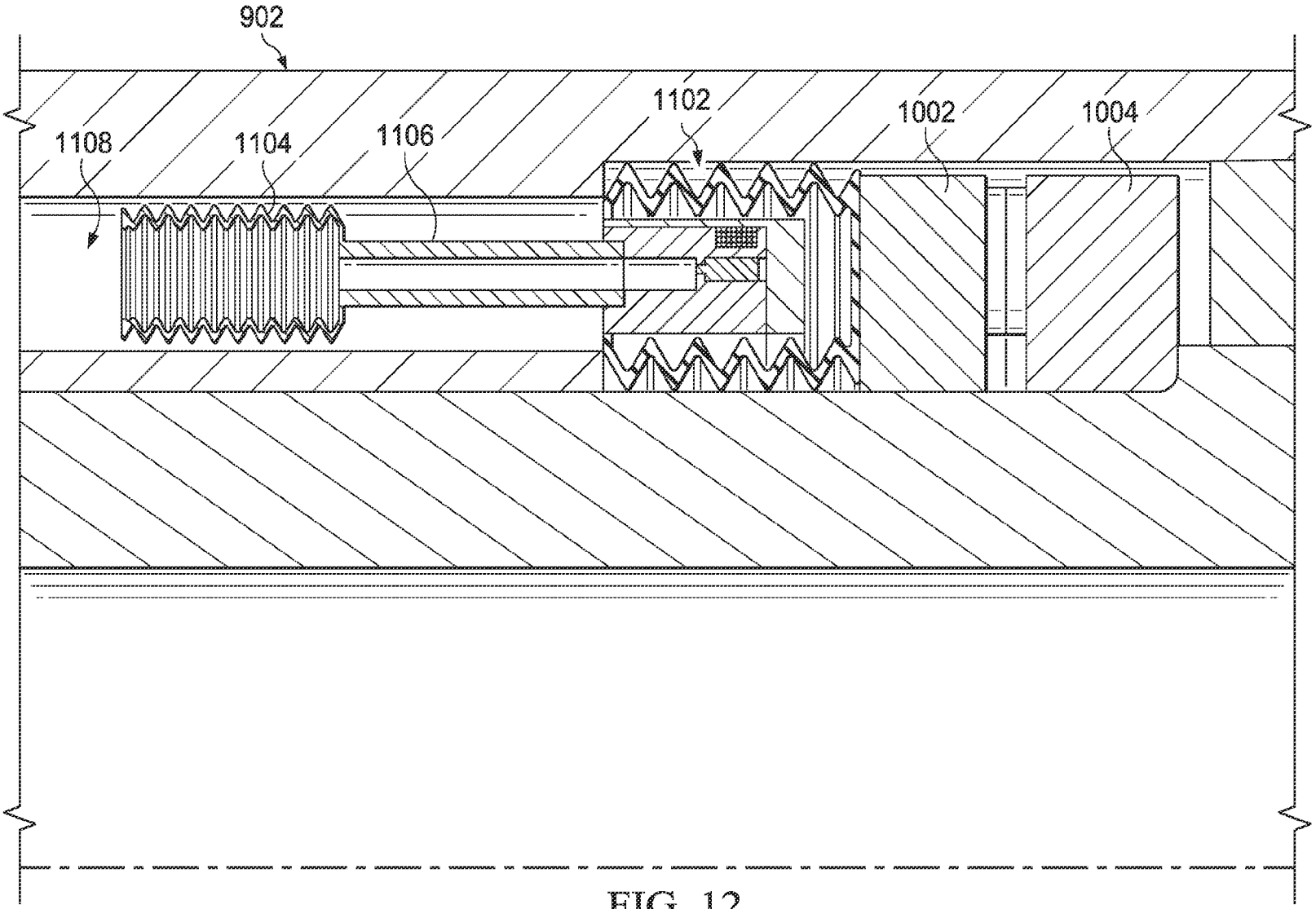
Figure 13:
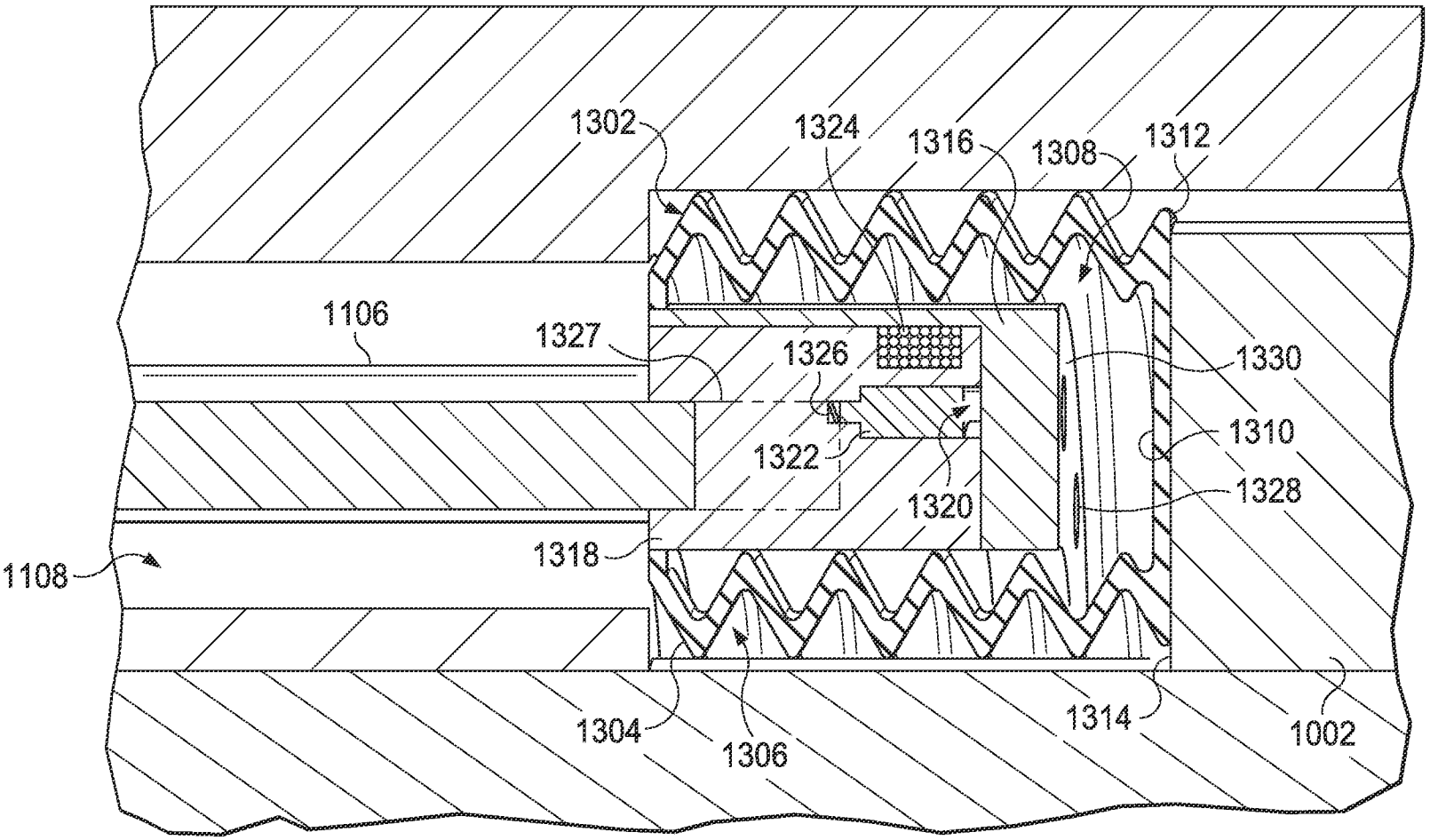
Figure 14:
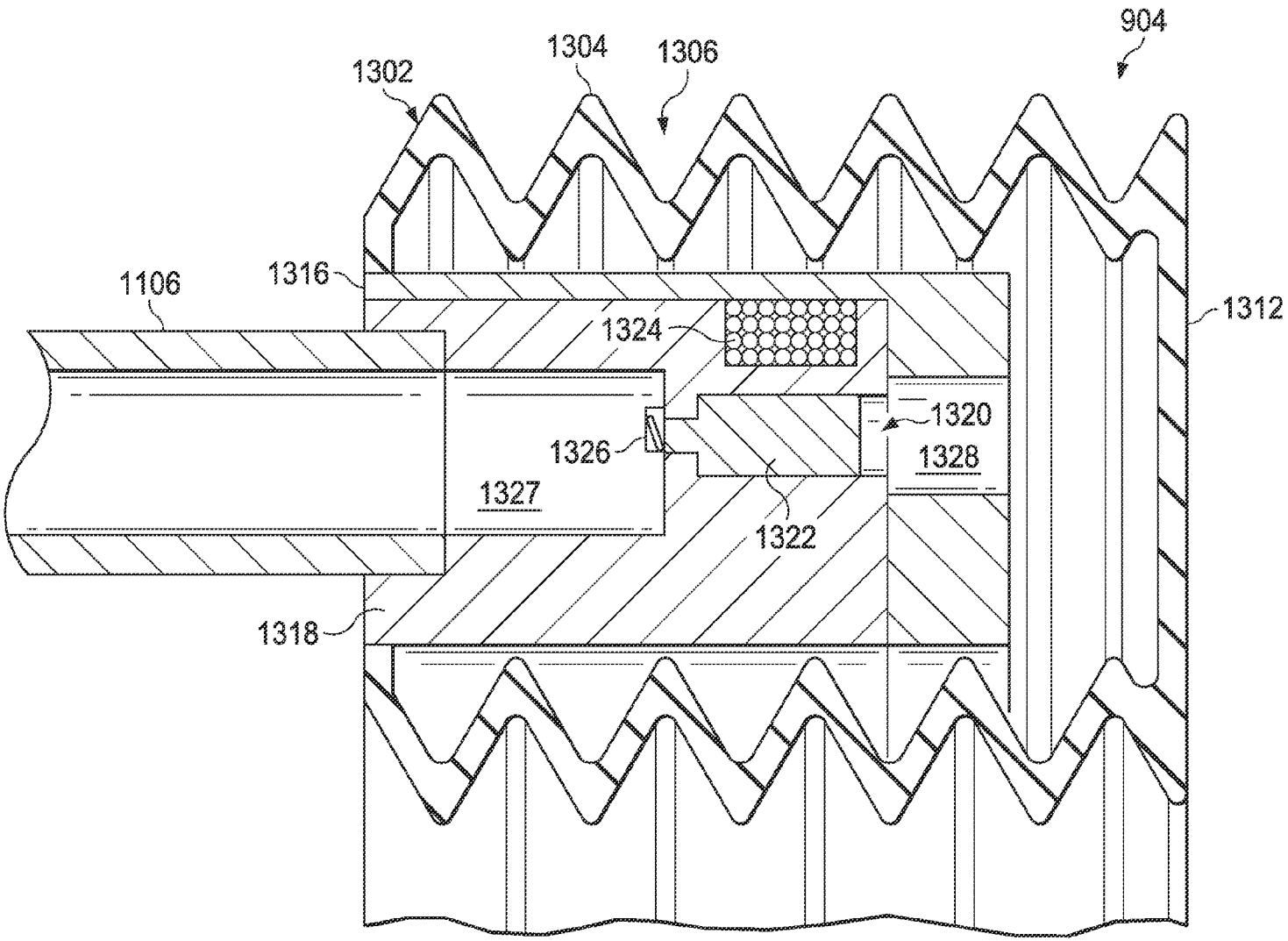
Figure 15:
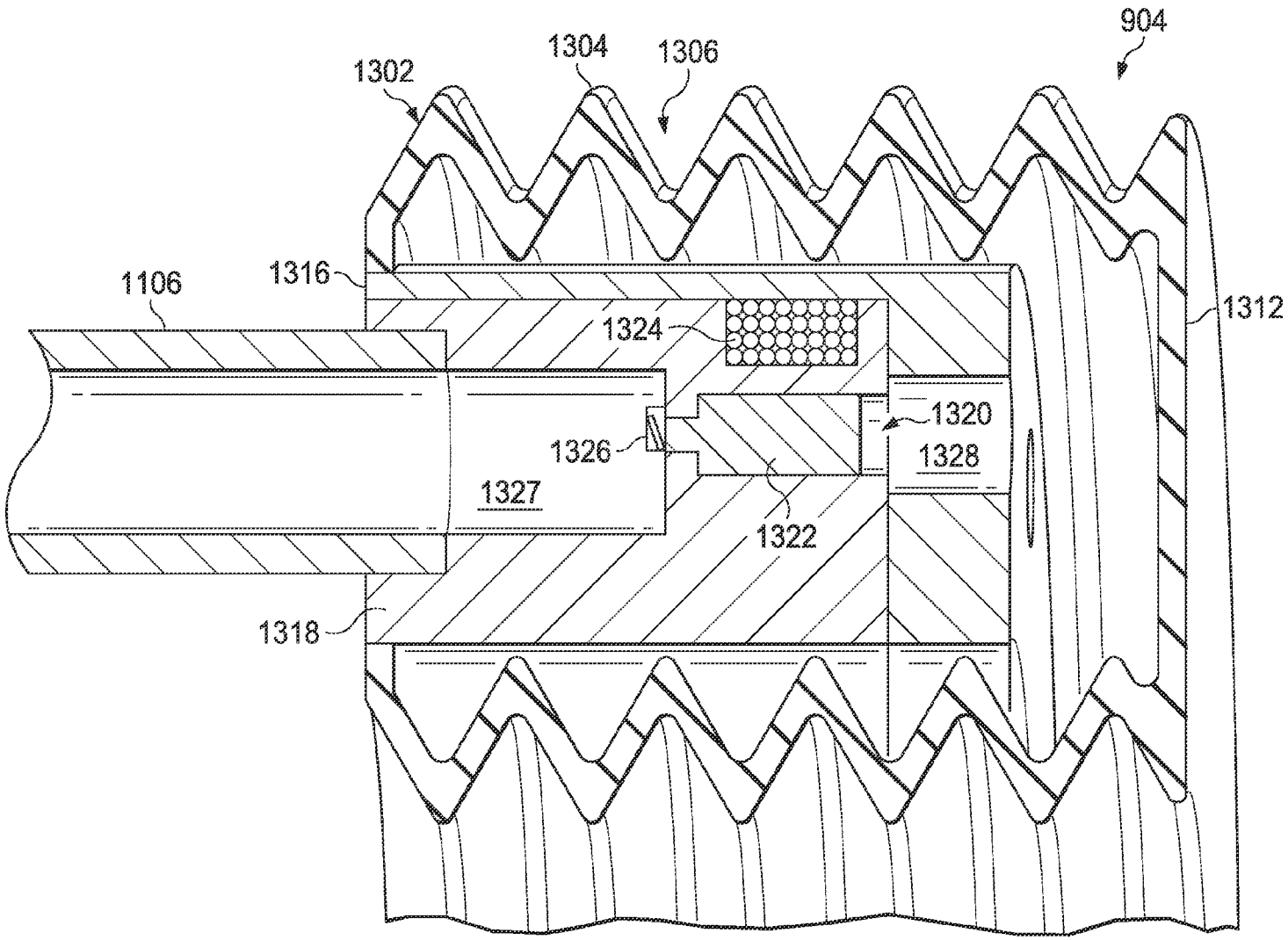
Figure 16:
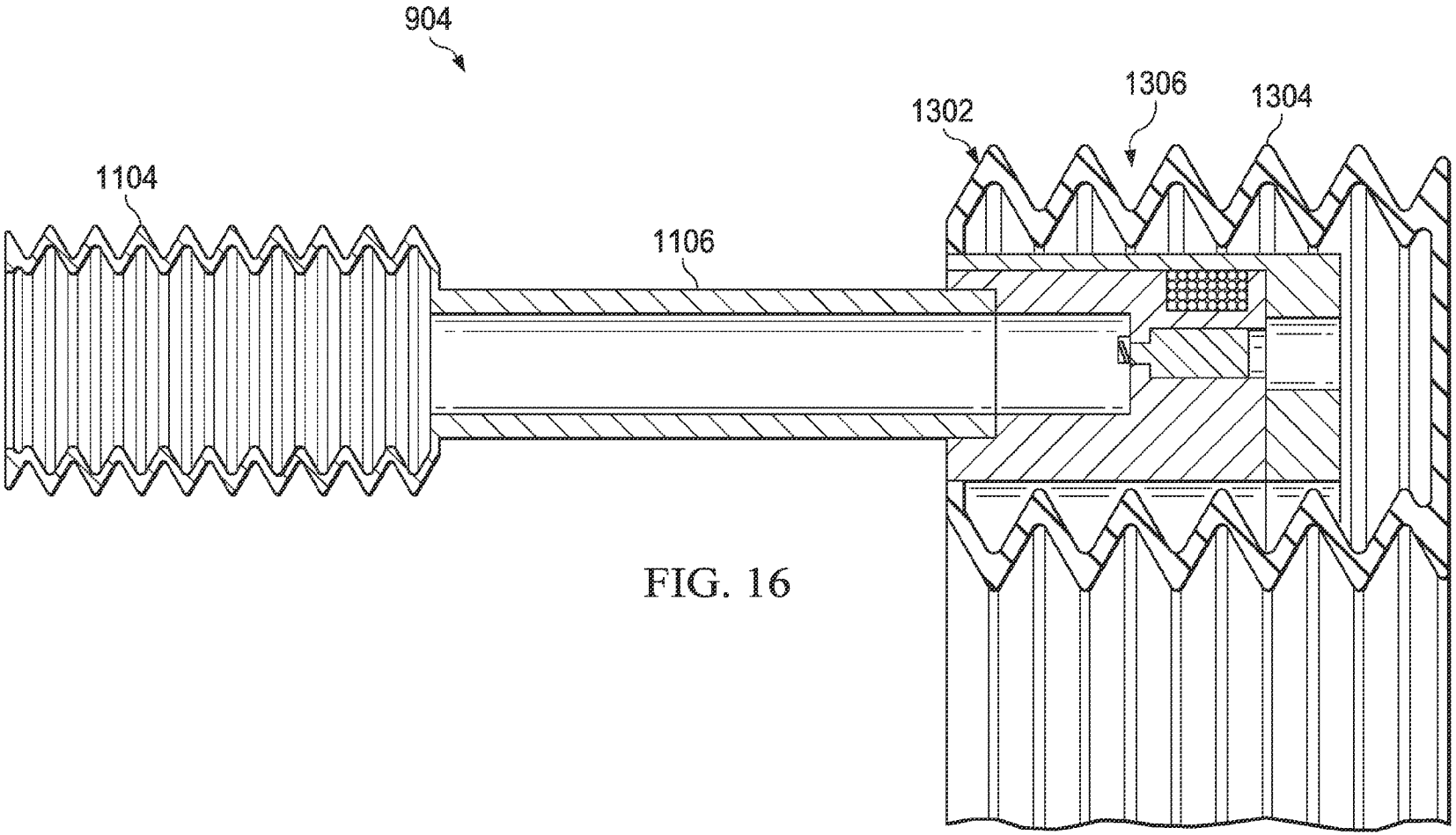
Figure 17:
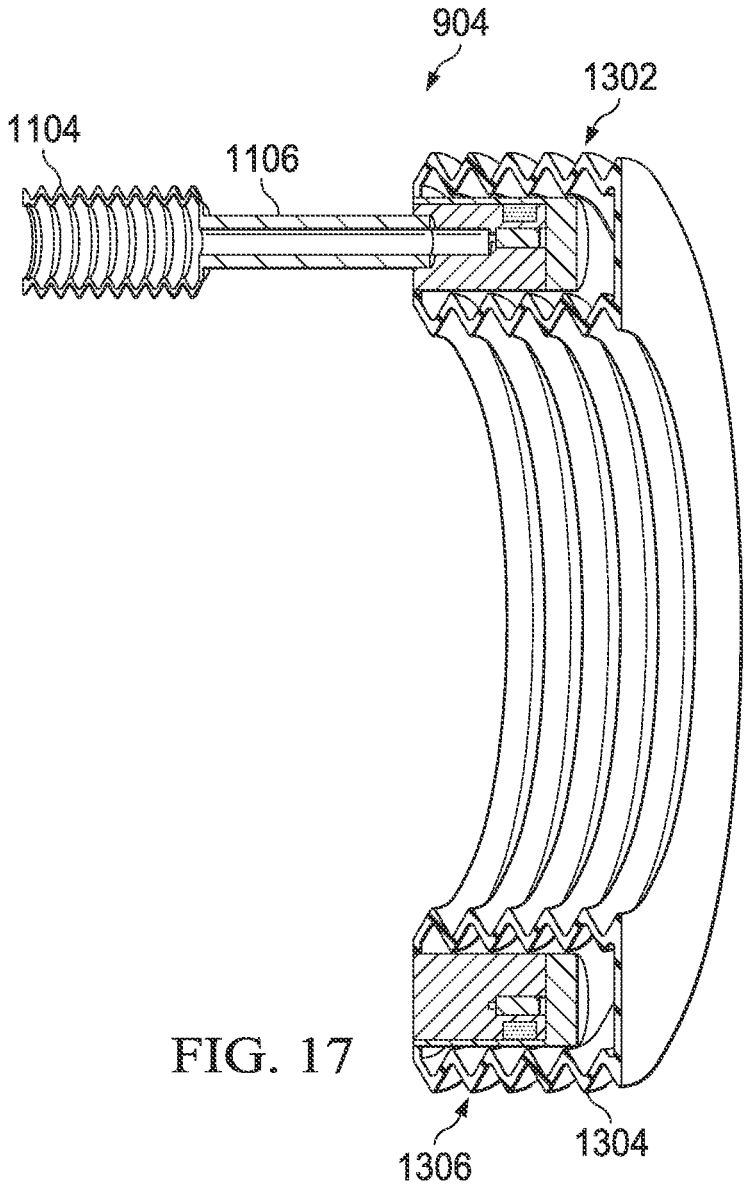
Figure 18:
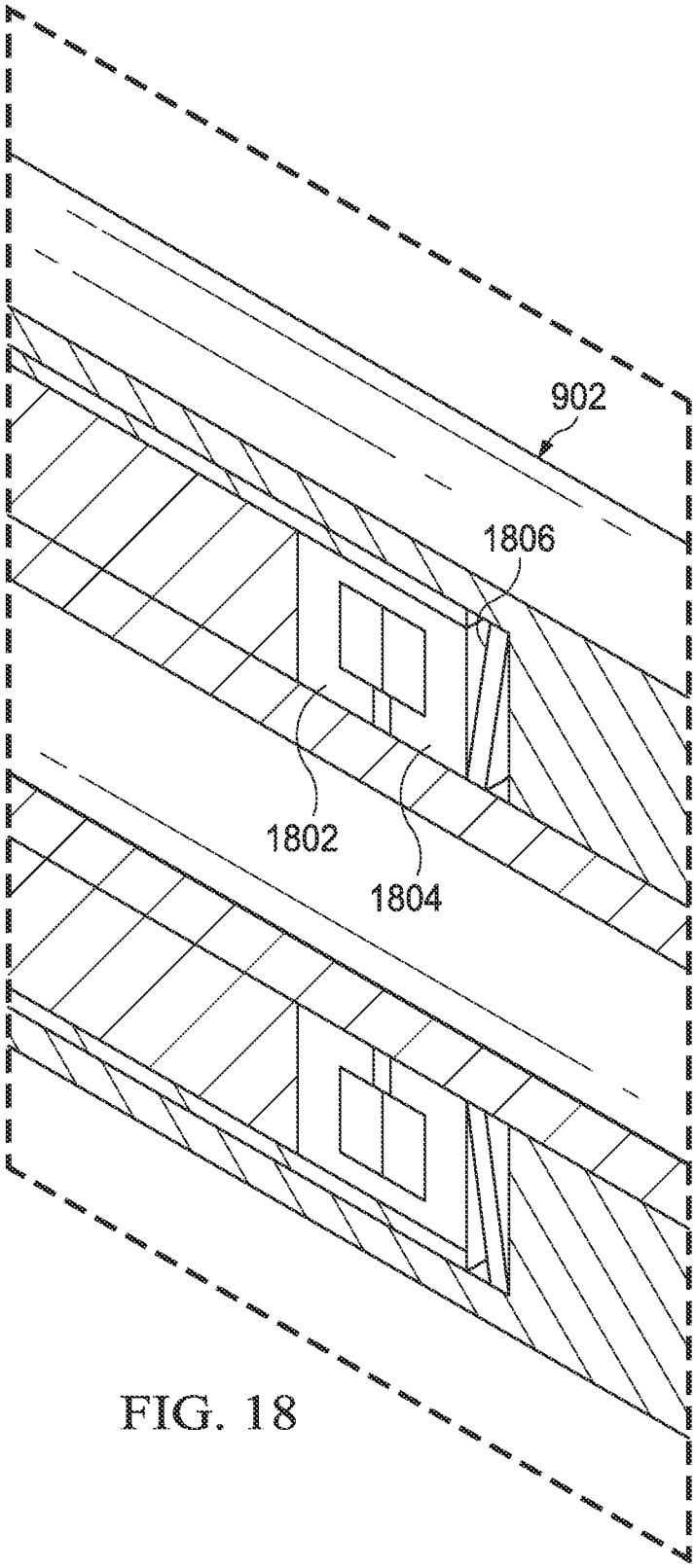

Referring to FIGS. 11 and 12, one embodiment of the valve assembly 904, the anvil plate 906 and encoder plate 908 (only in FIG. 11), and the thrust bearing assembly 910 are illustrated in greater detail. The valve assembly 904 includes a bellows assembly 1102 and a fluid reservoir 1104 that is coupled to the bellows assembly 1102 by a fluid conduit 1106. The bellows assembly 1102 is adjacent to the thrust bearing 1002 of thrust bearing assembly 910. In the present example, the fluid reservoir 1104 is positioned in a chamber 1108 in the housing 902 and may not extend entirely around the cavity 914. In other embodiments, the fluid reservoir 1104 and chamber 1108 may extend entirely around the cavity 914.

Referring to FIGS. 13-17, one embodiment of the bellows assembly 1102 and the thrust bearing assembly 910 are illustrated in greater detail. The bellows assembly 1102 may include a bellows 1302 that is formed with a plurality of ribs 1304 separated by gaps 1306. When compressed, the gaps 1306 will narrow and the ribs 1304 will be forced closer to one another. Decompression reverses this process, with the gaps 1306 getting wider and the ribs 1304 moving farther apart. Accordingly, the bellows 1302 serves as a spring mechanism within the valve assembly 904.

The bellows 1302 includes a cavity 1308. An end of the bellows 1302 adjacent to the thrust bearing 1002 includes a wall having an interior surface 1310 that faces the cavity 1308 and an exterior surface 1312 that faces a surface 1314 of the thrust bearing 1002.

The cavity 1308 at least partially surrounds a sleeve 1316. MR fluid is in the cavity 1308 between the sleeve 1316 and an outer wall of the bellows 1302. The sleeve 1316 provides a seal for the valve assembly 904 while allowing for fluid flow as described below. The sleeve 1316 fits over a valve body 1318. The valve body 1318 includes one channel 1320 in which a valve ring 1322 is positioned and another channel into which an energizer coil 1324 (e.g., copper wiring coupled to a power source (not shown) for creating a magnetic field) is positioned. A spring 1326, such as a Belleville washer, may be positioned in the channel 1320 between the valve ring 1322 and an opening leading to the fluid conduit 1106. A portion of the sleeve 1316 adjacent to the surface 1310 may include flow ports (e.g., holes) 1328. Accordingly, the cavity 1308 may be in fluid communication with the fluid conduit 1106 via the holes 1328 and channel 1320. Although not shown, the channel 1320 is in fluid communication with the fluid conduit 1106 as long as the valve ring 1322 is not seated. A surface 1330 of the sleeve 1316 facing the surface 1310 provides an anvil surface that takes impact transferred from the thrust bearing 1002.

The valve assembly 904 provides a spring force. More specifically, as the mandrel in the cavity 914 goes up and down, the encoder plate 908 and anvil plate 906 move relative to one another due to the ramps. This in turn compresses the spring provided by the bellows 1302. This spring force provided by the bellows 1302 keeps the thrust bearings 1002 and 1004 in substantially constant contact. Accordingly, the load is shared between the ramp of the vibration mechanism and the spring coefficient of the valve assembly 904.

Referring to FIG. 18, one embodiment of the off-bottom bearing assembly 912 is illustrated. The off-bottom bearing assembly 912 may include bearings 1802 and 1804. A spring 1806, such as a Belleville washer, may provide a bias in the upward direction (e.g., opposite the ramps in the vibration mechanism) to keep slack out of the thrust bearings. The spring 1806 may also provide another tuning point for the system 300.

Referring generally to FIGS. 9-18, in operation, the valve assembly 904 may be used to slow or stop the compression of the bellows 1302, which in turn alters the effect of the impact caused by the encoder plate 908 and anvil plate 906. The movement of the encoder plate 908 relative to the anvil plate 906 that occurs when the encoder plate 908 goes off a ramp causes an impact between the thrust bearings 1002 and 1004 because the thrust bearing 1004 moves in conjunction with the anvil plate 906. This impact is transferred via the surface 1314 of the thrust bearing 1002 to the exterior surface 1312 of the bellows 1302, and then from the interior surface 1310 to the anvil surface 1330 of the sleeve 1316.

If the energizer coil 1324 is not powered on to create a magnetic field, the MR fluid inside the bellows 1302 is not excited and may flow freely into the fluid reservoir 1104 via the fluid conduit 1106. In this case, the interior surface 1310 of the bellows 1302 may strike the anvil surface 1330 of the sleeve 1316 with relatively little resistance except for the spring resistance provided by the structure of the bellows 1302. This provides a relatively clean hard impact between the interior surface 1310 of the bellows 1302 may strike the anvil surface 1330 of the sleeve 1316. The MR fluid will be forced into the fluid reservoir 1104 and will flow back into the bellows 1302 as the bellows 1302 undergoes decompression.

However, if the energizer coil 1324 is powered on, the resistance within the bellows 902 may be considerably greater depending on the strength of the magnetic field. By supplying a strong enough magnetic field to restrict flow of the MR fluid sufficiently, the MR fluid may pull the valve ring 1322 in on itself and shut the valve ring 1322. In other words, sufficiently exciting the MR fluid makes the MR fluid viscous enough to pull the valve ring 1322 into a sealed position. Once the valve ring 1322 is seated, the bellows 1302 becomes a relatively uncompressible structure. Then, when the interior surface 1310 of the bellows 1302 receives the force transfer from the thrust bearing 1002, the interior surface 1310 will only travel a small distance (relative to the fully compressible state when the MR fluid is not excited) and will not make contact with the anvil surface 1330 of the sleeve 1316. Accordingly, minimal impact shock will occur. In embodiments where the valve ring 1322 is not completely seated, a sufficient increase in the viscosity of the MR fluid may allow a cushioned impact, rather than a hard impact, to occur between the interior surface 1310 and the anvil surface 1330. The MR fluid will again flow freely when the excitation is stopped.

Accordingly, there are two different approaches that may be provided by the valve assembly 904, with the particular approach selected by controlling the magnetic field. First, the valve assembly 904 may be used to cause fluid restriction to control how quickly the fluid transfers through the valve opening. This provides dampening functionality and may effectively suspend the impact mechanism from causing impact. Second, the valve assembly 904 may be used to stop fluid flow. In embodiments where the fluid flow is stopped completely, heat dissipation may be less of an issue than in embodiments where fluid flow is merely restricted and slowed. It is understood that the valve assembly 904 may provide either approach based on manipulation of the magnetic field.

In addition to controlling the functionality of the valve assembly 904 by manipulating the magnetic field, the functionality may be tuned by altering the spring forces that operate within the valve assembly 904. The spring 1326 biases the check valve ring 1322 so that the check valve ring 1322 resets to the open position when the magnetic field is dropped. The expansion of the bellows 1302 during decompression also acts as a spring to reset the check valve ring 1322. The reset may be needed because even though the vibration mechanism may force the encoder plate 908 to go up the ramp, there should generally not be a gap between the thrust bearings 1002/1004 and the bellows 1302. In other words, the bellows 1302 should not be floating off the thrust bearing 1002 and so needs to reset relatively quickly.

It is understood that the spring coefficients of the springs provided by the valve assembly 904 may be tuned, as too much spring force may dampen the impact and too little spring force may cause the bellows 1302 to float and prevent the system from resetting. Due to the design of the valve assembly 904, there are multiple points where the spring strength can be increased or decreased. Accordingly, the spring effect may be used to reset the system relatively quickly, with the actual time frame in which a reset needs to occur being controlled by the operating frequency (e.g., one hundred hertz) and/or other factors.

It is understood that many variations may be made to the system 900. For example, in some embodiments, the sleeve 1316 and/or the bellows 1302 may be disposable. For example, the bellows 1302 may have a fatigue life and may therefore withstand only so many compression/decompression cycles before failing. Accordingly, in such embodiments, the bellows 1302, sleeve 1316, and/or other components may be designed to balance such factors as lifespan, cost, and ease of replacement.

In some embodiments, the bellows 1302 and/or bellows assembly 1102 may be sealed.

In some embodiments, a piston system may be used instead of the bellows assembly 1102.

In some embodiments, the thrust bearing assembly 910 may be lubricated with drilling fluid. In other embodiments, MR fluid may be used as a lubricant. In still other embodiments, traditional oil lubricants may be used.

In some embodiments, a plurality of smaller bellows may be used instead of the single bellows 1302. In such embodiments, because the hoop stress on a cylindrical pipe increases as the diameter increases due to increased pressures, the use of smaller bellows may increase the pressure rating.

In some embodiments, a flexible sock-like material may be placed around the bellows 1302. In such embodiments, grease may be placed in the gaps 1306 of the bellows 1302 and sealed in using the sock-like structure. When the bellows 1302 is compressed, the grease would expand into the flexible sock-like structure, which would then force the grease back into the gaps 1306 during decompression. This may prevent solids from getting into the gaps 1306 and weakening or otherwise negatively impacting the performance of the bellows 1302.

In some embodiments, a rotary seal and a bellows mounted seal for lateral movement may be used to address the difficulty of sealing both lateral and rotational movement. In such embodiments, the bellows may enable the seal to move with the lateral movement.

In some embodiments, stacked disks (e.g., Belleville washers) may be used to make the bellows. For example, the stacked disks may have opening (e.g., slots or holes) to allow MR fluid to go into and out of the bellows (e.g., inside to outside and vice versa). The magnetic field may then be used to change the viscosity of the MR fluid to make it easier or harder for the fluid to move through the openings.

In some embodiments, torque transfer between the thrust bearing 1002 and the bellows 1302 may be addressed. For example, torque may be transferred from the thrust bearing 1004 to the thrust bearing 1002, and from the thrust bearing 1002 to the bellows 1302. Even in embodiments where the interface between the bellows 1302 and thrust bearing 1102 has a higher friction coefficient than the interface between the thrust bearings 1002 and 1004 (which may be PDC on PDC), some torque may transfer. This may be undesirable if the bellows 1302 is unable to handle the amount of torque being transferred. Accordingly, non-rotating elements (e.g., splines) may be placed on the thrust bearing 1002 and/or elsewhere to keep the thrust bearing 1002 from rotating and transferring torque to the bellows 1302. In embodiments where the friction level of the interface between the bellows 1302 and thrust bearing 1002 enables the interface to slip before significant torque can be transferred, such non-rotating elements may not be needed.

Figure 27:
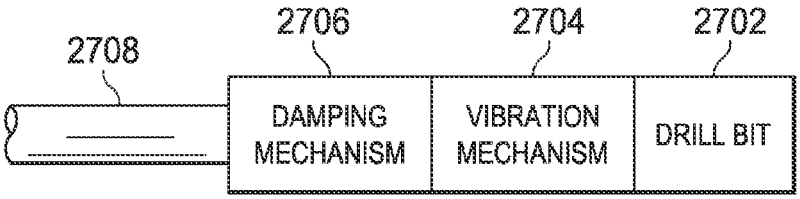
FIG. 27 illustrates a vibration mechanism and damping mechanism co-located with a drill bit of a bottom hole assembly.

With respect to the embodiment described with respect to FIG. 9-18, the damping portion of the mechanism and the vibration portion of the mechanism are each located together near the drill bit. This configuration is generally illustrated with respect to FIG. 27 where it is shown that the drill bit 2702 is located in close configuration with the vibration mechanism 2704 and the damping mechanism 2706 at the end of the drill string 2708. The vibration mechanism 2704 generates a series of pulses or beats which may be used for communication and/or control as described herein. The damping mechanism 2706 is used for minimizing or damping the generated pulses or beats by the vibration mechanism 2704 as described herein.

Figure 28:
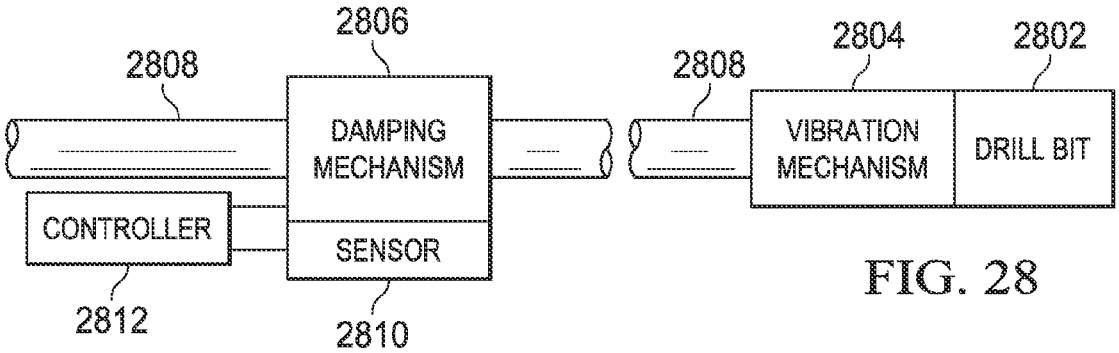
FIG. 28 illustrates a damping mechanism remotely located up the drill string from a vibration mechanism within a bottom hole assembly.

In an alternative configuration illustrated in FIG. 28, the drill bit 2802 and vibration mechanism 2804 are located together at the end of the drill string 2708. The vibration mechanism 2804 continuously or periodically generates a series of pulses or beats that are transmitted up the drill string 2808 and passes through the damping mechanism 2806. The damping mechanism 2806 selectively damps the purses or beats that are being transmitted up the drill string 2808 from the vibration mechanism 2804 to encode information therein.

The vibration mechanism 2804 may include a various number of implementations. Vibrations can be created in a variety of manners including use of a solenoid, a piezoelectric device, smart metal, a voice coil, compressed air device or any other manner for generating a series of repeating pulses. In one embodiment, the vibration mechanism 2804 may comprise the embodiment including the anvil plate 906 and encoder plate 908 described hereinabove. In alternative configurations, the vibration mechanism 2804 may comprise a continuous hammer pulse generation mechanism similar to that described in U.S. Pat. No. 7,434,623 entitled PERCUSSIVE TOOL AND METHOD, issued on Oct. 14, 2008, which is incorporated herein by reference in its entirety, and US Patent Application Publication No. 2013/0264119 entitled HAMMER DRILL, published on Oct. 10, 2013, which is incorporated herein by reference in its entirety. One example of an embodiment of a system including a vibration mechanism 2804 is described below with respect to FIGS. 29-34.

A sensor 2810 may be associated with a damping mechanism 2806 in order to detect the vibration beats being generated by the vibration mechanism 2804 along the drill string 2808. A controller 2812 in communication with the sensor 2810 uses the detected beats in order to control the damping mechanism 2806 to damp selected beat pulses to encode information for communication or provide control via the selective damping of beats within the damping mechanism 2806.

Figure 29:
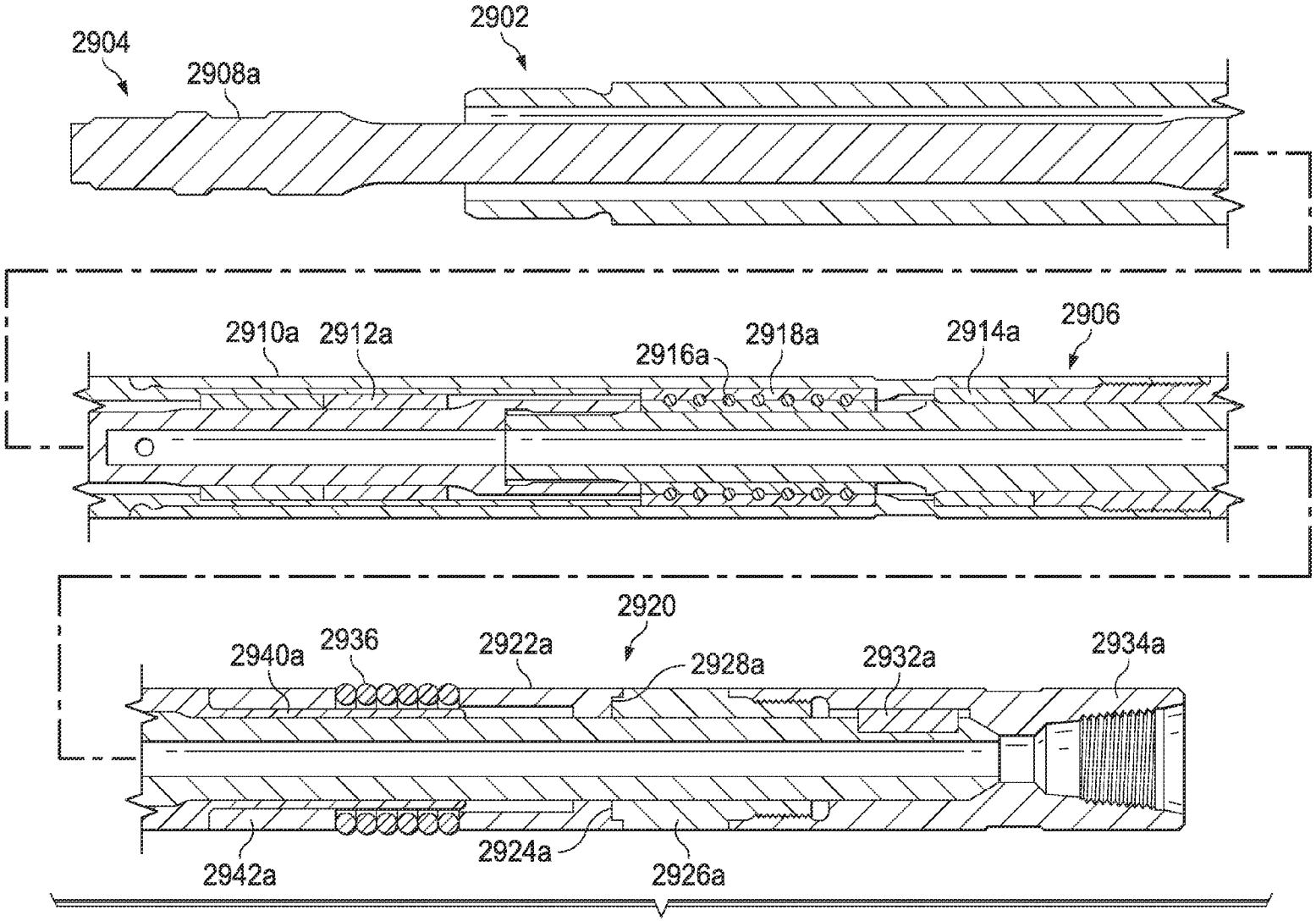
FIG. 29 is a partial section view of a first embodiment of a down hole apparatus including a vibration mechanism.

Referring now to the FIG. 29, a partial sectional view of the downhole apparatus 2902 of a first embodiment will now be discussed. The first embodiment apparatus 2902 includes a power mandrel, seen generally at 2904, that is operatively attached to the output of a downhole mud motor (not shown). The apparatus 2902 also includes a radial bearing housing unit, seen generally at 2906. The radial bearing housing unit 2906 will be operatively attached to the workstring, such as drill pipe or coiled tubing, as will be described later in this disclosure. More particularly, FIG. 29 shows the power mandrel 2904 (which is connected to the output of the motor section, as is well understood by those of ordinary skill in the art). The mandrel 2904 may be referred to as the power mandrel or flex shaft. Also shown in FIG. 29 is the upper bearing housing 2910*a* which includes the upper radial bearings 2912*a*, lower radial bearing 2914*a*, balls 2916*a* and thrust races 2918*a*. The lower housing is seen generally at 2920*a* in FIG. 1 and will be described in further detail.

As seen in FIG. 29, a partial sectional view of lower housing 2920*a* of the downhole apparatus 2902 of the first embodiment is shown. FIG. 29 depicts the hammermass 2922*a* (sometimes referred to as the hammer member or hammer), which is attached (for instance, by spline means via a spring saddle 2940*a*) to the radial bearing housing unit 2906. The hammermass 2922*a* will have a radial cam surface 2924*a*. The hammermass 2922*a* will engage with the anvil 2926*a*, wherein the anvil 2926*a* has a first end that contains a radial cam surface 2928*a*, wherein the radial cam surface 2928*a* and radial cam surface 2924*a* are reciprocal and cooperating in the preferred embodiment, as more fully set out below. FIG. 29 also depicts the power mandrel 2904, which is fixed connected to the driveshaft 2930*a* via thread connection or similar means. A key 2932*a* (also referred to as a spline) allows for rotational engagement of the power mandrel 2904 and the driveshaft 2930*a* with the bitbox sub 2934*a*, while also allowing for lateral movement of the bitbox sub 2934 relative to the drive shaft 2930*a*. The anvil 2926*a* is fixedly connected to the bitbox sub 2934*a*.

FIG. 29 also depicts the spring means 2936 for biasing the hammermass 2922*a*. The spring means 36 is for instantaneous action. More specifically, FIG. 29 depicts the spring saddle 2940*a* that is an extension of the bearing housing 2906 i.e. the spring saddle 2940*a* is attached (via threads for instance) to the bearing housing 2906. The spring saddle 2940*a* is disposed about the driveshaft 2930*a*. Disposed about the spring saddle 2940*a* is the spacer sub 2942*a*, wherein the spacer sub 2942*a* can be made at a variable length depending on the amount of force desired to load the spring means 2936. As shown, the spring means 2936 is a coiled spring member. The spring means 2936 may also be a Belleville washer spring. One end of the spring means 2936 abuts and acts against the hammermass 2922*a* which in turn urges to engagement with the anvil 2926*a*.

Figure 30:
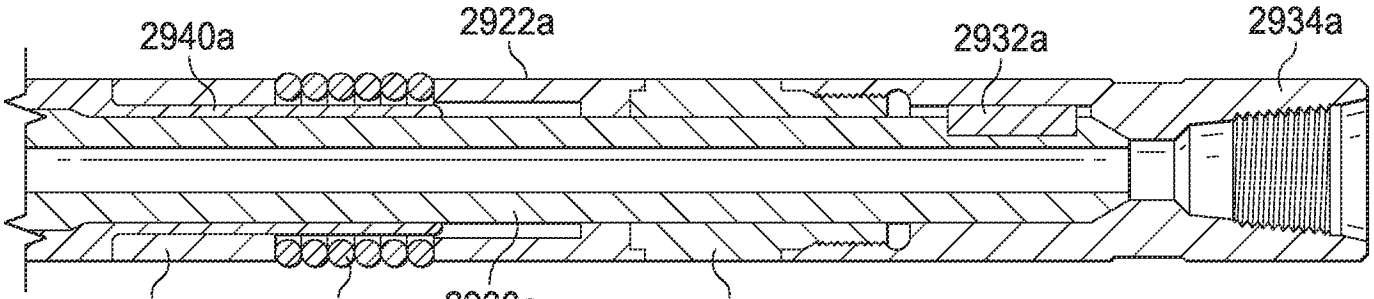
FIG. 30 is a partial sectional view of a lower housing of the down hole apparatus of the embodiment of FIG. 29.
Figure 31:
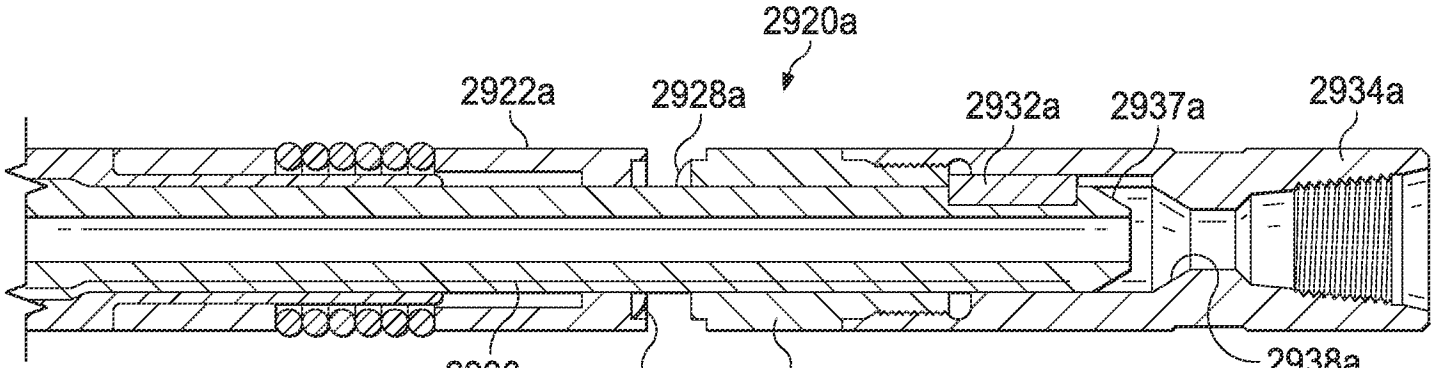
FIG. 31 is partial sectional view of the lower housing of the down hole apparatus of the embodiment of FIG. 29 in a disengaged mode.

In FIG. 30, a partial sectional view of the lower housing 2920*a* of the downhole apparatus 2902 of the first embodiment in the engaged mode is shown. It should be noted that like numbers appearing in the various figures refer to like components. The cam surface 2924*a* and cam surface 2928*a* are abutting and are face-to-face. Note the engaged position of the end 2937*a* of the driveshaft 2930*a* with the angled inner surface 2938*a* of the bitbox sub 2934*a* securing the axial transmission of the WOB from the drillstring to the bitbox sub 2934*a* and the bit (not showing here). In FIG. 31, a partial sectional view of the lower housing 2920*a* of the downhole apparatus 2902 of the first embodiment in the disengaged mode will now be described. In this mode, the apparatus 2902 can be, for instance, running into the hole or pulling out of the hole, as is well understood by those of ordinary skill in the art. Therefore, the radial cam surface 2924*a* of hammer 2922*a* is no longer engaging the radial cam surface 2928*a* of the anvil 2926*a*. Note the position of the end 2937*a* of the driveshaft 2930*a* in relation to the angled inner surface 2938*a* of the bitbox sub 2934*a*. As stated previously, the bit member (not shown in this view) is connected by ordinary means (such as by thread means) to the bitbox sub 2934*a*.

Figure 32:
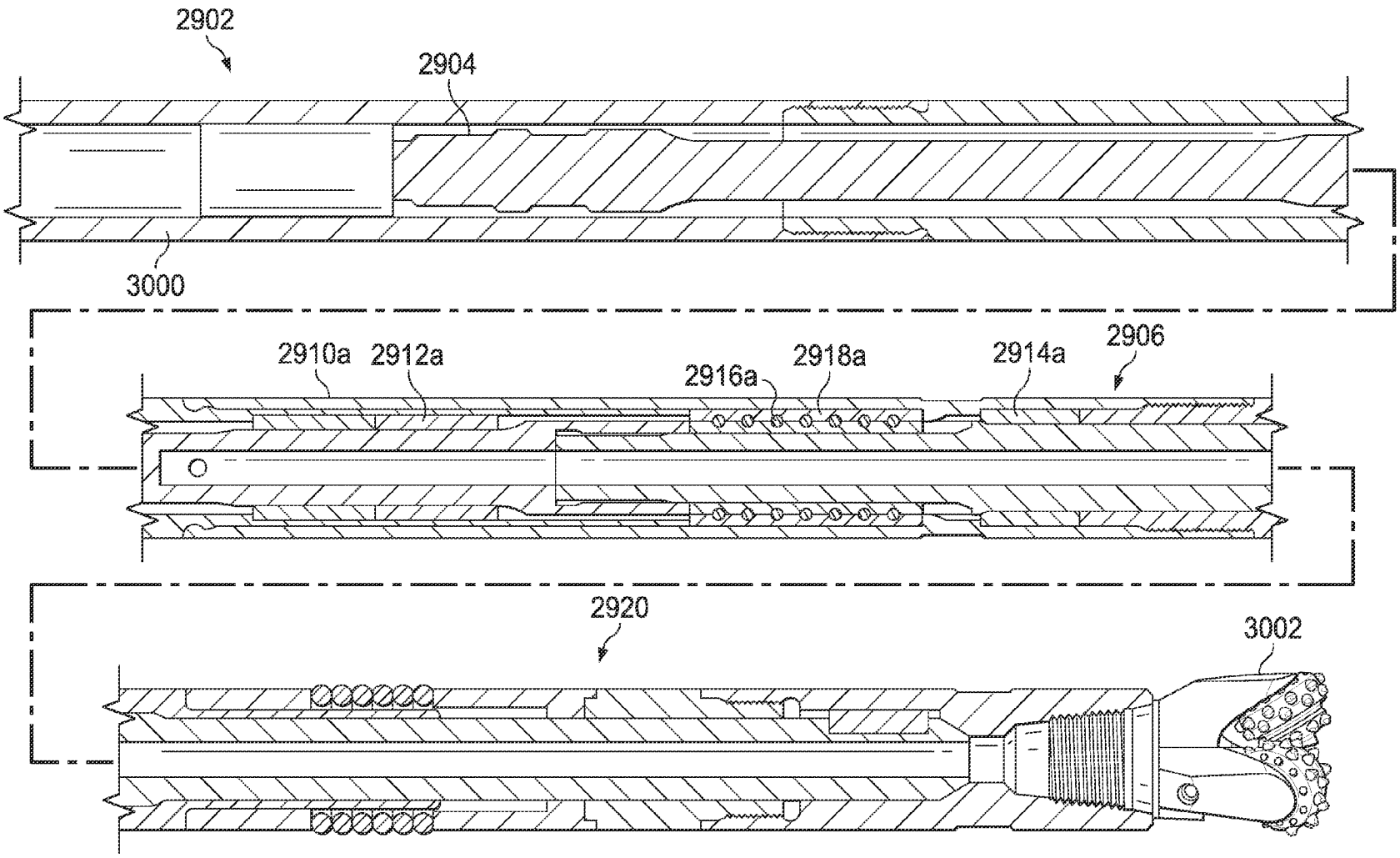
FIG. 32 is a partial sectional view of the down hole apparatus of the embodiment of FIG. 29 as part of a bottom hole assembly.

Referring now to the FIG. 32, a schematic view of the downhole apparatus 2902 of the first embodiment will now be discussed as part of a bottom hole assembly. The first embodiment the apparatus 2902 includes the power mandrel, seen generally at 2904, that is operatively attached to the output of a downhole mud motor "MM". The apparatus 2902 also includes a radial bearing housing unit, seen generally at 2906. The radial bearing housing unit 2906 will be operatively attached to the workstring 3000, such as drill pipe or coiled tubing. Also shown in FIG. 32 is the upper bearing housing 2910*a* which includes the upper radial bearings 2912*a*, lower radial bearing 2914*a*, balls 2916*a* and thrust races 2918*a*. The lower housing is seen generally at 2920*a*. As shown in FIG. 32, the bit 3029 is attached to the apparatus 2902, wherein the bit 2930 will drill the wellbore as readily understood by those of ordinary skill in the art.

Figure 33:
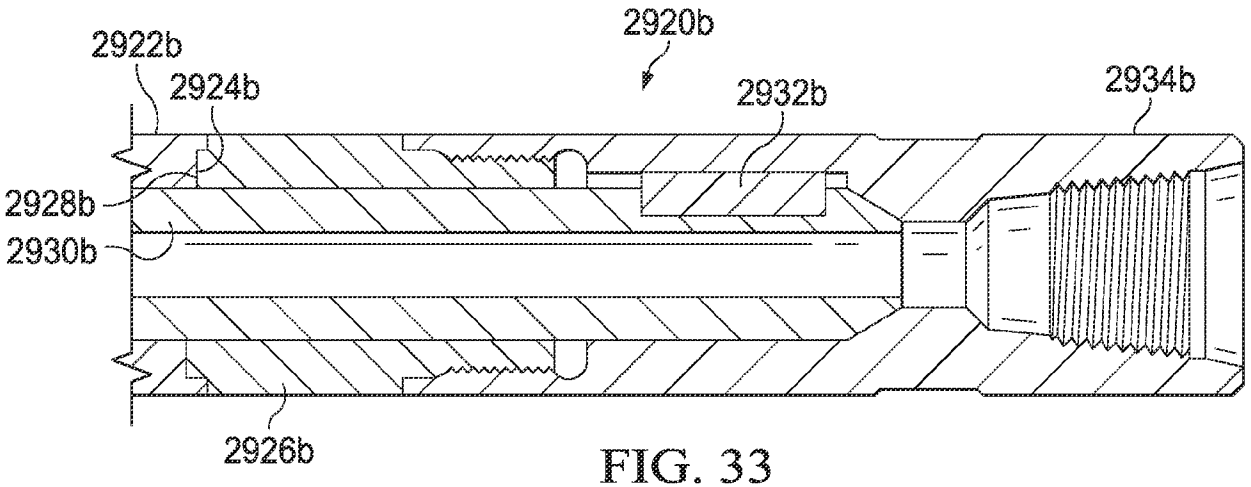
FIG. 33 is a partial sectional view of a lower housing of the down hole apparatus of a second embodiment in an engaged mode.
Figure 34:
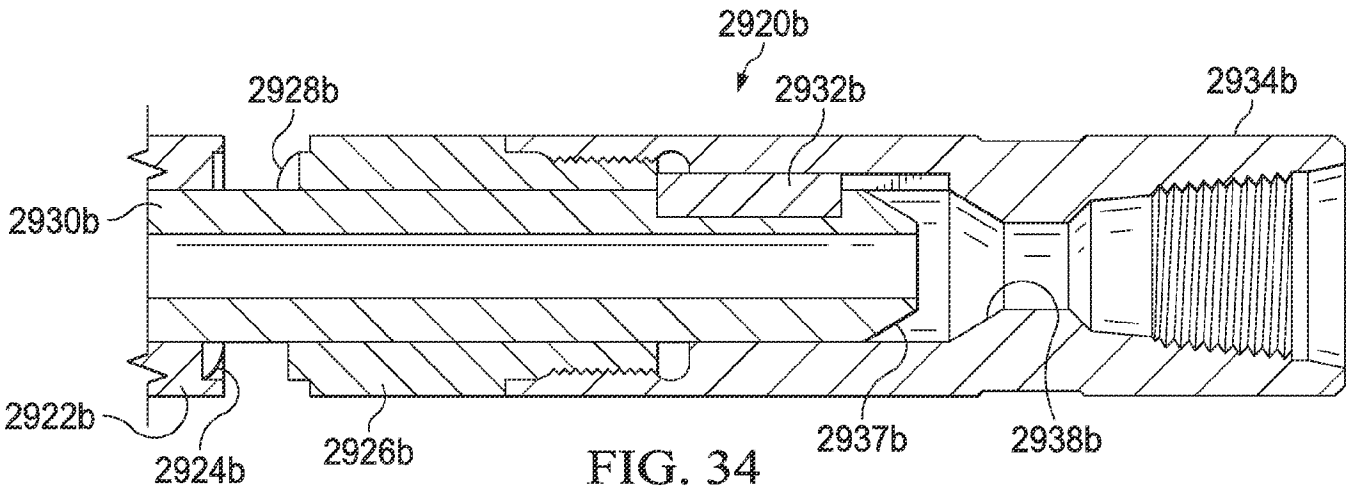
FIG. 34 is a partial sectional view of a lower housing of a down hole apparatus of the embodiment of FIG. 33 in the disengage mode.

FIG. 33 and FIG. 34 depict the embodiment of the apparatus 2902 without the spring means. Referring now to FIG. 33, a partial sectional view of lower housing 2920*b* of the downhole apparatus 2902 of a second embodiment in the engaged mode is shown. FIG. 33 depicts the hammermass 2922*b* (sometimes referred to as the hammer member or hammer), which is attached (for instance, by spline means) to the spring saddle and the radial bearing housing unit (not shown here). The hammermass 2922*b* will have a radial cam surface 2924*b*. The hammermass 2922*b* will engage with the anvil 2926*b*, wherein the anvil 2926*b* has a first end that contains a radial cam surface 2928*b*, wherein the radial cam surface 2928*b* and radial cam surface 2924*b* of the hammermass 2922*b* are reciprocal and cooperating in the preferred embodiment, as more fully set out below. FIG. 33 also depicts the driveshaft 2930*b* (with the driveshaft 2930*b* being connected to the power mandrel, not shown here). A key 2932*b* (also referred to as a spline) allows for rotational engagement of the drive shaft 2930*b* with the bitbox sub 2934*b*, while also allowing for lateral movement of the bitbox sub 2934*b* relatively to the driveshaft 2930*b*. The anvil 2926*b* is fixed connected to the bitbox sub 2934*b*.

In FIG. 34, a partial sectional view of the lower housing 2920*b* of the downhole apparatus 2902 of the second embodiment in the disengaged mode will now be described. In this mode, the apparatus 2902 can be, for instance, running into the hole or pulling out of the hole, as well understood by those of ordinary skill in the art. Hence, the radial cam surface 2924*b* of hammermass 2922*b* is no longer engaging the radial cam surface 2928*b* of the anvil 2926*b*. Note the position of the end 2937*b* of the driveshaft 2930*b* in relation to the angled inner surface 2938*b* of the bitbox sub 2934*b*. As previously mentioned, a bit member is connected (such as by thread means) to the bitbox sub 2934*b*.

The implementation of the vibration mechanism 2804 has been described with respect to the implementation illustrated in FIGS. 9-18 and the further embodiment described with respect to FIGS. 29-34, it will be appreciated that other implementations for providing a continuous or selective pulse or beat generation mechanism associated with the end of the drill string 2808 may be utilized in generating the beats for transmission vp the drill string 2808 for various communication and control purposes.

The damping mechanism 2806 in one embodiment may be configured such as that described with respect to valve assembly 904 described hereinabove. However, other configurations for the damping mechanism 2806 may also be utilized. Examples of things which may be used to for providing the damping mechanism include the use of an magnetic resonance (MR) fluid, a spring, various types of mechanical cushioning devices, various types of mechanical latching devices, gaseous damping systems and any other components enabling the damping of the beats generated by the vibration mechanism 2804. In one example, the active vibration damper sub provided by APS Technologies, Inc. may be utilized for the damping mechanism 2806. Embodiments of this damping mechanism are described in U.S. Pat. No. 7,219,752 entitled SYSTEM AND METHOD FOR DAMPING VIBRATION IN A DRILL STRING, issued May 22, 2007, which is incorporated herein by reference in its entirety, and U.S. Pat. No. 7,377,339 entitled SYSTEM AND METHOD FOR DAMPING VIBRATION IN A DRILL STRING, issued May 28, 2008, which is incorporated herein by reference in its entirety. This embodiment of a damping mechanism minimizes actual and torsional drill string vibration.

Referring now to FIGS. 35-39, there is illustrated one potential embodiment of a damping mechanism 2806. Figures depict an embodiment of a vibration damping system 3510. The figures are each referenced to a common coordinate system 3511 depicted therein. The vibration damping system 3510 can be used as part of a drill string 3512, to dampen vibration of a drill bit 3513 located at a down-hole end of the drill string 3512 (see FIG. 35).

The vibration damping system 3510 comprises a torsional bearing assembly 3514, a valve assembly 3516, and a spring assembly 3518. The valve assembly 3516 and the spring assembly 3518 can produce axial forces that dampen vibration of the drill bit 3513. The magnitude of the damping force can be varied by the valve assembly 3514 in response to the magnitude and frequency of the vibration, on a substantially instantaneous basis. The vibration damping assembly 3510 can be mechanically coupled to the drill bit by drill pipe 3522 that forms part of the drill string 3512.

The torsional bearing assembly 3514 can facilitate the transmission of drilling torque, while permitting relative axial movement between the portions of the drill string 3512 located up-hole and down-hole of the vibration damping system 3510. Moreover, the torsional bearing assembly 3514 can transform torsional vibration of the drill bit 3513 into axial vibration. The axial vibration, in turn, can be damped by the valve assembly 3516 and the spring assembly 3518.

Figure 35:
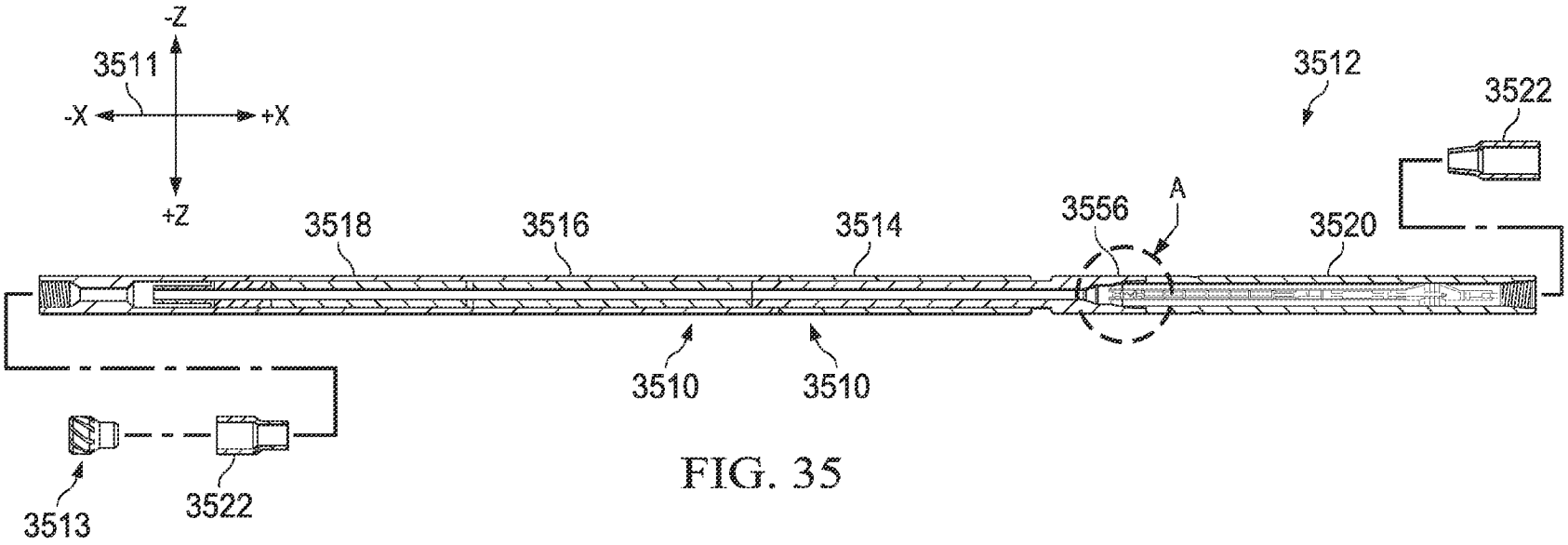
FIG. 35 is a longitudinal cross-sectional view of an embodiment of a vibration damping mechanism installed as part of a drill string.
Figure 36:
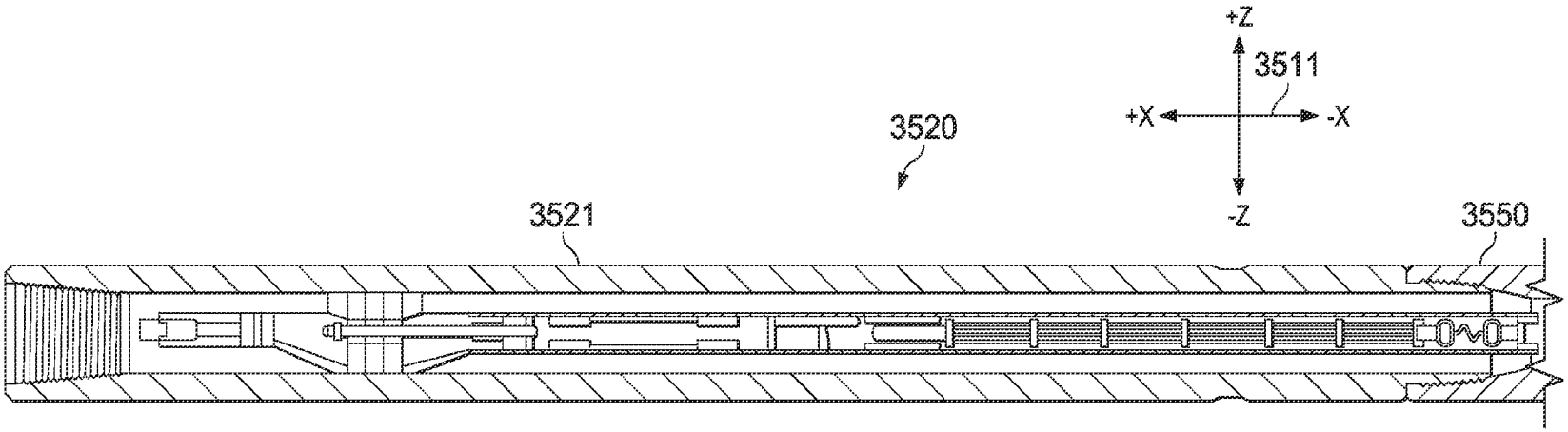
FIG. 36 is a longitudinal cross-sectional view of a turbine alternator assembly of the drill string shown in FIG. 35.

The vibration damping system 3510 can be mechanically and electrically connected to a turbine-alternator module 3520 located up-hole of the vibration damping system 3510 (see FIGS. 35 and 36). (The up-hole and down-hole directions correspond respectively to the "+x" and "−x" directions denoted in the figures.) The turbine-alternator module 3520 can provide electric power for the vibration damping system 3510. The use of the vibration damping system 3510 in conjunction with the turbine-alternator module 3520 is described for exemplary purposes only. The vibration damping system 3510 can be powered by an alternative means such as a battery located in the vibration damping system 3510 (or elsewhere in the drill string 3512), or a power source located above ground.

Figure 37:
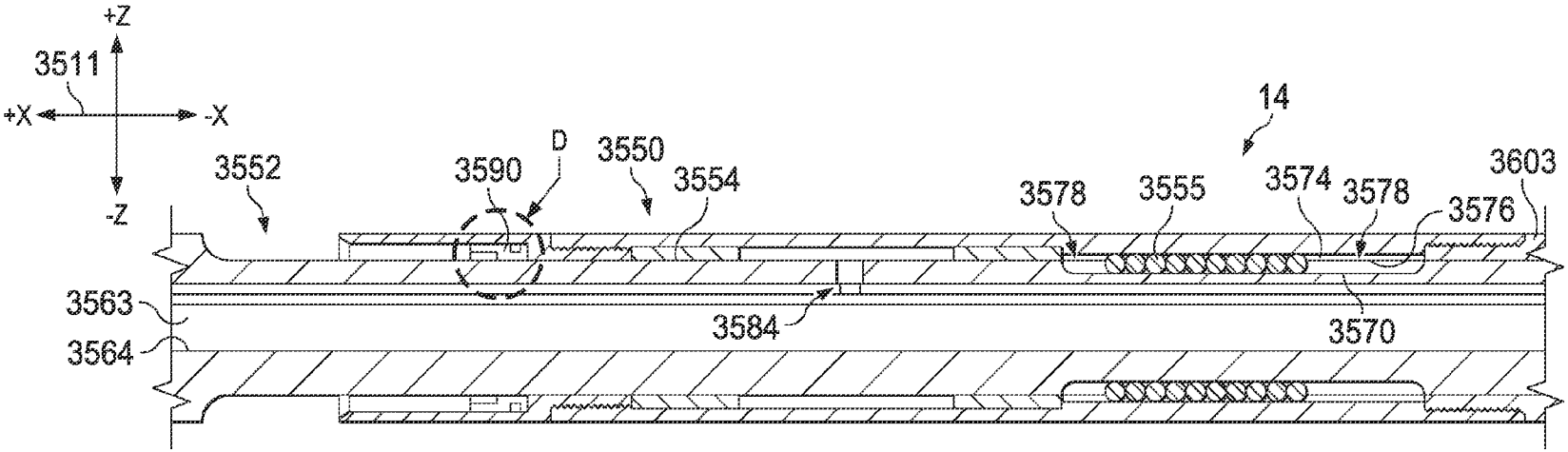
FIG. 37 is a longitudinal cross-sectional view of a torsional bearing assembly of the vibration damping mechanism shown in FIG. 35.
Figure 38A:
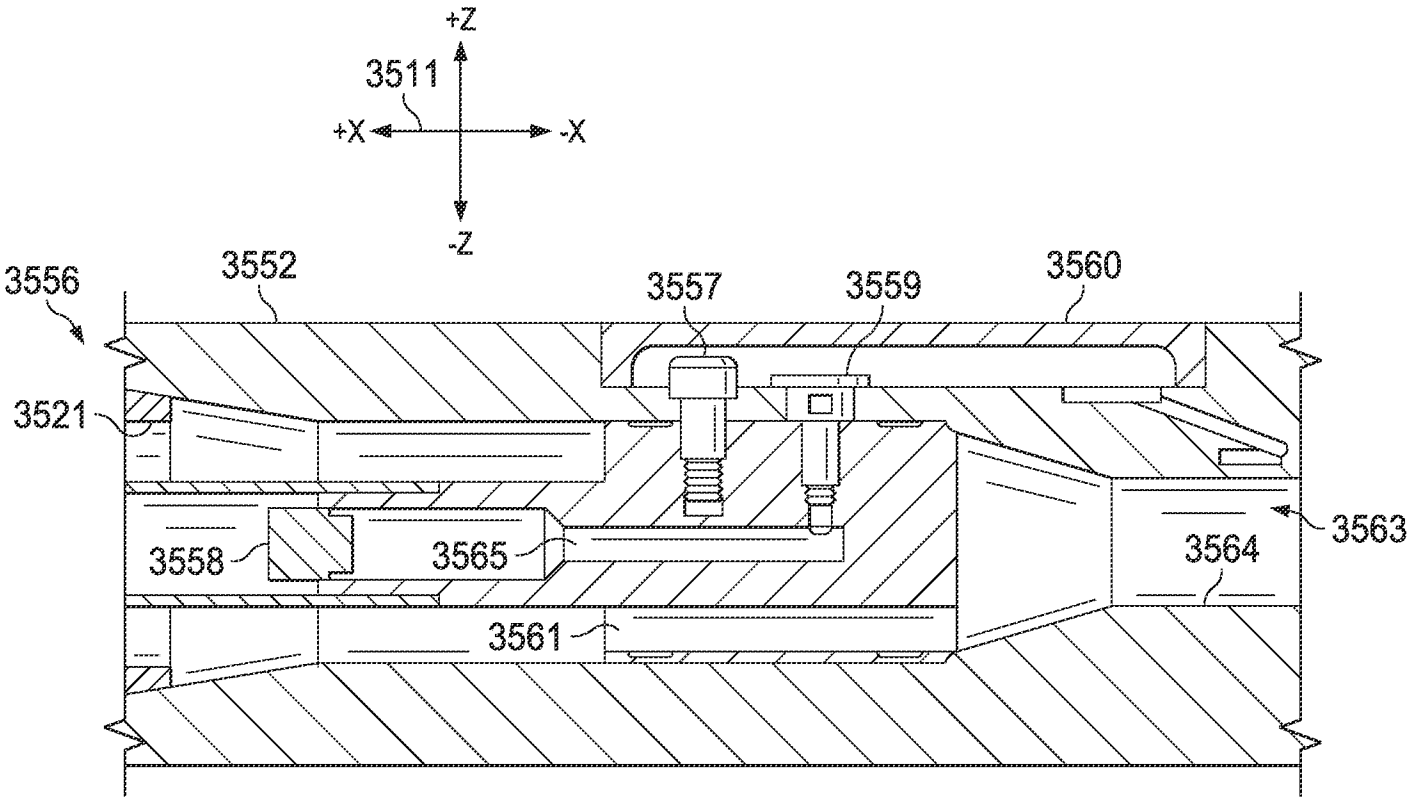
FIG. 38*a* is a magnified view of the area designated "A" in FIG. 35.
Figure 38B:
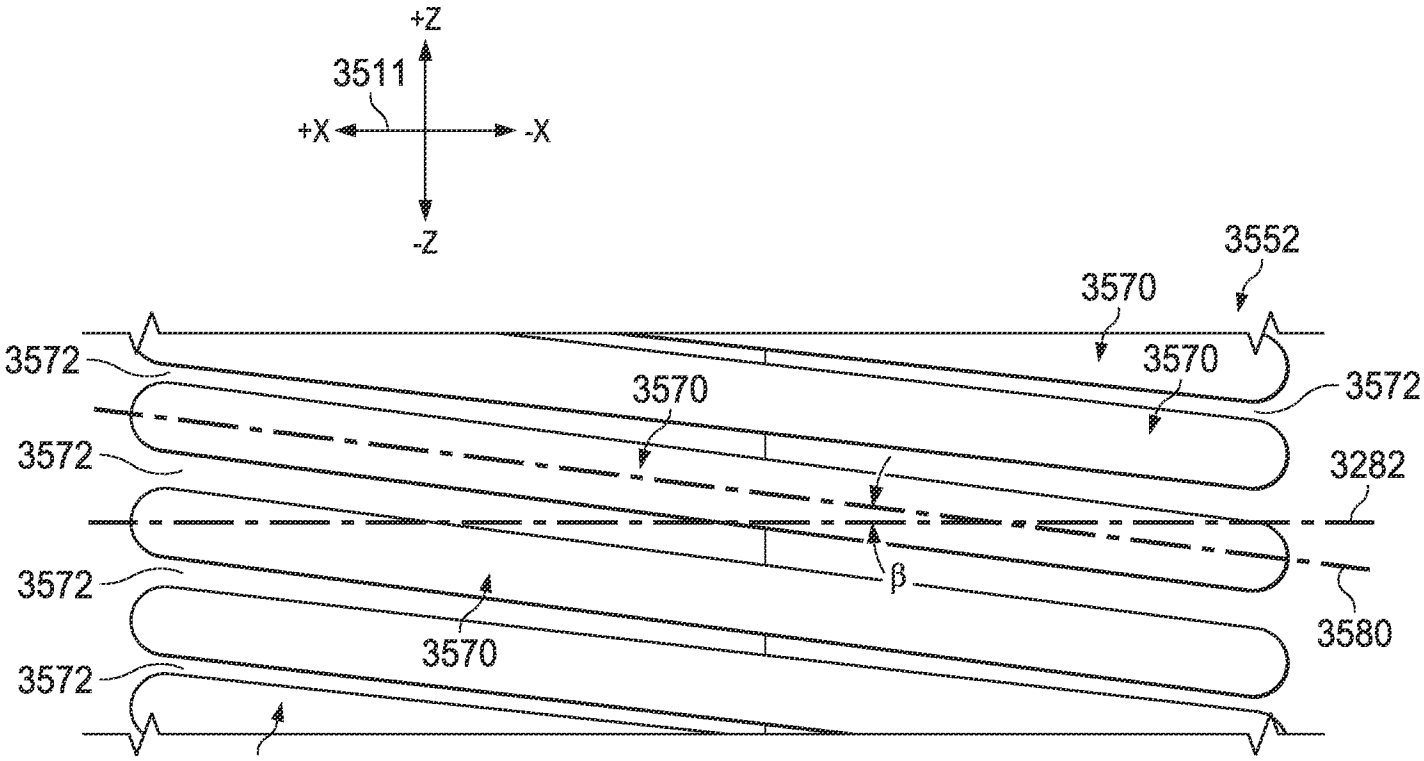
FIG. 38*b* is a side view of a mandrel of a torsional bearing assembly shown in FIG. 37.

The torsional bearing assembly 3514 comprises a casing 3550 and a bearing mandrel 3552 (see FIGS. 37 and 38*a*). The bearing casing 3550 and the bearing mandrel 3552 are disposed in a substantially coaxial arrangement, with the bearing mandrel 3552 located within the bearing casing 3550. The bearing mandrel 3552 is supported within the bearing casing 3550 by a radial bearing 3554. The bearing casing 3550 can translate axially in relation to the bearing mandrel 3552. The torsional bearing assembly 3512 also comprises a plurality of ball bearings 3555 for transmitting torque between the bearing mandrel 3552 and the bearing casing 3550. The ball bearings 3555 can be, for example, rock bit balls (other types of ball bearings can be used in the alternative).

Drilling torque is transmitted to an outer casing 3521 of the turbine-alternator module 3520 by way of a drill pipe 3522 located up-hole of the turbine-alternator module 3520 (see FIG. 35). The bearing mandrel 3552 is secured to the outer casing 3521 so that the drilling torque is transferred to the bearing mandrel 3552. The bearing mandrel 3552 therefore rotates, and translates axially with the outer casing 3521.

A centralizer feed-thru 3556 is positioned within the bearing mandrel 3552, proximate the up-hole end thereof, and is secured to the bearing mandrel 3552 by a locking pin 3557 (see FIG. 35). The centralizer feed-thru 3556 can be supported by one or more ribs (not shown).

The centralizer feed-thru 3556 facilitates routing of electrical signals and power between the turbine-alternator assembly 3520 and the torsional bearing assembly 3512. In particular, the centralizer feed-thru 3556 includes a multi-pin connector 3558 for electrically connecting the centralizer feed-thru 3556 to the turbine-alternator assembly 3520. The centralizer feed-thru 3556 also includes a second electrical connector 3559. Wiring (not shown) is routed from the connector 3558 to the connector 3559 by way of a passage 3565 formed within the centralizer feed-thru 3556. (Additional wiring (also not shown) is routed from the electrical connector 3559 and through a wireway formed in the bearing mandrel 3552.) The centralizer feed-thru 3556 also includes a removable panel 3560 for providing access to the locking pin 3557 and the connector 3559.

The centralizer feed-thru 3556 has a passage 3561 formed therein. The passage 3561 adjoins a passage 3563 defined in the bearing mandrel 3552 by an inner surface 3564 thereof. The passage 3563 receives drilling mud from the passage 3561.

The bearing mandrel 3552 has a plurality of grooves 3570 formed in an outer surface 3572 thereof (see FIG. 38*a*). The grooves 3570 are substantially parallel, and are spaced apart in substantially equal angular increments along the outer surface 3572. (The grooves 3570 can be spaced apart in unequal angular increments in alternative embodiments.) The surfaces of the bearing mandrel 3552 that define the grooves 3570 each have substantially semi-circular shape, to accept the substantially spherical ball bearings 3555.

The depth of each groove 3570 is substantially constant along the length thereof. Preferably, the grooves 3570 are substantially straight. In other words, a longitudinal centerline 3580 of each groove 3570 is shaped substantially as a helix.

The bearing casing 3550 has a plurality of grooves 3574 formed on an inner surface 3576 thereof (see FIGS. 37 and 38*a*). The size, shape, and orientation of the grooves 3574 are approximately equal those of the grooves 3570.

Each groove 3574 faces a corresponding one of the grooves 3570 when the bearing casing 3550 and the bearing mandrel 3552 are assembled. Each corresponding groove 3570 and groove 3574 defines a passage 3578 for ten of the ball bearings 3555 (see FIG. 37). Each passage 3578 preferably has a length greater than a combined length of the ten ball bearings 3555 disposed therein, to facilitate translation of the ball bearings 3550 along the passage 3578. (The number of ball bearings 3555 within each groove 3570 is application dependent, and can vary with factors such as the amount of torque to be transferred between the bearing casing 3550 and the bearing mandrel 3552; more or less than ten of the ball bearings 3555 can be disposed in each groove 3570 in alternative embodiments.)

The grooves 3570 and the grooves 3574 are sized so that sufficient clearance exists between the walls of the grooves 3570, 3574 and the associated ball bearings 3555 to permit the ball bearings 3555 to translate in the lengthwise direction within the passages 3578.

Each groove 3570 preferably is angled in relation to a longitudinal centerline 3582 of the bearing mandrel 3552 (see FIG. 38*a*). (Axially-aligned grooves can be used in the alternative, for reasons discussed below.) (The longitudinal centerline 3582 of the bearing mandrel 3552 is oriented substantially in the axial ("x") direction). In particular, a centerline 3580 of each groove 3570 is oriented in relation to the centerline 3582 at a helix angle denoted by the reference symbol "β" in FIG. 38*b*. Preferably, the helix angle β lies within a range of approximately four degrees to approximately fifteen degrees.

The optimal value for the helix angle β is application dependent; a particular value is presented for exemplary purposes only. In particular, the optimal value for β can be calculated based on the following parameters: maximum torque (T) and maximum allowable axial force ($F_A$) to be transmitted through the drill string 3512; radial distance (R) between the centerline 3582 of the bearing mandrel 3552 and the centers of the ball bearings 3555; and maximum tangential force (Fc) on the ball bearings 3555 (equal to T/R). The helix angle $\beta = \text{arcsine}(F_A/F_C)$.

Drilling torque transmitted to the bearing mandrel 3552 from the turbine-alternator assembly 3520 exerts a tangential force, i.e., a force coincident with the "y-z" plane, on the ball bearings 3555. The tangential force is transferred to the ball bearings 3555 by way of the walls of the grooves 3570. The ball bearings 3555 transfer the torque to the bearing casing 3550 by way of the walls of the grooves 3574, thereby causing the bearing casing 3550 to rotate with the bearing mandrel 3552.

Movement of the ball bearings 3555 along the length of their respective passage 3580 can facilitate relative movement between the bearing mandrel 3552 and the bearing casing 3550 in the axial direction. Hence, the torsional bearing assembly 3514 substantially decouples the portion of the drill string 3512 down-hole of the vibration damping system 3510 from axial movement of the portion of the drill string 3512 up-hole of the vibration damping system 3510, and vice versa.

The use of the ball bearings 3555 is believed to minimize friction, and the sticking associated therewith, as the bearing mandrel 3552 translates axially in relation to the bearing casing 3550. Alternative embodiments can be configured with other means for facilitating relative axial movement between the bearing mandrel 3552 and the bearing casing 3550.

The bearing mandrel 3552 and the bearing casing 3550 are restrained from relative tangential movement, i.e., movement in the "y-z" plane, due to the substantially straight geometry of the passages 3578, and because the ball bearings 3555 remain at a substantially constant distance from the centerline 3582 of the bearing mandrel 3552 as the ball bearings 3557 translate along their associated passages 3578.

The bearing casing 3550 is connected to the drill bit 3513 by way of the valve assembly 3516, the spring assembly 3518, and the portion of the drill string 3512 located down-hole thereof. The bearing casing 3550 therefore rotates with the drill bit 3513, and translates with the drill bit 3513 in the axial direction. Hence, axial and torsional vibrations of the drill bit 3513 are transmitted up-hole by way of the drill string 3512, to the bearing casing 3550.

Orienting the passages 3578 at the helix angle β, it is believed, can transform at least a portion of the torsional vibration acting on the bearing casing 3550 into axial vibration. In particular, the angled orientation of the passages 3578 permits the bearing casing 3550 to rotate (by a minimal amount) in relation to the bearing mandrel 3552 in response to torsional vibration. The rotation of the bearing casing 3550 is converted into an axial force due to the angled orientation of the passages 3578. Hence, the torsional vibration acting on the bearing casing 3550 can be converted, at least in part, into axial vibration acting on the bearing mandrel 3552. This axial vibration, as discussed below, can be transferred to and damped by the valve assembly 3516 and the spring assembly 3518. (In addition, the angled orientation of the passages 3578 is believed to generate friction damping that further reduces the torsional vibration.)

It should be noted that the grooves 3570, 3574 in alternative embodiments can be formed so that the passages 3570 extend in a direction substantially parallel to the longitudinal centerline 3582 of the bearing mandrel 3552. (Torsional vibration of the drill bit 3513 will not be converted into axial vibration in the above-described manner, in these types of embodiments.)

The torsional bearing assembly 3514 also comprises a linear variable displacement transducer (LVDT) 3584 for measuring the relative displacement of the bearing casing 3550 and the bearing mandrel 3552 in the axial direction (see FIG. 37). The LVDT 3584 comprises an array of axially-spaced magnetic elements 3586 embedded in the bearing casing 3550, proximate the inner surface 3576 thereof. The LVDT 3584 also comprises a sensor 3588, such as a Hall-effect sensor, mounted on the bearing mandrel 3552 so that the sensor 3588 is magnetically coupled to the magnetic elements 3586.

The sensor 3588 produces an electrical output as a function of the position of the sensor 3588 in relation to the array of magnetic elements 3586. The LVDT 3584 thereby can provide an indication of the relative axial positions of the bearing casing 3550 and the bearing mandrel 3552. Moreover, the rate of change of the output is a function of the rate of change in the relative positions of the sensor 3588 and the array of magnetic elements 3586. Hence, the LVDT 3584 can provide an indication of the relative axial displacement, velocity, and acceleration of the bearing casing 3550 and the bearing mandrel 3552.

The torsional bearing assembly 3514 also includes a compensation piston 3590 (see FIG. 37). The compensation piston 3590 is positioned between the bearing mandrel 3552 and the bearing casing 3550, proximate an up-hole end of the bearing casing 3550. An up-hole side 3590' of the compensation piston 3590 is exposed to drilling mud. A down-hole side 3590" of the compensation piston 3590 is exposed to compensation oil used to equalize the pressure within the interior of the vibration damping system 3510.

The compensation piston 3590 can slide in the axial direction in relation to the bearing casing 3550 and the bearing mandrel 3552, in response to a pressure differential between the drilling mud and the compensation oil. This feature can to help to equalize the pressure between the compensation oil and the drilling mud, and compensate for thermal expansion of the compensation oil. In particular, the movement of the compensation piston 3590 can help to pressurize the compensation oil as the distance of the drill bit 3513 below ground level increases (thereby causing an increase in the pressure of the drilling mud).

Three reciprocating seals 3591 are positioned in grooves 3592 formed around the outer circumference of the compensation piston 3590 (see FIG. 37). The seals 3591 substantially isolate the compensation oil from the drilling mud. Two of the seals 3591 preferably face the drilling mud, so as to discourage infiltration of the drilling mud into the compensation oil.

Each seal 3591 includes a heel 3593, a lip (scraper) 3594, and an extension 3595. The lip 3594 adjoins the heel 3593, and forms part of the inner diameter of the seal 3591. The extension 3595 adjoins the heel 3593, and forms part of the outer diameter of the seal 3591. The heel 3593, lip 3594, and extension 3595 preferably are formed from a wear and extrusion-resistant material, such as a blend of polytetrafluoroethylene (PTFE) and carbon-graphite.

The heel 3593, lip 3594, and extension 3595 define a groove 3596. A spring 3597 is disposed in the groove 3596.

The spring 3597 preferably is a ribbon spring. Preferably, the spring 3597 is formed from a resilient, corrosion-resistant material such as Elgiloy. The spring 3597 exerts a force on the lip 3594 in the radially-outward direction. The force urges the lip 3594 into contact with the adjacent surface of the bearing mandrel 3552, and can help to maintain this contact as the lip 3594 wears.

The groove 3596 preferably is sized so that the surface area of the seal 3591 that defines the groove 3596 is minimal. This feature can help to minimize the pressure forces exerted on the lip 3594 by the drilling mud or the compensation oil.

The geometry of the lip 3594, it is believed, causes the lip 3594 to scrape (rather than slide over) the drilling mud or the compensation oil on the adjacent surface of the bearing mandrel 3552 as the compensation piston 3590 translates in relation thereto (the seals 3591 therefore are believed to be particularly well suited for use with an abrasive materials such as drilling mud or magnetorheological fluid).

The extension 3595 helps to maintain spacing between the lip 3594, and the gap between the bearing mandrel 3552 and the compensation piston 3590. This feature therefore can reduce the potential for the lip 3594 to become trapped in the gap and damaged during movement of the compensation piston 3590.

The heel 3593 preferably is sized so that the height of the seal 3591 exceeds the height of the corresponding groove 3592. The seals 3591 therefore can act as glide rings that support the compensation piston 3590 on the bearing mandrel 3552.

The relatively large size of the heel 3593 is believed to help the heel 3593 resist the potentially large differential pressures that can form across the seal 3591.

Figure 39:
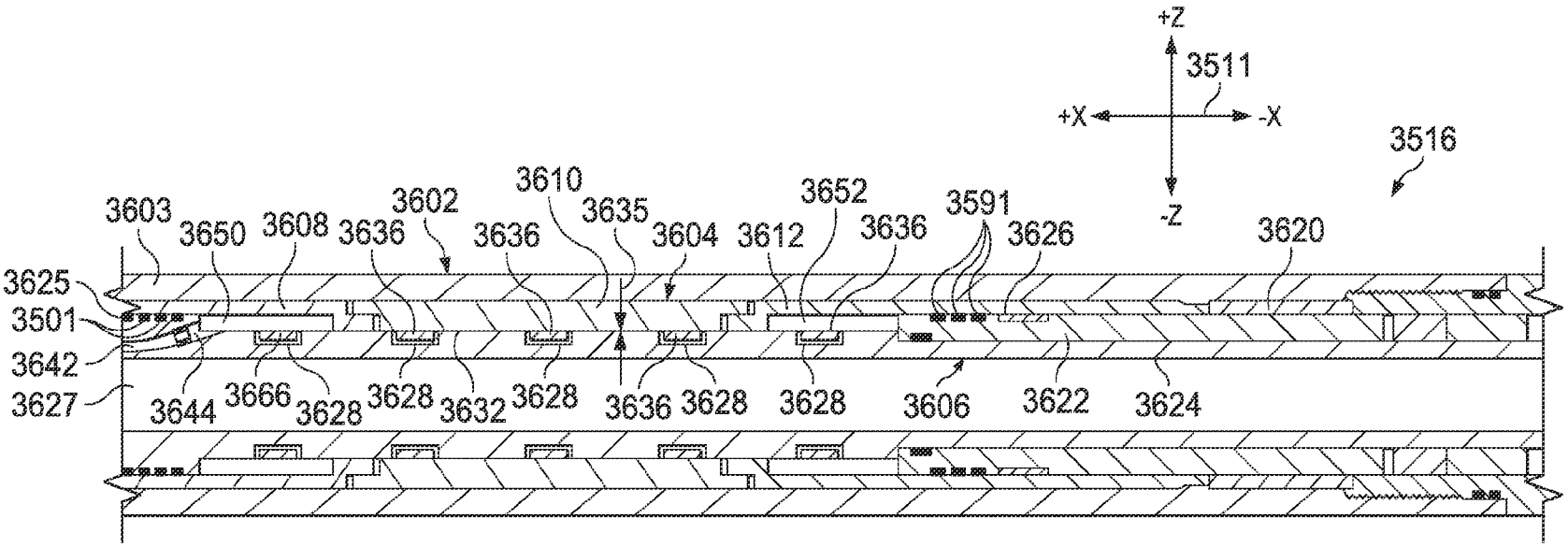
FIG. 39 is a longitudinal cross-sectional view of a valve assembly of the vibration damping system shown in FIG. 35.

The valve assembly 3516 is located immediately down-hole of the torsional bearing assembly 3512 (see FIG. 39). The valve assembly 3516 comprises a valve casing 3602. The valve casing 3602 comprises an outer casing 3603, and a housing 3604 positioned within the outer casing 3603.

The valve assembly 3516 also comprises a coil mandrel 3606 positioned within the valve casing 3602 (see FIG. 39). The outer casing 3603, housing 3604, and coil mandrel 3606 are disposed in a substantially coaxial arrangement. The coil mandrel 3606 preferably is formed from a material having a high magnetic permeability and a low magnetic susceptibility, such as 3610 stainless steel.

The coil mandrel 3606 is secured to the bearing mandrel 3552 so that the coil mandrel 3606 rotates, and translates axially with the bearing mandrel 3552.

As shown in FIG. 35, the outer portion 3603 of the valve casing 3602 is secured to the bearing casing 3550 so that the drilling torque is transferred from the bearing casing 3550 to the valve casing 3502. The valve casing 3502 therefore rotates, and translates axially with the bearing casing 3550.

The housing 3604 preferably comprises a first portion 3608, and a second portion 3610 located down-hole of the first portion 3608 (see FIG. 39). The housing 3904 also comprises a third portion 3612 located down-hole of the second portion 3610. (It should be noted that the housing 3604 can be formed as one piece in alternative embodiments. Moreover, the housing 3604 and the outer casing 3603 can be formed as one piece in alternative embodiments.)

The up-hole end of the first portion 3608 abuts a lip (not shown) on the outer casing 3603 of the valve casing 3602. The down-hole end of the third portion 3612 abuts a radial bearing 3620 of the valve assembly 3516 (see FIG. 39). This arrangement restrains the housing 3604 from axial ("x" direction) movement in relation to the outer casing 3603. (The housing 3604 therefore translates axially with the outer casing 3603.)

The valve assembly 3516 also comprises a sleeve 3622 (see FIG. 39). The sleeve 3622 is concentrically disposed around portion of the coil mandrel 3606, proximate the down-hole end thereof. The sleeve 3622 is secured to the coil mandrel 3606 so that the sleeve 3622 rotates, and translates axially with the coil mandrel 3606.

A first linear bearing 3625 is positioned in a groove formed around the coil mandrel 3606, proximate the up-hole end thereof. A second linear bearing 3626 is positioned in a groove formed around the sleeve 3622. The first and second linear bearings 3625, 3626 help to support the coil mandrel 3606 and the sleeve 3622, and facilitate axial movement of the coil mandrel 3606 and the sleeve 3622 in relation to the housing 3604 (and the valve casing 3602).

An inner surface 3624 of the coil mandrel 3606 defines a passage 3627 for permitting drilling mud to flow through the valve assembly 3516. The passage 3627 adjoins the passage 3563 formed in the bearing mandrel 3552.

The coil mandrel 3606 has a plurality of outwardly-facing recesses 3628 formed around a circumference thereof (see FIG. 39). Adjacent ones of the recesses 3628 are separated by outer surface portions 3630 of the coil mandrel 3606.

The coil mandrel 3606 and the second portion 3610 of the housing 3604 are sized so that a clearance, or gap 3635 exists between an inner surface 3632 of the second portion 3610, and the adjacent outer surface portions 3630 of the coil mandrel 3606 (see FIG. 39). The gap 3635 preferably is within the range of approximately 0.030 inch to approximately 0.125 inch. (The optimal value, or range of values for the gap 3635 is application-dependent; a specific range of values is presented for exemplary purposes only.)

The valve assembly 3516 also comprises a plurality of coils 3636. Each of the coils 3636 is wound within a respective one of the recesses 3628. Adjacent ones of the coils 3636 preferably are wound in opposite directions (the purpose of this feature is discussed below).

A groove 3640 is formed in each of the outer surface portions 3630 to facilitate routing of the wiring for the coils 136 between adjacent ones of the recesses 3628. The grooves 3640 each extend substantially in the axial ("x") direction. A wireway 3642 and an electrical feed thru 3644 are formed in the coil mandrel 3606 to facilitate routing of the wire 3638 from the up-hole end of the coil mandrel 3606 to the recesses 3628 (see FIG. 39). (The coils 3636 can be positioned on the valve casing 3602 instead of (or in addition to) the coil mandrel 3606 in alternative embodiments.)

The coils 3636 each generate a magnetic field 3649 in response to the passage of electrical current therethrough. The coils 3636 can be electrically connected to a controller 3646 mounted in the turbine-alternator assembly 3520 (see FIG. 36). The controller 3646 can be powered by an alternator 3647 of the turbine-alternator assembly 3520. The controller 3646 can supply an electrical current to the coils 3636. The controller 3646 can control the magnitude of the electrical current to vary the strength of the aggregate magnetic field generated by the coils 3636. Further details relating to this feature are presented below.

The controller 3646 is depicted as being mounted within the turbine-alternator assembly 3520 for exemplary purposes only. The controller 3646 can be mounted in other locations, including above-ground locations, in the alternative.

The first portion 3608 of the housing 3604 and the coil mandrel 3606 define a circumferentially-extending first, or up-hole, chamber 3650 (see FIG. 39). The third portion 3612 of the housing 3604 and the coil mandrel 3606 define a circumferentially-extending second, or down-hole chamber 3652.

Figure 40:
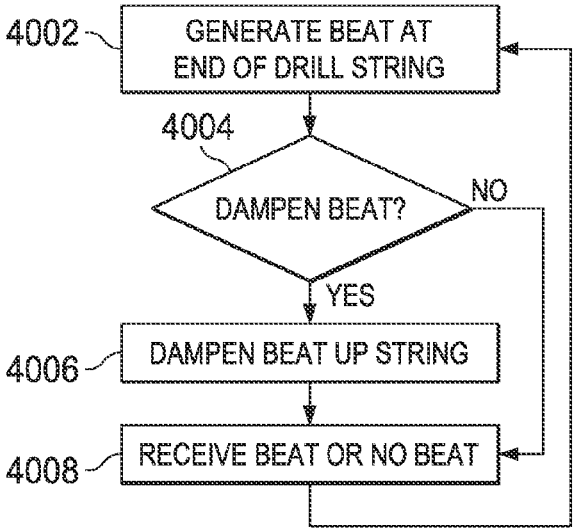
FIG. 40 is a flow-diagram illustrating one example of the operation of a system such as that illustrated in FIG. 28.

Referring now to FIG. 40, there is illustrated a flow diagram describing the manner in which pulses/beats generated at the end of the drill string may be dampened at a point remotely located from the vibration generation mechanism 2804 in order to provide various types of communication and control up the drill string from the bottom of a borehole. Initially, the pulses or beats are generated at the end of the drill string at step 4002 by the vibration mechanism 2804. A control mechanism determines at inquiry step 4004 if the beat generated by the vibration mechanism 2804 needs to be dampened in order to provide the communication or control desired responsive to the pulse or beats. If not, control passes on to step 4008. If the beat is to be dampened, the dampening mechanism 2806 will dampen the beat at the remote location on the string at step 4006. The beat or dampened beat are received and detected at step 4008 at a location of the drill string 2808 and utilized in the communication or control of drill operations as described herein. The process returns back to step 4002 to generate a next beat or pulse and the process repeats until desired information transmission or control is achieved.

Referring to FIGS. 19-22, an embodiment of a portion of a system 2000 is illustrated. The system 2000 may be similar to the system 300 of FIG. 3 in that the system 2000 provides control over vibration-based communications. In the present embodiment, an encoder plate 2001 includes a static inner ring 2002 supporting inner ramps 2004 and a moving outer ring 2006 supporting outer ramps 2008 (e.g., as illustrated in FIG. 8C by outer ramps 812 and inner ramps 816). The outer ring 2006 is able to move independently from the inner ring 2002. An interface 2014 between the inner and outer rings 2002 and 2006 may be configured to reduce wear and friction. Anvil plate ramps 2010 (e.g., as illustrated in FIG. 8A by ramps 802) are positioned opposite the inner and outer ramps 2004 and 2008. The orientation control involves a spring loaded helical ramp system with spring 2012.

Figure 19:
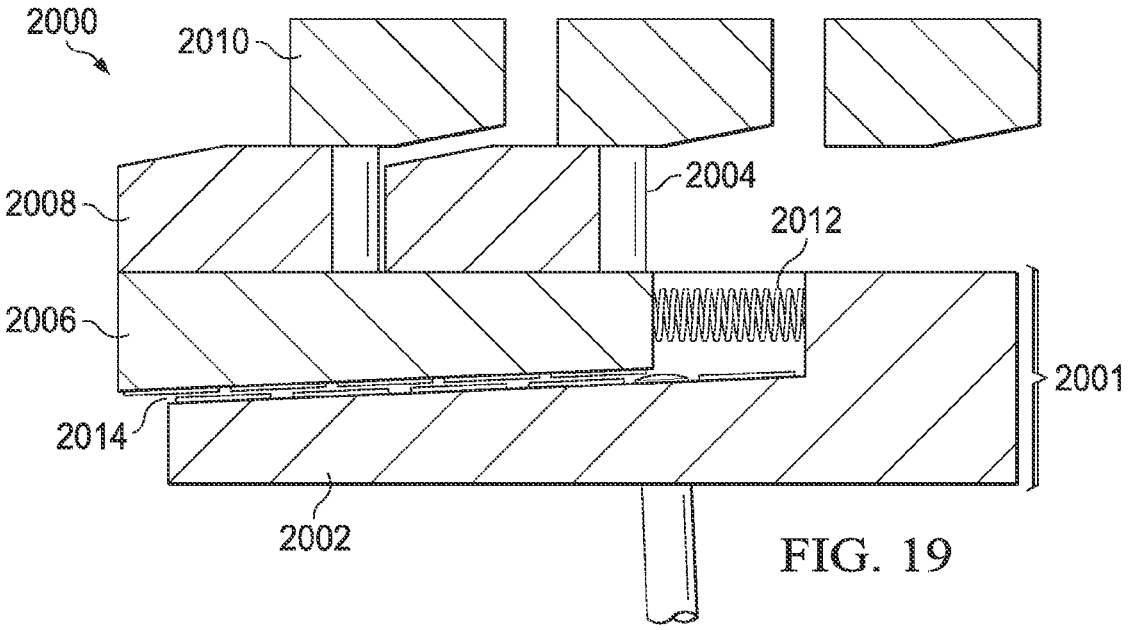
FIGS. 19-22 illustrate another embodiment of a vibration mechanism.
Figure 20:
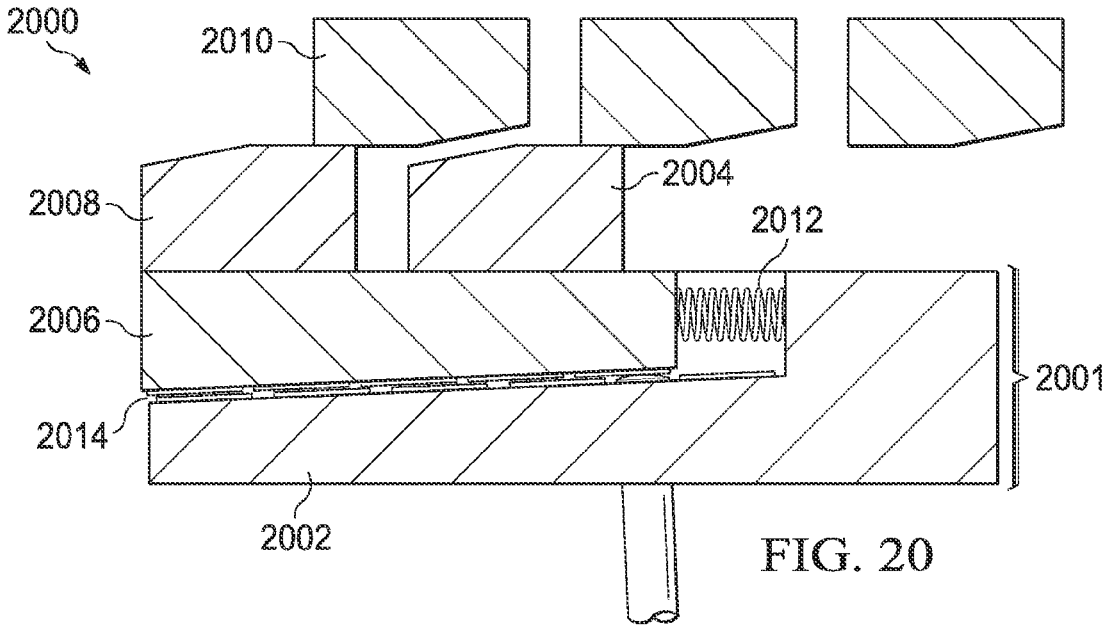
Figure 21:
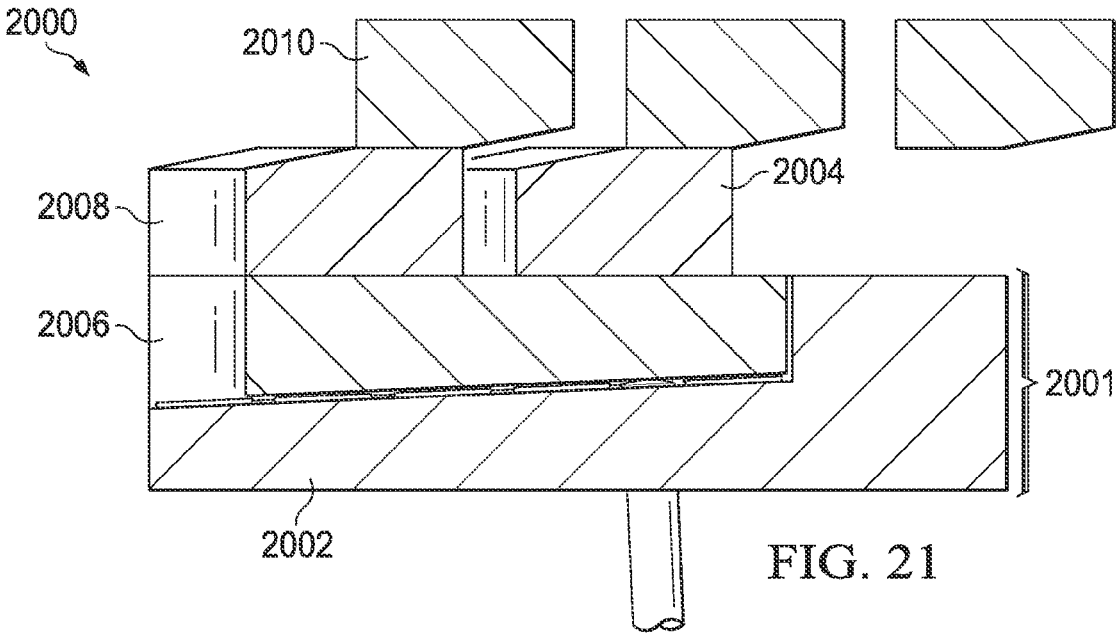
Figure 22:
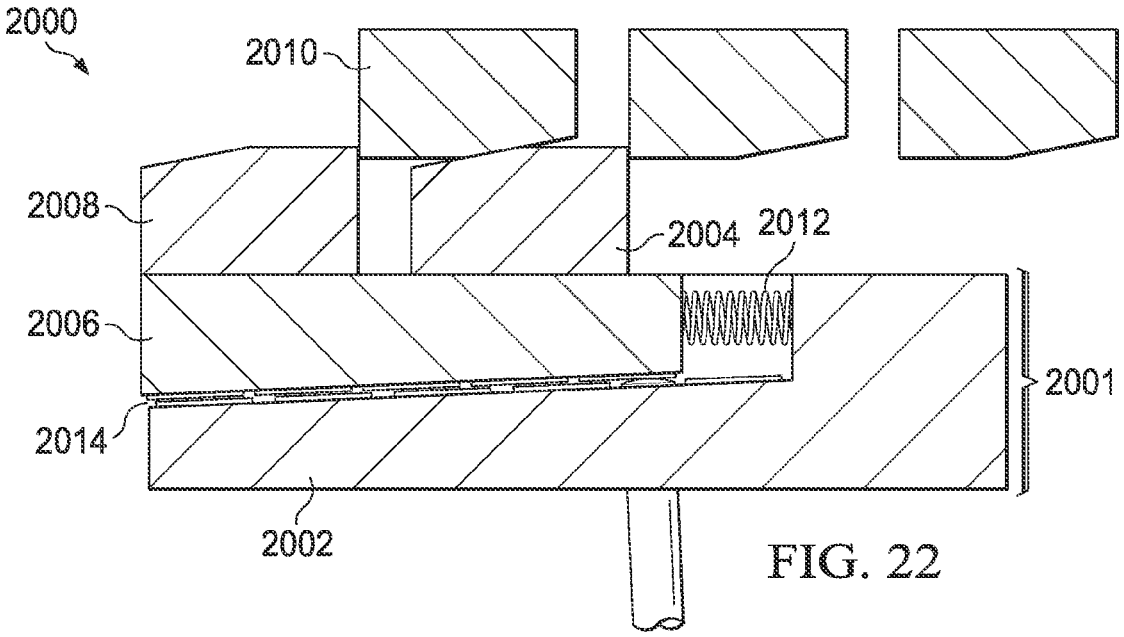

As shown in FIG. 19, the anvil ramps 2010 are initially in contact with the inner ramps 2004. In operation, anvil ramps 2010 move up the slopes of the inner ramps 2004, repeatedly dropping off the cliff. The outer ramps 2008 of the moving outer ring 2006 will be pushed up a helical ramp that supports the outer ring 2008 by an actuation device (FIG. 19). Actuation can be induced by a solenoid, electric motor, hydraulic valve, etc. The amount of actuation energy is minimal as the helical ramp will cause the outer ramps 2008 to make contact with the rotating anvil plate ramps 2010, which will then drag the outer ring 2006 further up the helical ramp in a wedge-like, increasing contact pressure relationship (FIG. 20) until a positive stop is reached. During this motion, the ejector spring 2012 is compressed. When the outer ring 2006 is in its fully deployed state, the outer ramps 2008 will support the anvil plate ramps 2010 between the static encoder plate's support regions and eliminate the impact that would otherwise be generated by the relative axial motion (FIG. 21).

Once the anvil plate ramps 2010 have rotated to a position no longer in contact with the outer ramps 2008, the friction force holding the outer ring 2006 against the positive stop will no longer be present and the ejector spring 2012 will push the outer ring 2006 back to its neutral state where no friction force acts upon it due to the axial movement in the helical supporting ramp. With this approach, a high speed state change can occur with the moving encoder ring 2006 without fighting against the rotation of a mandrel shaft as the energy to change states is primarily provided by the rotating mandrel.

In still another embodiment, the impact source may be changed. As described previously, the WOB of the BHA may be used as the source of the impact force. In the present embodiment, a strong spring may be used in the BHA as the source of the impact force, which removes the dependency on WOB. In such embodiments, the encoding approach, formation evaluation, and basic mechanism need not change significantly.

Figure 23A:
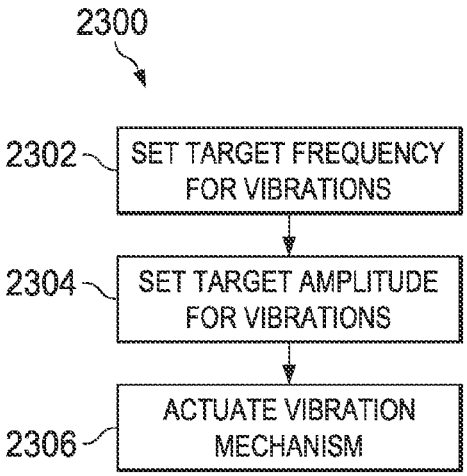
FIGS. 23A and 23B illustrate flow charts of embodiments of methods that may be used to cause, tune, and/or otherwise control vibrations.

Referring to FIG. 23A, a method 2300 illustrates one embodiment of a process that may be executed using a system such as the system 900, although other systems or combinations of system components described herein may be used to cause, tune, and/or otherwise control vibrations. In step 2302, a control system may be used to set a target frequency for vibrations using a tunable encoder plate. For example, the control system may be the system 48 of FIG. 1A or may be a system such as is disclosed in previously incorporated U.S. Pat. No. 8,210,283, although it is understood that many different systems may be used to execute the method 2300. In step 2304, the control system may be used to set a target amplitude for the vibrations. In step 2306, the vibration mechanism may be activated to cause vibrations at the target frequency and amplitude. If the vibration mechanism is already activated, step 2306 may be omitted.

Figure 23B:
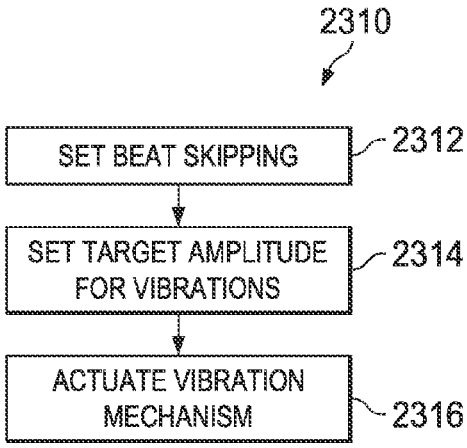

Referring to FIG. 23B, a method 2310 illustrates one embodiment of a process that may be executed using a system such as the system 900, although other systems or combinations of system components described herein may be used to cause, tune, and/or otherwise control vibrations. In step 2312, a control system may be used to set a beat skipping mechanism using an MR fluid valve assembly. For example, the control system may be the system 48 of FIG. 1A or may be a system such as is disclosed in previously incorporated U.S. Pat. No. 8,210,283, although it is understood that many different systems may be used to execute the method 2310. In step 2314, the control system may be used to set a target amplitude for the vibrations. In step 2316, the vibration mechanism may be activated to cause vibrations at the target frequency and amplitude. If the vibration mechanism is already activated, step 2316 may be omitted.

Figure 24A:
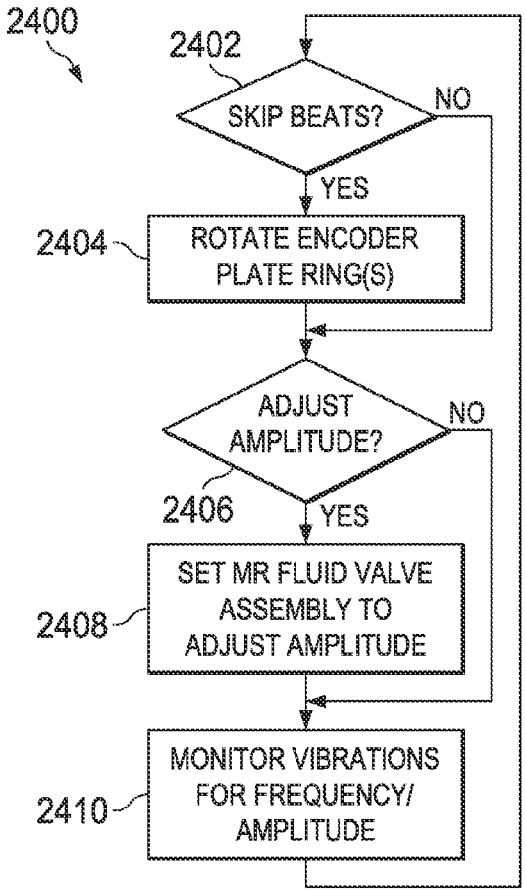
FIGS. 24A and 24B illustrate flow charts of more detailed embodiments of the methods of FIGS. 23A and 23B, respectively, that may be used with the system of FIG. 9A.

Referring to FIG. 24A, a method 2400 illustrates a more detailed embodiment of the method 2300 of FIG. 23A using the components of the system 900, including the encoder plate 806 of FIG. 8C with the outer encoder ring 808 and inner encoder ring 810, and the MR fluid valve assembly 904 of FIG. 9A. Accordingly, the method 2400 enables vibrations to be tuned in frequency and/or controlled in amplitude.

In step 2402, a determination may be made as to whether the frequency is to be tuned. If the frequency is to be tuned, the method 2400 moves to step 2404, where one or both of the outer encoder ring 808 and inner encoder ring 810 may be moved to configure the encoder plate 806 to produce a target frequency in conjunction with an anvil plate as previously described. After setting the encoder plate 806 or if the determination of step 2402 indicates that the frequency is not to be tuned, the method 2400 moves to step 2406.

In step 2406, a determination may be made as to whether the amplitude is to be adjusted. If the amplitude is to be adjusted, the method 2400 moves to step 2408, where the strength of the magnetic field produced by the energizer coil 1324 may be altered to adjust the impact on the anvil surface 1330 and so adjust the amplitude of the vibrations. After altering the strength of the magnetic field or if the determination of step 2406 indicates that the amplitude is not to be adjusted, the method 2400 moves to step 2410, where vibrations may be monitored as previously described. In some embodiments, some or all steps of the method 2400 may be performed while vibrations are occurring, while in other embodiments, some or all steps may only be performed when little or no vibration is occurring.

Figure 24B:
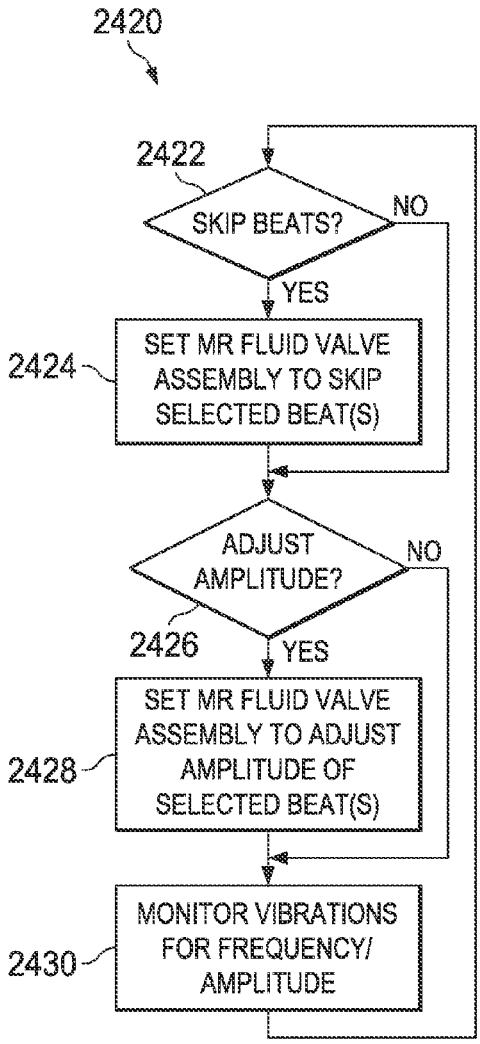

Referring to FIG. 24B, a method 2420 illustrates a more detailed embodiment of the method 2310 of FIG. 23B using the components of the system 900, including the encoder plate 104 of FIG. 1C with a single encoder ring, and the MR fluid valve assembly 904 of FIG. 9A. Accordingly, the method 2420 enables vibration beats to skipped and/or controlled in amplitude.

In step 2422, a determination may be made as to whether beats are to be skipped. If beats are to be skipped, the method 2420 moves to step 2424, the MR fluid valve assembly 904 is set to skip one or more selected beats. After setting the fluid valve assembly 904 or if the determination of step 2422 indicates that no beats are to be skipped, the method 2420 moves to step 2426.

In step 2426, a determination may be made as to whether the amplitude is to be adjusted. If the amplitude is to be adjusted, the method 2420 moves to step 2428, where the strength of the magnetic field produced by the energizer coil 1324 may be altered to adjust the impact on the anvil surface 1330 and so adjust the amplitude of the vibrations. After altering the strength of the magnetic field or if the determination of step 2426 indicates that the amplitude is not to be adjusted, the method 2420 moves to step 2430, where vibrations may be monitored as previously described. In some embodiments, some or all steps of the method 2420 may be performed while vibrations are occurring, while in other embodiments, some or all steps may only be performed when little or no vibration is occurring.

Figure 25:
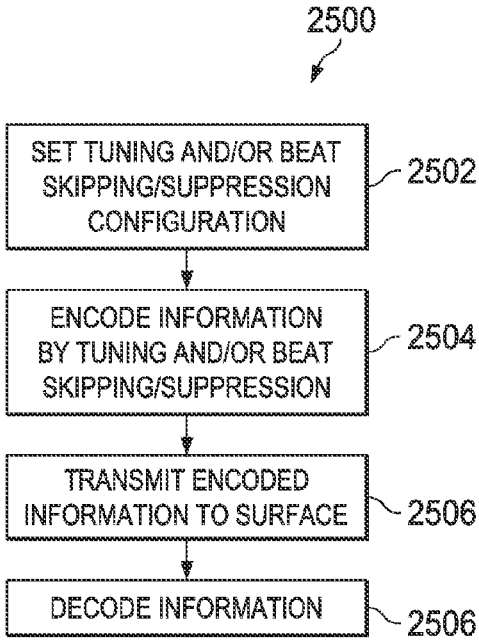
FIG. 25 illustrates a flow chart of one embodiment of a method that may be used to encode and transmit information within the environment of FIG. 1A.

Referring to FIG. 25, a method 2500 illustrates one embodiment of a process that may be executed using a system such as the system 900, although other systems or combinations of system components described herein may be used to cause, tune, and/or otherwise control vibrations. In step 2502, a control system (e.g., the control system 48 of FIG. 1A) may be used to configure a tunable encoder plate to set a target frequency for vibrations and/or to configure an MR fluid valve assembly to skip/suppress beats. In step 2504, information may be encoded downhole based on the tuning and/or beat skip/suppression configurations. In step 2506, the encoded information may be transmitted to the surface via mud and/or one or more other transmission mediums. The transmission may occur directly or via a series of relays. In step 2508, the information may be decoded.

Figure 26:
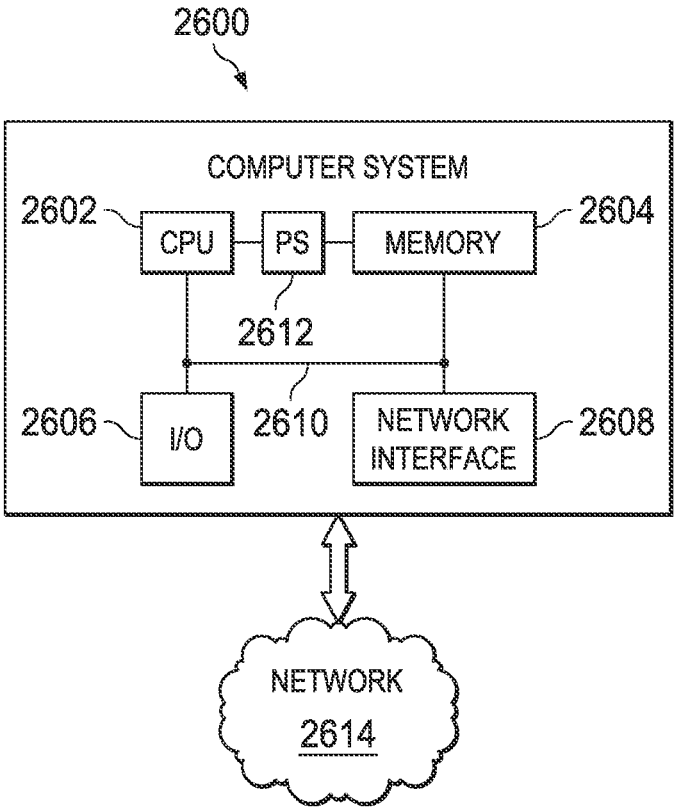
FIG. 26 illustrates one embodiment of a computer system that may be used within the environment of FIG. 1A.

Referring to FIG. 26, one embodiment of a computer system 2600 is illustrated. The computer system 2600 is one possible example of a system component or device such as the control system 48 of FIG. 1A. In scenarios where the computer system 2600 is on-site, such as within the environment 10 of FIG. 1A, the computer system may be contained in a relatively rugged, shock-resistant case that is hardened for industrial applications and harsh environments. It is understood that downhole electronics may be mounted in an adaptive suspension system that uses active dampening as described in various embodiments herein.

The computer system 2600 may include a central processing unit ("CPU") 2602, a memory unit 2604, an input/output ("I/O") device 2606, and a network interface 2608. The components 2602, 2604, 2606, and 2608 are interconnected by a transport system (e.g., a bus) 2610. A power supply (PS) 2612 may provide power to components of the computer system 2600, such as the CPU 2602 and memory unit 2604. It is understood that the computer system 2600 may be differently configured and that each of the listed components may actually represent several different components. For example, the CPU 2602 may actually represent a multi-processor or a distributed processing system; the memory unit 2604 may include different levels of cache memory, main memory, hard disks, and remote storage locations; the I/O device 2606 may include monitors, keyboards, and the like; and the network interface 2608 may include one or more network cards providing one or more wired and/or wireless connections to a network 2614. Therefore, a wide range of flexibility is anticipated in the configuration of the computer system 2600.

The computer system 2600 may use any operating system (or multiple operating systems), including various versions of operating systems provided by Microsoft (such as WINDOWS), Apple (such as Mac OS X), UNIX, and LINUX, and may include operating systems specifically developed for handheld devices, personal computers, and servers depending on the use of the computer system 2600. The operating system, as well as other instructions (e.g., software instructions for performing the functionality described in previous embodiments) may be stored in the memory unit 2604 and executed by the processor 2602. For example, if the computer system 2600 is the control system 48, the memory unit 2604 may include instructions for performing the various methods and control functions disclosed herein.

It will be appreciated by those skilled in the art having the benefit of this disclosure that this system and method for causing, tuning, and/or otherwise controlling vibrations provides advantages in downhole environments. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A system for producing controlled vibrations within a borehole comprising:

a vibration mechanism for generating an impact to produce a plurality of vibration beats, wherein the vibration mechanism is located substantially near a bottom hole assembly within the borehole; and a damping mechanism for selectively damping the plurality of vibration beats to encode information therein, wherein the damping mechanism is located remotely from the vibration mechanism along a drill string of the bottom hole assembly, wherein the damping mechanism is configured to selectively damp the vibration beats to a plurality of levels to encode the information therein.

2. The system of claim 1, wherein the vibration mechanism is configured to use mechanical energy provided by a mechanical energy source to enable translational movement of a first surface relative to a second surface to allow the first surface to repeatedly impact the second surface to produce the plurality of vibration beats.

3. The system of claim 1, wherein the plurality of vibration beats occur at a fixed frequency.

4. The system of claim 1, wherein the vibration damping mechanism is further configured to dampen a particular vibration beat below a detection threshold to skip the particular vibration beat while encoding information.

5. The system of claim 1, wherein defined amplitude values of the vibration beats are bounded by a first amplitude value representing a full impact of the first and second surfaces and a second amplitude value that is below a detection threshold.

6. The system of claim 1, wherein the damping mechanism is further configured to reduce a frequency of the plurality of vibration beats to a desired frequency by damping the plurality of vibration beats at a selected frequency.

7. The system of claim 1 further comprising:

a sensor positioned to detect the vibration beats; and a controller coupled to the sensor and configured to control the damping mechanism based on the plurality of vibration beats detected by the sensor.

8. The system of claim 1, wherein the plurality of levels includes at least one of a completely suppressed level and a partially suppressed level.

9. A method for producing controlled vibrations within a borehole comprising:

generating, at a location substantially near a bottom hole assembly within a bore hole, a plurality of vibration beats using an impact force; and selectively damping the plurality of vibration beats to a plurality of levels to encode information therein at a location on the drill string remotely located from the bottom hole assembly.

10. The method of claim 9, wherein the step of generating further comprises generating translational movement of a first surface relative to a second surface to allow the first surface to repeatedly impact the second surface to generate the plurality of vibration beats.

11. The method of claim 9, wherein the step of generating further comprises generating the plurality of vibration beats at a fixed frequency.

12. The method of claim 9, wherein the step of damping further comprises selectively damping a particular vibration beat below a detection threshold to skip the particular vibration beat while encoding information.

13. The method of claim 9, wherein the step of generating further comprises generating the plurality of vibration beats having define amplitude values bounded by a first amplitude value representing a full impact of the first and second surfaces and a second amplitude value that is below a detection threshold.

14. The method of claim 9, wherein the step of damping further comprises selectively damping the plurality of vibration beats at a selected frequency to reduce a frequency of the vibration beats to a desired frequency.

15. The method of claim 9 further comprising:

detecting the plurality of vibration beats with a sensor; and controlling the damping mechanism based on the plurality of vibration beats detected by the sensor.

16. The method of claim 9, wherein the plurality of levels includes at least one of a completely suppressed level and a partially suppressed level.

17. A system for producing controlled vibrations within a borehole comprising:

a vibration mechanism, located substantially near a bottom hole assembly within the borehole, to produce a plurality of vibration beats at a constant frequency, wherein the vibration mechanism is configured to use mechanical energy provided by a mechanical energy source to produce the plurality of vibration beats; and a damping mechanism for selectively damping the plurality of vibration beats to encode information therein, wherein the damping mechanism is located remotely from the vibration mechanism along a drill string of the bottom hole assembly, wherein the damping mechanism is further configured to reduce a frequency of the plurality of vibration beats to a desired frequency by damping vibration beats at a selected frequency.

18. The system of claim 17, wherein the damping mechanism is configured to selectively damp the plurality of vibration beats to a plurality of levels to encode the information therein.

19. The system of claim 18, wherein the plurality of levels includes at least one of a completely suppressed level and a partially suppressed level.

20. The system of claim 17, wherein the vibration damping mechanism is further configured to dampen a particular vibration beat below a detection threshold to skip the particular vibration beat while encoding information.

21. The system of claim 17, wherein defined amplitude values of the vibration beats are bounded by a first amplitude value representing a full impact of the first and second surfaces and a second amplitude value that is below a detection threshold.

22. The system of claim 17 further comprising:

a sensor positioned to detect the plurality of vibration beats: and a controller coupled to the sensor and configured to control the damping mechanism based on the plurality of vibration beats detected by the sensor.

23. A method for producing controlled vibrations within a borehole comprising:

generating, at a location substantially near a bottom hole assembly within a borehole, translational movement of a first surface relative to a second surface to allow the first surface to repeatedly impact the second surface to generate a plurality of vibration beats at a fixed frequency; and selectively damping the plurality of vibration beats to encode information therein and selectively damping the plurality of vibration beats at a selected frequency to reduce a frequency of the plurality of vibration beats to a desired frequency at a location on the drill string remotely located from the bottom hole assembly.

24. The method of claim 23, wherein the step of damping further comprises selectively damping the plurality of vibration beats to a plurality of levels to encode the information therein.

25. The method of claim 24, wherein the plurality of levels includes at least one of a completely suppressed level and a partially suppressed level.

26. The method of claim 23, wherein the step of damping further comprises selectively damping a particular vibration beat below a detection threshold to skip the particular vibration beat while encoding information.

27. The method of claim 23, wherein the step of generating further comprises generating the plurality of vibration beats having define amplitude values bounded by a first amplitude value representing a full impact of the first and second surfaces and a second amplitude value that is below a detection threshold.

28. The method of claim 23 further comprising:

detecting the plurality of vibration beats with sensor; and controlling the damping mechanism based on the plurality of vibration beats detected by the sensor.

* * * * *